US007467852B2

(12) United States Patent
Silverbrook et al.

(10) Patent No.: US 7,467,852 B2
(45) **Date of Patent: *Dec. 23, 2008**

(54) INKJET PRINTER WITH PRINTHEAD CARTRIDGE AND INK CARTRIDGE

(75) Inventors: Kia Silverbrook, Balmain (AU); Norman Michael Berry, Balmain (AU); Akira Nakazawa, Balmain (AU); Paul Ian Mackey, Balmain (AU); Garry Raymond Jackson, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 479 days.

This patent is subject to a terminal disclaimer.

(21) Appl. No.: 11/293,805

(22) Filed: Dec. 5, 2005

(65) Prior Publication Data

US 2007/0126819 A1 Jun. 7, 2007

(51) Int. Cl.
*B41J 2/14* (2006.01)

(52) U.S. Cl. ..... 347/49

(58) Field of Classification Search ..... 347/42, 347/43, 49, 50, 85

See application file for complete search history.

(56) References Cited

U.S. PATENT DOCUMENTS

| | | | | |
|---|---|---|---|---|
| 4,685,815 | A | 8/1987 | Baranyi | |
| 5,208,610 | A * | 5/1993 | Su et al. | 347/49 |
| 5,366,302 | A | 11/1994 | Masumura et al. | |
| 5,815,183 | A * | 9/1998 | Sasaki | 347/86 |
| 6,024,442 | A * | 2/2000 | Sato et al. | 347/85 |
| 6,350,025 | B1 * | 2/2002 | Morita et al. | 347/86 |
| 6,443,567 | B1 * | 9/2002 | Hayashi et al. | 347/85 |
| 7,261,397 | B2 * | 8/2007 | Morita | 347/84 |
| 2005/0134672 | A1 | 6/2005 | Williams et al. | |

FOREIGN PATENT DOCUMENTS

| | | |
|---|---|---|
| DE | 20012945 | 12/2000 |
| EP | 0313205 A2 | 4/1989 |
| EP | 1348562 A2 | 10/2003 |
| WO | WO 2005/108094 A1 | 11/2005 |

* cited by examiner

*Primary Examiner*—Anh T. N. Vo

(57) ABSTRACT

An inkjet printer comprising: a printer body; a printhead cartridge for installation in the printer body; an ink cartridge containing a supply of ink, the ink cartridge having a docking face for engagement with a complementary face to supply the printhead cartridge with ink; wherein, the complementary face is partially provided by the printhead cartridge and partially provided by the printer body.

19 Claims, 55 Drawing Sheets

INKJET PRINTER WITH PRINTHEAD CARTRIDGE AND INK CARTRIDGE

FIELD OF THE INVENTION

This invention relates to a printer having a replaceable printhead cartridge and replaceable ink cartridges. It has been developed primarily for simplifying replacement of ink cartridges and, in particular, for ensuring that replacement steps are not performed in an incorrect order.

CO-PENDING APPLICATIONS

The following applications have been filed by the Applicant simultaneously with the present application:

| | | | | |
|---|---|---|---|---|
| 11/293832 | 11/293838 | 11/293825 | 11/293841 | 11/293799 |
| 11/293796 | 11/293797 | 11/293798 | 11/293800 | 11/293802 |
| 11/293801 | 11/293808 | 11/293809 | 11/293804 | 11/293840 |
| 11/293803 | 11/293833 | 11/293834 | 11/293835 | 11/293836 |
| 11/293837 | 11/293792 | 11/293794 | 11/293839 | 11/293826 |
| 11/293829 | 11/293830 | 11/293827 | RKC001US | 7270494 |
| 11/293823 | 11/293824 | 11/293831 | 11/293815 | 11/293819 |
| 11/293818 | 11/293817 | 11/293816 | 11/293820 | 11/293813 |
| 11/293822 | 11/293812 | 7357496 | 11/293814 | 11/293793 |
| 11/293842 | 11/293811 | 11/293807 | 11/293806 | 11/293810 |

The disclosures of these co-pending applications are incorporated herein by reference.

CROSS REFERENCES TO RELATED APPLICATIONS

Various methods, systems and apparatus relating to the present invention are disclosed in the following US Patents/Patent Applications filed by the applicant or assignee of the present invention:

| | | | | | |
|---|---|---|---|---|---|
| 6750901 | 6476863 | 6788336 | 7249108 | 6566858 | 6331946 |
| 6246970 | 6442525 | 7346586 | 09/505951 | 6374354 | 7246098 |
| 6816968 | 6757832 | 6334190 | 6745331 | 7249109 | 7197642 |
| 7093139 | 10/636263 | 10/636283 | 10/866608 | 7210038 | 7401223 |
| 10/940653 | 10/942858 | 7364256 | 7258417 | 7293853 | 7328968 |
| 7270395 | 11/003404 | 11/003419 | 7334864 | 7255419 | 7284819 |
| 7229148 | 7258416 | 7273263 | 7270393 | 6984017 | 7347526 |
| 7357477 | 11/003463 | 7364255 | 7357476 | 11/003614 | 7284820 |
| 7341328 | 7246875 | 7322669 | 11/246676 | 11/246677 | 11/246678 |
| 11/246679 | 11/246680 | 11/246681 | 11/246714 | 11/246713 | 7399057 |
| 11/246671 | 11/246704 | 11/246710 | 11/246688 | 7399054 | 11/246715 |
| 7367648 | 7370936 | 7401886 | 11/246708 | 7401887 | 7384119 |
| 7401888 | 7387358 | 11/246694 | 10/922842 | 10/922848 | 6623101 |
| 6406129 | 6505916 | 6457809 | 6550895 | 6457812 | 7152962 |
| 6428133 | 7204941 | 7282164 | 10/815628 | 7278727 | 10/913373 |
| 10/913374 | 7367665 | 7138391 | 7153956 | 10/913380 | 10/913379 |
| 10/913376 | 7122076 | 7148345 | 11/172816 | 11/172815 | 11/172814 |
| 10/407212 | 7252366 | 10/683064 | 7360865 | 6746105 | 11/246687 |
| 11/246718 | 7322681 | 11/246686 | 11/246703 | 11/246691 | 11/246711 |
| 11/246690 | 11/246712 | 11/246717 | 7401890 | 7401910 | 11/246701 |
| 11/246702 | 11/246668 | 11/246697 | 11/246698 | 11/246699 | 11/246675 |
| 11/246674 | 11/246667 | 7156508 | 7159972 | 7083271 | 7165834 |
| 7080894 | 7201469 | 7090336 | 7156489 | 10/760233 | 10/760246 |
| 7083257 | 7258422 | 7255423 | 7219980 | 10/760253 | 10/760255 |
| 7367649 | 7118192 | 10/760194 | 7322672 | 7077505 | 7198354 |
| 7077504 | 10/760189 | 7198355 | 7401894 | 7322676 | 7152959 |
| 7213906 | 7178901 | 7222938 | 7108353 | 7104629 | 7303930 |
| 11/246672 | 7401405 | 11/246683 | 11/246682 | 7246886 | 7128400 |
| 7108355 | 6991322 | 7287836 | 7118197 | 10/728784 | 7364269 |
| 7077493 | 6962402 | 10/728803 | 7147308 | 10/728779 | 7118198 |
| 7168790 | 7172270 | 7229155 | 6830318 | 7195342 | 7175261 |
| 10/773183 | 7108356 | 7118202 | 10/773186 | 7134744 | 10/773185 |

-continued

| | | | | | |
|---|---|---|---|---|---|
| 7134743 | 7182439 | 7210768 | 10/773187 | 7134745 | 7156484 |
| 7118201 | 7111926 | 10/773184 | 7018021 | 7401901 | 11/060805 |
| 11/188017 | 11/097308 | 11/097309 | 7246876 | 11/097299 | 11/097310 |
| 7377623 | 7328978 | 7334876 | 7147306 | 09/575197 | 7079712 |
| 6825945 | 7330974 | 6813039 | 6987506 | 7038797 | 6980318 |
| 6816274 | 7102772 | 7350236 | 6681045 | 6728000 | 7173722 |
| 7088459 | 09/575181 | 7068382 | 7062651 | 6789194 | 6789191 |
| 6644642 | 6502614 | 6622999 | 6669385 | 6549935 | 6987573 |
| 6727996 | 6591884 | 6439706 | 6760119 | 7295332 | 6290349 |
| 6428155 | 6785016 | 6870966 | 6822639 | 6737591 | 7055739 |
| 7233320 | 6830196 | 6832717 | 6957768 | 09/575172 | 7170499 |
| 7106888 | 7123239 | 10/727181 | 10/727162 | 7377608 | 7399043 |
| 7121639 | 7165824 | 7152942 | 10/727157 | 7181572 | 7096137 |
| 7302592 | 7278034 | 7188282 | 10/727159 | 10/727180 | 10/727179 |
| 10/727192 | 10/727274 | 10/727164 | 10/727161 | 10/727198 | 10/727158 |
| 10/754536 | 10/754938 | 10/727160 | 10/934720 | 7171323 | 7278697 |
| 7369270 | 6795215 | 7070098 | 7154638 | 6805419 | 6859289 |
| 6977751 | 6398332 | 6394573 | 6622923 | 6747760 | 6921144 |
| 10/884881 | 7092112 | 7192106 | 11/039866 | 7173739 | 6986560 |
| 7008033 | 11/148237 | 7222780 | 7270391 | 7195328 | 7182422 |
| 7374266 | 10/854522 | 10/854488 | 7281330 | 10/854503 | 7328956 |
| 10/854509 | 7188928 | 7093989 | 7377609 | 10/854495 | 10/854498 |
| 10/854511 | 7390071 | 10/854525 | 10/854526 | 10/854516 | 7252353 |
| 10/854515 | 7267417 | 10/854505 | 10/854493 | 7275805 | 7314261 |
| 10/854490 | 7281777 | 7290852 | 10/854528 | 10/854523 | 10/854527 |
| 10/854524 | 10/854520 | 10/854514 | 10/854519 | 10/854513 | 10/854499 |
| 10/854501 | 7266661 | 7243193 | 10/854518 | 10/854517 | 10/934628 |
| 7163345 | 10/760254 | 10/760210 | 7364263 | 7201468 | 7360868 |
| 10/760249 | 7234802 | 7303255 | 7287846 | 7156511 | 10/760264 |
| 7258432 | 7097291 | 10/760222 | 10/760248 | 7083273 | 7367647 |
| 7374355 | 10/760204 | 10/760205 | 10/760206 | 10/760267 | 10/760270 |
| 7198352 | 7364264 | 7303251 | 7201470 | 7121655 | 7293861 |
| 7232208 | 7328985 | 7344232 | 7083272 | 11/014764 | 11/014763 |
| 7331663 | 7360861 | 7328973 | 11/014760 | 11/014757 | 7303252 |
| 7249822 | 11/014762 | 7311382 | 7360860 | 7364257 | 7390075 |
| 7350896 | 11/014758 | 7384135 | 7331660 | 11/014738 | 11/014737 |
| 7322684 | 7322685 | 7311381 | 7270405 | 7303268 | 11/014735 |
| 7399072 | 7393076 | 11/014750 | 11/014749 | 7249833 | 11/014769 |
| 11/014729 | 7331661 | 11/014733 | 7300140 | 7357492 | 7357493 |
| 11/014766 | 7380902 | 7284816 | 7284845 | 7255430 | 7390080 |
| 7328984 | 7350913 | 7322671 | 7380910 | 11/014717 | 11/014716 |
| 11/014732 | 7347534 | 11/097268 | 11/097185 | 7367650 | |

The disclosures of these applications and patents are incorporated herein by reference.

BACKGROUND OF THE INVENTION

Traditionally, most commercially available inkjet printers have a print engine which forms part of the overall structure and design of the printer. In this regard, the body of the printer unit is typically constructed to accommodate the printhead and associated media delivery mechanisms, and these features are integral with the printer unit.

This is especially the case with inkjet printers that employ a printhead that traverses back and forth across the media as the media is progressed through the printer unit in small iterations. In such cases the reciprocating printhead is typically mounted to the body of the printer unit such that it can traverse the width of the printer unit between a media input roller and a media output roller, with the media input and output rollers forming part of the structure of the printer unit. With such a printer unit it may be possible to remove the printhead for replacement, however the other parts of the print engine, such as the media transport rollers, control circuitry and maintenance stations, are typically fixed within the printer unit and replacement of these parts is not possible without replacement of the entire printer unit.

As well as being rather fixed in their design construction, printer units employing reciprocating type printheads are relatively slow, particularly when performing print jobs of full colour and/or photo quality. This is due to the fact that the printhead must continually traverse the stationary media to deposit the ink on the surface of the media and it may take a number of swathes of the printhead to deposit one line of the image.

Recently, it has been possible to provide a printhead that extends the entire width of the print media so that the printhead can remain stationary as the media is transported past the printhead. Such systems greatly increase the speed at which printing can occur as the printhead no longer needs to perform a number of swathes to deposit a line of an image, but rather the printhead can deposit the ink on the media as it moves past at high speeds. Such printheads have made it possible to perform full colour 1600 dpi printing at speeds in the vicinity of 60 pages per minute, speeds previously unattainable with conventional inkjet printers.

High print speeds require high precision and high speed paper movement, and as such, the entire print engine (printhead, paper handling mechanisms and control circuitry etc) must be configured accordingly to ensure high quality output.

Accordingly, there is a need to provide a print engine having a pagewidth printhead that can be readily employed within a printer body for consistent, high speed printing.

Unfortunately, individual nozzles on a printhead will malfunction through clogging, air bubbles in the ink, fabrication errors and so on. Obviously, this is detrimental to print quality. It is possible to combat this with dead nozzle compensation in the print engine controller (PEC) and nozzle redundancy (extra nozzles) on the printhead. However, eventually too many nozzles will fail for these mechanisms to work, and the print quality is compromised. By providing the printhead in a replaceable printhead cartridge, the printhead can be replaced when the print quality deteriorates, rather than replacing the entire printer. However, as the ink is also provided in cartridges, the printer will have two different types of cartridge and this adds another level of complexity when re-assembling the printer after replacement if a printhead cartridge. To avoid any user error and frustration, the sequence of installing the printhead cartridge and the ink cartridges into the printer should be as self evident as possible.

SUMMARY OF THE INVENTION

In a first aspect the present invention provides an inkjet printer comprising:

a printer body;

a printhead cartridge for installation in the printer body;

an ink cartridge containing a supply of ink, the ink cartridge having a docking face for engagement with a complementary face to supply the printhead cartridge with ink; wherein, the complementary face is partially provided by the printhead cartridge and partially provided by the printer body.

If the interface for receiving the ink cartridge is at least partially provided by the printhead cartridge, the user will not attempt to install the ink cartridge prior to the printhead cartridge. If part of the interface is missing because the printhead cartridge has not yet been installed, it will be immediately evident that the ink cartridge can not be installed without first inserting the new printhead cartridge. The printhead cartridge could theoretically provide the whole interface for the ink cartridge, but this would require much more structure to receive the ink cartridges. This is not a practical solution in view of the increased sized and cost of the printhead cartridges.

Optionally, the printhead cartridge has a casing to support the printhead and the printer body has a cradle for holding the printhead cartridge in an operative position such that the printhead is adjacent a paper path defined by the printer body; wherein, during insertion, the cradle and the casing interact to form an over centre mechanism whereby, the printhead cartridge rotates against a bias prior until reaching a balance point, after which it is biased to rotate into the operative position.

Optionally, the casing has a plurality of contacts for receiving print data from corresponding contacts on the printer body when the printhead cartridge is in the operative position; and, the casing is a lever for pushing the contacts into engagement with the corresponding contacts on the printer body.

Optionally, the printhead the cradle has a biased locating abutment to apply a compressive force for maintaining the printhead cartridge in the operative position and the casing has a structural member extending from the fulcrum formation; such that during use, the structural member extends from the locating abutment to the complementary formation and is aligned with the direction of the compressive force.

Optionally, the printhead cartridge has a pagewidth inkjet printhead structure with an array of nozzles for ejecting ink supplied by a plurality of ink cartridges, each of the ink cartridges connecting to respective ink inlets, a plurality of resilient connectors form part of the fluid paths to the nozzles from each of the ink inlets, the ink inlets and the resilient connectors being mounted in a docking frame for receiving the ink cartridges; such that, longitudinal expansion and contraction of the pagewidth printhead structure relative to the ink cartridge docking frame is accommodated by the resilient connectors.

Optionally, the docking frame is configured to receive five of the ink cartridges, the ink cartridges containing cyan, magenta, yellow, black and infra red ink respectively.

Optionally, the printhead cartridge has a maintenance station for engaging the pagewidth printhead when not in use; the inkjet printer further comprises a maintenance station drive shaft for detachably engaging the maintenance station upon insertion of the printhead cartridge into the printer, the maintenance station drive shaft having an engagement formation at one end for engaging a complementary formation in the maintenance station; such that, when engaging the complementary formation, the engagement formation has limited axial displacement and limited transverse displacement.

Optionally, the ink inlet valve are each configured for sealed connection to respective outlets on the ink cartridges, each of the inlet valves having an inlet opening and a movable valve member biased into sealing engagement with the inlet opening, the outlet having a complementary member for depressing the movable valve member out of engagement with the inlet opening to open the valve; wherein, the inlet opening has an external formation about its periphery for sealing against the outlet before the complementary member depresses the movable valve member.

Optionally, the printhead assembly is a printhead cartridge for installation in the inkjet printer.

Optionally, the external formation is an outer surface of a ring member, the inlet opening is the hole defined by the ring member and an inner surface opposite the outer surface provides a valve seat for the movable valve member.

Optionally, the moveable valve member has a conical head for sealing against the valve seat supported on a based of compressible resilient material such that the complementary member compresses the base to open the inlet valve.

Optionally, the conical head has its apex does not extend beyond the outer surface of the ring member so that the complementary member is within the inlet opening when it engages the conical head.

Optionally, the complementary member has a stem with a flange portion on its end, the flange portion having a recess corresponding to the apex end of the conical head, the flange portion having a diameter sized for a loose sliding fit within the inlet opening to displace substantially all the air from between the complementary member and the conical head before the inlet valve is opened.

Optionally, the ink cartridge outlet has an annular collar of resilient material that is biased to seal against the side of the flange portion opposite the recess, such that during use the external formation on the inlet valve seals against the annular collar of resilient material before the flange portion depressed the conical head to open the inlet valve.

Optionally, the external formation on the inlet valve seals against the annular collar immediately adjacent to the sides of the flange portion such that minimal air is trapped between the sides of the flange portion and the external formation.

Optionally, the ring member and the external formation are located within a frustoconical tube that tapers toward the outlet of the ink cartridge to guide the ink cartridge into correct position during installation.

In a further aspect there is provided a printhead assembly further comprising a filter adjacent the inlet valve for trapping air bubbles and contaminants.

Optionally, the filter has a surface area larger than the area of the inlet opening such that its pore size is kept small while adversely constricting the ink flow.

In a further aspect there is provided a printhead assembly further comprising a pressure regulator to cut fluid communication between the inlet valve and the nozzles if the pressure difference across the pressure regulator is below a certain threshold.

Optionally, the pressure regulator has a diaphragm biased to seal against a regulator valve seat such that upstream pressure acts on one side of the diaphragm and down stream pressure acts the opposite side.

In a second aspect the present invention provides an inkjet printer comprising:

a printer body and a replaceable printhead cartridge, the printhead cartridge having a casing that supports a pagewidth printhead;

the printer body having a cradle for holding the printhead cartridge in an operative position such that the pagewidth printhead is adjacent a paper path defined by the printer body; wherein, during insertion, the cradle and the casing interact to form an over centre mechanism whereby, the printhead cartridge rotates against a bias prior until reaching a balance point, after which it is biased to rotate into the operative position.

The cradle and the casing of the cartridge are shaped to serve a dual purpose. They provide the basic frame or structure for their respective elements, and fit together to form an over centre mechanism. The bias of the over centre mechanism locks the printhead into place while using the cradle and casing as the components of the mechanism keeps the manufacturing complexity to an acceptable level.

Furthermore, the installation of the cartridge is a single step event for the user.

Optionally, the casing has a plurality of contacts for receiving print data from corresponding contacts on the printer body when the printhead cartridge is in the operative position; and, the casing is a lever for pushing the contacts into engagement with the corresponding contacts on the printer body.

Optionally, the printhead the cradle has a biased locating abutment to apply a compressive force for maintaining the printhead cartridge in the operative position and the casing has a structural member extending from the fulcrum formation; such that during use, the structural member extends from the locating abutment to the complementary formation and is aligned with the direction of the compressive force.

Optionally, the printhead cartridge has a pagewidth inkjet printhead structure with an array of nozzles for ejecting ink supplied by a plurality of ink cartridges, each of the ink cartridges connecting to respective ink inlets, a plurality of resilient connectors form part of the fluid paths to the nozzles from each of the ink inlets, the ink inlets and the resilient connectors being mounted in a docking frame for receiving the ink cartridges; such that, longitudinal expansion and contraction of the pagewidth printhead structure relative to the ink cartridge docking frame is accommodated by the resilient connectors.

Optionally, the docking frame is configured to receive five of the ink cartridges, the ink cartridges containing cyan, magenta, yellow, black and infra red ink respectively.

Optionally, the printhead cartridge has a maintenance station for engaging the pagewidth printhead when not in use; the inkjet printer further comprises a maintenance station drive shaft for detachably engaging the maintenance station upon insertion of the printhead cartridge into the printer, the maintenance station drive shaft having an engagement formation at one end for engaging a complementary formation in the maintenance station; such that, when engaging the complementary formation, the engagement formation has limited axial displacement and limited transverse displacement.

Optionally, the ink inlet valve are each configured for sealed connection to respective outlets on the ink cartridges, each of the inlet valves having an inlet opening and a movable valve member biased into sealing engagement with the inlet opening, the outlet having a complementary member for depressing the movable valve member out of engagement with the inlet opening to open the valve; wherein, the inlet opening has an external formation about its periphery for sealing against the outlet before the complementary member depresses the movable valve member.

Optionally, the printhead assembly is a printhead cartridge for installation in the inkjet printer.

Optionally, the external formation is an outer surface of a ring member, the inlet opening is the hole defined by the ring member and an inner surface opposite the outer surface provides a valve seat for the movable valve member.

Optionally, the moveable valve member has a conical head for sealing against the valve seat supported on a based of compressible resilient material such that the complementary member compresses the base to open the inlet valve.

Optionally, the conical head has its apex does not extend beyond the outer surface of the ring member so that the complementary member is within the inlet opening when it engages the conical head.

Optionally, the complementary member has a stem with a flange portion on its end, the flange portion having a recess corresponding to the apex end of the conical head, the flange portion having a diameter sized for a loose sliding fit within the inlet opening to displace substantially all the air from between the complementary member and the conical head before the inlet valve is opened.

Optionally, the ink cartridge outlet has an annular collar of resilient material that is biased to seal against the side of the flange portion opposite the recess, such that during use the external formation on the inlet valve seals against the annular collar of resilient material before the flange portion depressed the conical head to open the inlet valve.

Optionally, the external formation on the inlet valve seals against the annular collar immediately adjacent to the sides of the flange portion such that minimal air is trapped between the sides of the flange portion and the external formation.

Optionally, the ring member and the external formation are located within a frustoconical tube that tapers toward the outlet of the ink cartridge to guide the ink cartridge into correct position during installation.

In a further aspect there is provided a printhead assembly further comprising a filter adjacent the inlet valve for trapping air bubbles and contaminants.

Optionally, the filter has a surface area larger than the area of the inlet opening such that its pore size is kept small while adversely constricting the ink flow.

In a further aspect there is provided a printhead assembly further comprising a pressure regulator to cut fluid communication between the inlet valve and the nozzles if the pressure difference across the pressure regulator is below a certain threshold.

Optionally, the pressure regulator has a diaphragm biased to seal against a regulator valve seat such that upstream pressure acts on one side of the diaphragm and down stream pressure acts the opposite side.

Optionally, the diaphragm and the filter are circular, adjacent and have similar diameters.

In a third aspect the present invention provides an inkjet printer comprising:

a printer body and a replaceable printhead cartridge, the printhead cartridge having a casing that supports a pagewidth printhead and a plurality of contacts for receiving print data from corresponding contacts on the printer body;

the printer body having a cradle for holding the printhead cartridge in an operative position such that the pagewidth printhead is adjacent a paper path defined by the printer body and the contacts on the printhead cartridge are connected to the corresponding contacts on the printer body, the cradle having a fulcrum formation for engaging a complementary formation on the casing upon insertion of the cartridge; such that, the cartridge rotates into the operative position and the casing is a lever for pushing the contacts into engagement with the corresponding contacts on the printer body.

Structuring the casing so that it is the supporting frame for the printhead, as well as lever, provides a mechanical advantage to assist the engagement of the data contacts with their corresponding contacts. This substantially reduces the user effort required to install the cartridge. As the casing is designed for several functions, the total number of parts is reduced and manufacturing is likewise streamline.

Optionally, during insertion, the cradle and the casing interact to form an over centre mechanism whereby, the printhead cartridge rotates against a bias prior until reaching a balance point, after which it is biased to rotate into the operative position.

Optionally, the printhead the cradle has a biased locating abutment to apply a compressive force for maintaining the printhead cartridge in the operative position and the casing has a structural member extending from the fulcrum formation; such that during use, the structural member extends from the locating abutment to the complementary formation and is aligned with the direction of the compressive force.

Optionally, the printhead cartridge has a pagewidth inkjet printhead structure with an array of nozzles for ejecting ink supplied by a plurality of ink cartridges, each of the ink cartridges connecting to respective ink inlets, a plurality of resilient connectors form part of the fluid paths to the nozzles from each of the ink inlets, the ink inlets and the resilient connectors being mounted in a docking frame for receiving the ink cartridges; such that, longitudinal expansion and contraction of the pagewidth printhead structure relative to the ink cartridge docking frame is accommodated by the resilient connectors.

Optionally, the docking frame is configured to receive five of the ink cartridges, the ink cartridges containing cyan, magenta, yellow, black and infra red ink respectively.

Optionally, the printhead cartridge has a maintenance station for engaging the pagewidth printhead when not in use; the inkjet printer further comprises a maintenance station drive shaft for detachably engaging the maintenance station upon insertion of the printhead cartridge into the printer, the maintenance station drive shaft having an engagement formation at one end for engaging a complementary formation in the maintenance station; such that, when engaging the complementary formation, the engagement formation has limited axial displacement and limited transverse displacement.

Optionally, the ink inlet valve are each configured for sealed connection to respective outlets on the ink cartridges, each of the inlet valves having an inlet opening and a movable valve member biased into sealing engagement with the inlet opening, the outlet having a complementary member for depressing the movable valve member out of engagement with the inlet opening to open the valve; wherein, the inlet opening has an external formation about its periphery for sealing against the outlet before the complementary member depresses the movable valve member.

Optionally, the printhead assembly is a printhead cartridge for installation in the inkjet printer.

Optionally, the external formation is an outer surface of a ring member, the inlet opening is the hole defined by the ring member and an inner surface opposite the outer surface provides a valve seat for the movable valve member.

Optionally, the moveable valve member has a conical head for sealing against the valve seat supported on a based of compressible resilient material such that the complementary member compresses the base to open the inlet valve.

Optionally, the conical head has its apex does not extend beyond the outer surface of the ring member so that the complementary member is within the inlet opening when it engages the conical head.

Optionally, the complementary member has a stem with a flange portion on its end, the flange portion having a recess corresponding to the apex end of the conical head, the flange portion having a diameter sized for a loose sliding fit within the inlet opening to displace substantially all the air from between the complementary member and the conical head before the inlet valve is opened.

Optionally, the ink cartridge outlet has an annular collar of resilient material that is biased to seal against the side of the flange portion opposite the recess, such that during use the external formation on the inlet valve seals against the annular collar of resilient material before the flange portion depressed the conical head to open the inlet valve.

Optionally, the external formation on the inlet valve seals against the annular collar immediately adjacent to the sides of the flange portion such that minimal air is trapped between the sides of the flange portion and the external formation.

Optionally, the ring member and the external formation are located within a frustoconical tube that tapers toward the outlet of the ink cartridge to guide the ink cartridge into correct position during installation.

In a further aspect there is provided a printhead assembly further comprising a filter adjacent the inlet valve for trapping air bubbles and contaminants.

Optionally, the filter has a surface area larger than the area of the inlet opening such that its pore size is kept small while adversely constricting the ink flow.

In a further aspect there is provided a printhead assembly further comprising a pressure regulator to cut fluid communication between the inlet valve and the nozzles if the pressure difference across the pressure regulator is below a certain threshold.

Optionally, the pressure regulator has a diaphragm biased to seal against a regulator valve seat such that upstream pressure acts on one side of the diaphragm and down stream pressure acts the opposite side.

Optionally, the diaphragm and the filter are circular, adjacent and have similar diameters.

In a fourth aspect the present invention provides an ink cartridge for an inkjet printhead, the ink cartridge comprising:

an ink storage volume;

an outlet opening with an outlet valve for connection to an inlet on the printhead, the outlet valve having a stem positioned in the outlet opening, the stem having a radially extending valve seat; and, an annular skirt of resilient material extending from the side of the outlet opening to the valve seat; such that, the inlet on the printhead pushes the annular skirt off the valve seat to open the outlet valve upon installation of the cartridge.

As the printhead inlet opens the cartridge outlet valve by pushing against the resilient annular skirt, a seals automatically forms immediately prior to the valve opening and the amount of entrained air can be minimized, and any resultant bubbles, can be kept to a manageable level while keeping the outlet opening big enough to provide a suitable ink flow rate.

In a further aspect there is provided an ink cartridge according to claim 1 further comprising an air inlet in fluid communication with a variable volume structure within the ink storage volume.

Optionally, the variable volume structure is an air bag such that upon installation in the printer, the air inlet vents the air bag to atmosphere.

Optionally, the air inlet has a frangible seal that is ruptured upon installation in the printer.

Optionally, during use the variable volume structure in the ink storage volume expands to keep a constant head of ink above the outlet valve.

In a further aspect there is provided an ink cartridge further comprising a rigid housing, the housing having a docking face for abutting a complementary face on the printer, wherein the outlet valve and the air inlet are both in the docking face.

Optionally, the outlet valve and the air inlet are recessed into the docking face.

Optionally, the complementary face has a raised formation for rupturing the frangible seal on the air inlet upon installation of the cartridge.

Optionally, the complementary face has ink inlet for the printhead.

Optionally, the outlet valve and the air inlet are opened simultaneously as the cartridge is installed.

Optionally, the docking face is substantially flat.

Optionally, the outlet valve and the air inlet are at spaced locations on the docking face.

Optionally, the printer has a pressure regulating valve that is biased closed, such that in use, it opens in response to a predetermined pressure difference between the ink on the cartridge side and the ink on the printhead side.

Optionally, the pressure regulating valve has a diaphragm biased against a valve seat such that ink pressure on the cartridge side of the valve acts of one side of diaphragm and ink pressure on the printhead side acts on the other side of the diaphragm.

Optionally, the diaphragm has an aperture through with ink flows when the pressure regulating valve is open.

Optionally, the pressure regulating valve has a filter on the cartridge side of the diaphragm to remove air bubbles and contaminants from the ink.

Optionally, the cartridge further comprises a conduit in the ink storage volume, one end of the conduit being connected to the outlet valve and other end being open to ink within the ink storage volume and positioned such that it does not get obstructed by the air bag as it inflates.

Optionally, the ink storage volume is partially defined by a roof wall, the roof wall being substantially flat, parallel to, and directly opposite the docking wall such that the cartridges are vertically stackable on eachother.

Optionally, the docking face defines part of the ink storage volume and the air bag is adjacent the docking face such that in use, the air bag expands upwardly in the storage volume.

Optionally, the air bag has flat top and bottom sheets separated by side walls folded in a concertina fashion when the air bag is deflated.

In a fifth aspect the present invention provides an inkjet printer comprising:

a printer body and a replaceable printhead cartridge, the printhead cartridge having a casing that supports a page-width printhead;

the printer body having a cradle for holding the printhead cartridge in an operative position such that the page-width printhead is adjacent a paper path defined by the printer body, the cradle having a fulcrum formation for engaging a complementary formation on the casing upon insertion of the cartridge so that it rotates into the operative position; wherein, the cradle has a biased locating abutment to apply a compressive force for maintaining the printhead cartridge in the operative position and the casing has a structural member extending from the complementary formation for engaging the fulcrum formation; such that during use, the structural member extends from the locating abutment to the complementary formation and is aligned with the direction of the compressive force.

By providing a bracing structure that runs directly from the biased locating abutment to the fulcrum on the opposite side of the casing, and aligning the structure with the direction of the compressive force, the rigidity of the cartridge at the point where it is clamped is high. Hence there is little deflection in the cartridge but the rest of the cartridge structure need not have the same level of robustness.

Optionally, during insertion, the cradle and the casing interact to form an over centre mechanism whereby, the printhead cartridge rotates against a bias prior until reaching a balance point, after which it is biased to rotate into the operative position.

Optionally, the casing supports a plurality of contacts for receiving print data from corresponding contacts on the printer body such that the contacts on the printhead cartridge are connected to the corresponding contacts on the printer body when the printhead cartridge is in the operative position; such that, as the cartridge is rotated into the operative position, the casing is a lever for pushing the contacts into engagement with the corresponding contacts on the printer body.

Optionally, the printhead cartridge has a pagewidth inkjet printhead structure with an array of nozzles for ejecting ink supplied by a plurality of ink cartridges, each of the ink cartridges connecting to respective ink inlets, a plurality of resilient connectors form part of the fluid paths to the nozzles from each of the ink inlets, the ink inlets and the resilient connectors being mounted in a docking frame for receiving the ink cartridges; such that, longitudinal expansion and contraction of the pagewidth printhead structure relative to the ink cartridge docking frame is accommodated by the resilient connectors.

Optionally, the docking frame is configured to receive five of the ink cartridges, the ink cartridges containing cyan, magenta, yellow, black and infra red ink respectively.

Optionally, the printhead cartridge has a maintenance station for engaging the pagewidth printhead when not in use; the inkjet printer further comprises a maintenance station drive shaft for detachably engaging the maintenance station upon insertion of the printhead cartridge into the printer, the maintenance station drive shaft having an engagement formation at one end for engaging a complementary formation in the maintenance station; such that, when engaging the complementary formation, the engagement formation has limited axial displacement and limited transverse displacement.

Optionally, the ink inlet valve are each configured for sealed connection to respective outlet on the ink cartridges, each of the inlet valves having an inlet opening and a movable valve member biased into sealing engagement with the inlet opening, the outlet having a complementary member for depressing the movable valve member out of engagement with the inlet opening to open the valve; wherein, the inlet opening has an external formation about its periphery for sealing against the outlet before the complementary member depresses the movable valve member.

Optionally, the printhead assembly is a printhead cartridge for installation in the inkjet printer.

Optionally, the external formation is an outer surface of a ring member, the inlet opening is the hole defined by the ring member and an inner surface opposite the outer surface provides a valve seat for the movable valve member.

Optionally, the moveable valve member has a conical head for sealing against the valve seat supported on a based of compressible resilient material such that the complementary member compresses the base to open the inlet valve.

Optionally, the conical head has its apex does not extend beyond the outer surface of the ring member so that the complementary member is within the inlet opening when it engages the conical head.

Optionally, the complementary member has a stem with a flange portion on its end, the flange portion having a recess corresponding to the apex end of the conical head, the flange portion having a diameter sized for a loose sliding fit within the inlet opening to displace substantially all the air from between the complementary member and the conical head before the inlet valve is opened.

Optionally, the ink cartridge outlet has an annular collar of resilient material that is biased to seal against the side of the flange portion opposite the recess, such that during use the external formation on the inlet valve seals against the annular collar of resilient material before the flange portion depressed the conical head to open the inlet valve.

Optionally, the external formation on the inlet valve seals against the annular collar immediately adjacent to the sides of the flange portion such that minimal air is trapped between the sides of the flange portion and the external formation.

Optionally, the ring member and the external formation are located within a frustoconical tube that tapers toward the outlet of the ink cartridge to guide the ink cartridge into correct position during installation.

In a further aspect there is provided a printhead assembly according to claim 13 further comprising a filter adjacent the inlet valve for trapping air bubbles and contaminants.

Optionally, the filter has a surface area larger than the area of the inlet opening such that its pore size is kept small while adversely constricting the ink flow.

In a further aspect there is provided a printhead assembly according to claim 17 further comprising a pressure regulator to cut fluid communication between the inlet valve and the nozzles if the pressure difference across the pressure regulator is below a certain threshold.

Optionally, the pressure regulator has a diaphragm biased to seal against a regulator valve seat such that upstream pressure acts on one side of the diaphragm and down stream pressure acts the opposite side.

Optionally, the diaphragm and the filter are circular, adjacent and have similar diameters.

In a sixth aspect the present invention provides a pagewidth printhead assembly for an inkjet printer, the printhead assembly comprising:

a pagewidth printhead structure having an array of nozzles and a plurality of ink ports in fluid communication with corresponding nozzles in the array;

an ink cartridge docking frame for receiving a plurality ink cartridges, the cartridge docking frame having ink inlet valves for sealed connection to outlets on each of the ink cartridges respectively; and, resilient connectors for sealed fluid communication between the ink inlet valves and the corresponding ink port to accommodate longitudinal expansion and contraction of the pagewidth printhead structure relative to the ink cartridge docking frame.

Using a resilient connector between the cartridge docking frame and the printhead structure accommodates the different CTE's in the assembly to avoid thermally induced bending. The mechanical connection between the various components can have a certain amount of 'play', particularly in the longitudinal direction, so that assembly of the components is relatively simple as well as CTE mismatch tolerant.

Optionally, the resilient connectors have an outer collar and an inner collar joined by an annular web.

Optionally, the inner collar have is radially within the outer collar and the annular web extends diagonally from one end of the inner collar to the further of the two ends of the outer collar.

Optionally, the printhead assembly is a printhead cartridge for installation in the inkjet printer.

Optionally, the inlet valve has an inlet opening and a movable valve member biased into sealing engagement with the inlet opening, the outlet having a complementary member for depressing the movable valve member out of engagement with the inlet opening to open the valve; wherein, the inlet opening has an external formation about its periphery for sealing against the outlet before the complementary member depresses the movable valve member.

Optionally, the external formation is an outer surface of a ring member, the inlet opening is the hole defined by the ring member and an inner surface opposite the outer surface provides a valve seat for the movable valve member.

Optionally, the moveable valve member has a conical head for sealing against the valve seat supported on a based of compressible resilient material such that the complementary member compresses the base to open the inlet valve.

Optionally, the conical head has its apex does not extend beyond the outer surface of the ring member so that the complementary member is within the inlet opening when it engages the conical head.

Optionally, the complementary member has a stem with a flange portion on its end, the flange portion having a recess corresponding to the apex end of the conical head, the flange portion having a diameter sized for a loose sliding fit within the inlet opening to displace substantially all the air from between the complementary member and the conical head before the inlet valve is opened.

Optionally, the ink cartridge outlet has an annular collar of resilient material that is biased to seal against the side of the flange portion opposite the recess, such that during use the external formation on the inlet valve seals against the annular collar of resilient material before the flange portion depressed the conical head to open the inlet valve.

Optionally, the external formation on the inlet valve seals against the annular collar immediately adjacent to the sides of the flange portion such that minimal air is trapped between the sides of the flange portion and the external formation.

Optionally, the ring member and the external formation are located within a frustoconical tube that tapers toward the outlet of the ink cartridge to guide the ink cartridge into correct position during installation.

In a further aspect there is provided a printhead assembly further comprising a filter adjacent the inlet valve for trapping air bubbles and contaminants.

Optionally, the filter has a surface area larger than the area of the inlet opening such that its pore size is kept small while adversely constricting the ink flow.

In a further aspect there is provided a printhead assembly further comprising a pressure regulator to cut fluid communication between the inlet valve and the nozzles if the pressure difference across the pressure regulator is below a certain threshold.

Optionally, the pressure regulator has a diaphragm biased to seal against a regulator valve seat such that upstream pressure acts on one side of the diaphragm and down stream pressure acts the opposite side.

Optionally, the diaphragm and the filter are circular, adjacent and have similar diameters.

Optionally, the printhead cartridge has a casing that supports the pagewidth printhead and the inkjet printer has a cradle for holding the printhead cartridge in an operative position such that the pagewidth printhead is adjacent a paper path through by the inkjet printer; wherein, during insertion, the cradle and the casing interact to form an over centre mechanism whereby, the printhead cartridge rotates against a bias prior until reaching a balance point, after which it is biased to rotate into the operative position.

Optionally, the printhead cartridge has a casing that supports a pagewidth printhead, and the printer body has a cradle for holding the printhead cartridge in an operative position such that the pagewidth printhead is adjacent a paper path defined by the printer body, the cradle having a fulcrum formation for engaging a complementary formation on the casing upon insertion of the cartridge so that it rotates into the operative position; wherein, the cradle has a biased locating abutment to apply a compressive force for maintaining the printhead cartridge in the operative position and the casing has a structural member extending from the complementary formation for engaging the fulcrum formation; such that during use, the structural member extends from the locating abutment to the complementary formation and is aligned with the direction of the compressive force.

Optionally, the plurality of ink cartridges comprises cyan, magenta, yellow, black and infra red ink cartridges.

Optionally, the printhead cartridge has a pagewidth printhead and a maintenance station for engaging the printhead when not in use; the inkjet printer further comprises a maintenance station drive shaft for detachably engaging the maintenance station upon insertion of the printhead cartridge into the printer, the maintenance station drive shaft having an engagement formation at one end for engaging a complementary formation in the maintenance station; such that, when engaging the complementary formation, the engagement formation has limited axial displacement and limited transverse displacement.

In a seventh aspect the present invention provides an inkjet printer comprising:

a printhead cartridge with a printhead and a maintenance station for engaging the printhead when not in use;

a printer body with a cradle for receiving the cartridge, and a maintenance station drive shaft for detachably engaging the maintenance station upon insertion of the printhead cartridge into the cradle, the maintenance station drive shaft having an engagement formation at one end for engaging a complementary formation in the maintenance station; such that, when engaging the complementary formation, the engagement formation has limited axial displacement and limited transverse displacement.

By constructing and mounting the input drive shaft for the maintenance station so that it has a certain amount of axial and transverse 'play', the coupling will tolerate a degree of misalignment as the user puts the cartridge into the cradle. This provides a mechanical power input to the printhead cartridge without complicating the printhead cartridge replacement procedure for the user.

Optionally, the engagement formation is mounted at one end of the drive shaft and the maintenance station moves axially relative to the drive shaft to engage the engagement formation.

Optionally, the engagement formation has a plurality of drive vanes and the maintenance station has a socket for engagement with the drive vanes.

Optionally, the drive vanes have a curved outer profile for guiding the engagement formation into the socket in the maintenance station.

Optionally, the drive shaft is mounted to the printer body at the end opposite the engagement formation, the mounting allowing limited pivotal play in the drive shaft and limited axial play such that the drive shaft can move between an axially extended position and an axially retracted position.

Optionally, the mounting biases the drive shaft towards the axially extended position.

In a further aspect there is provide an inkjet printer further comprising a powered shaft for powering the drive shaft, the powered shaft having a helical screw drive and the drive shaft having a spur gear adjacent the mounted end for engagement with the helical screw drive, the pitch in the helical screw drive being such that the spur gear has limited rotational play.

Optionally, the printhead cartridge has a casing that supports the printhead and a plurality of contacts for receiving print data from corresponding contacts on the printer body; and, the cradle having a fulcrum formation for engaging a complementary formation on the casing upon insertion of the cartridge; such that, the cartridge rotates into the operative position and the casing is a lever for pushing the contacts into engagement with the corresponding contacts on the printer body.

Optionally, during insertion, the cradle and the casing interact to form an over centre mechanism whereby, the printhead cartridge rotates against a bias prior until reaching a balance point, after which it is biased to rotate into the operative position.

Optionally, the printhead the cradle has a biased locating abutment to apply a compressive force for maintaining the printhead cartridge in the operative position and the casing has a structural member extending from the fulcrum formation; such that during use, the structural member extends from the locating abutment to the complementary formation and is aligned with the direction of the compressive force.

Optionally, the printhead cartridge has a pagewidth inkjet printhead structure with an array of nozzles for ejecting ink supplied by a plurality of ink cartridges, each of the ink cartridges connecting to respective ink inlets, a plurality of resilient connectors form part of the fluid paths to the nozzles from each of the ink inlets, the ink inlets and the resilient connectors being mounted in a docking frame for receiving the ink cartridges; such that, longitudinal expansion and contraction of the pagewidth printhead structure relative to the ink cartridge docking frame is accommodated by the resilient connectors.

Optionally, the docking frame is configured to receive five of the ink cartridges, the ink cartridges containing cyan, magenta, yellow, black and infra red ink respectively.

Optionally, the ink inlet valves are each configured for sealed connection to respective outlets on the ink cartridges, each of the inlet valves having an inlet opening and a movable valve member biased into sealing engagement with the inlet opening, the outlet having a complementary member for depressing the movable valve member out of engagement with the inlet opening to open the valve; wherein, the inlet opening has an external formation about its periphery for sealing against the outlet before the complementary member depresses the movable valve member.

Optionally, the external formation is an outer surface of a ring member, the inlet opening is the hole defined by the ring member and an inner surface opposite the outer surface provides a valve seat for the movable valve member.

Optionally, the moveable valve member has a conical head for sealing against the valve seat supported on a based of compressible resilient material such that the complementary member compresses the base to open the inlet valve.

Optionally, the conical head has its apex does not extend beyond the outer surface of the ring member so that the complementary member is within the inlet opening when it engages the conical head.

Optionally, the complementary member has a stem with a flange portion on its end, the flange portion having a recess corresponding to the apex end of the conical head, the flange portion having a diameter sized for a loose sliding fit within the inlet opening to displace substantially all the air from between the complementary member and the conical head before the inlet valve is opened.

Optionally, the ink cartridge outlet has an annular collar of resilient material that is biased to seal against the side of the flange portion opposite the recess, such that during use the external formation on the inlet valve seals against the annular collar of resilient material before the flange portion depressed the conical head to open the inlet valve.

In a further aspect there is provide an inkjet printer further comprising a filter adjacent the inlet valve for trapping air bubbles and contaminants.

In a further aspect there is provide an inkjet printer further comprising a pressure regulator to cut fluid communication between the inlet valve and the nozzles if the pressure difference across the pressure regulator is below a certain threshold.

In an eighth aspect the present invention provides an ink reservoir for an inkjet printhead, the ink reservoir comprising:

a sealed ink storage volume;

an ink outlet for establishing sealed fluid communication between the printhead and the ink storage volume; and, an air bag in the ink storage volume with an air inlet for allowing external air into the air bag; wherein during use, the air bag inflates as the ink is drawn from the ink storage volume.

Instead of storing ink in a flexible bag that collapses as the ink is used, the present invention has an air bag that inflates to replace the ink volume used by the printhead. The ink remains sealed from the air, but the inflated bag fills out to occupy almost all the voided area of the storage volume, there is little residual ink left when the cartridge is empty. Also, an air bag has far less resistance to inflating in ink than a ink bag has of collapsing.

Optionally, the ink reservoir is a replaceable ink cartridge for installation in the printer and the ink outlet has an outlet valve that is biased closed and opens upon installation in the printer.

Optionally, the air bag is formed of a polymer material with low air permeability.

Optionally, the air inlet has a frangible seal that is ruptured upon installation in the printer.

Optionally, the air inlet is spaced from the outlet valve, and, the outlet valve and the air inlet are configured for engagement with complementary formations on the printer such that the ink outlet and the air inlet are both opened upon installation of the cartridge in the printer.

Optionally, the cartridge further comprises a rigid housing, the housing having a docking face for abutting a complementary face on the printer, wherein the outlet valve and the air inlet are both in the docking face.

Optionally, the outlet valve and the air inlet are spaced from each other.

Optionally, the complementary face has a raised formation for rupturing the frangible seal on the air inlet upon installation of the cartridge.

Optionally, the complementary face has a valve actuator for opening the outlet valve.

Optionally, the outlet valve and the air inlet are opened simultaneously as the cartridge is installed.

Optionally, the docking face is substantially flat.

Optionally, the valve actuator has a peripheral seal that engages the outlet valve to form a seal prior to the outlet valve opening.

Optionally, the printer has a pressure regulating valve that is biased closed, such that in use, it opens in response to a predetermined pressure difference between the ink on the cartridge side and the ink on the printhead side.

Optionally, the pressure regulating valve has a diaphragm biased against a valve seat such that ink pressure on the cartridge side of the valve acts of one side of diaphragm and ink pressure on the printhead side acts on the other side of the diaphragm.

Optionally, the diaphragm has an aperture through with ink flows when the pressure regulating valve is open.

Optionally, the pressure regulating valve has a filter on the cartridge side of the diaphragm to remove air bubbles and contaminants from the ink.

Optionally, the cartridge further comprises a conduit in the ink storage volume, one end of the conduit being connected to the outlet valve and other end being open to ink within the ink storage volume and positioned such that it does not get obstructed by the air bag as it inflates.

Optionally, the ink storage volume is partially defined by a roof wall, the roof wall being substantially flat, parallel to, and directly opposite the docking wall such that the cartridges are vertically stackable on eachother.

Optionally, the docking face defines part of the ink storage volume and the air bag is adjacent the docking face such that in use, the air bag expands upwardly in the storage volume.

Optionally, the air bag has flat top and bottom sheets separated by side walls folded in a concertina fashion when the air bag is deflated.

In a ninth aspect the present invention provides a printer with an inkjet printhead, the printer comprising:

an ink reservoir; and, a pressure regulating valve for establishing fluid communication between the printhead and the ink reservoir; wherein, the pressure regulating valve is biased closed and opens in response to a predetermined ink pressure difference across the valve.

Using a pressure regulating valve avoids the inefficiency associated with foam inserts or spring biased ink bags. The pressure regulating valve could be at the ink outlet of the cartridge, but as it is more cost effective to keep the outlet valve on the replaceable cartridges as simple as possible, and build the pressure regulating valve into the printer itself.

The ejection actuators in the printhead can act as a pump to drop the pressure on the printhead side of the valve until threshold pressure difference is reached. Ink from the storage volume flows through the valve to stop the negative pressure dropping further as the printhead draws more ink.

Optionally, the ink reservoir is a replaceable ink cartridge for installation in the printer, the cartridge having an ink storage volume and an ink outlet, the ink outlet having an outlet valve that is biased closed and opens upon installation in the printer.

Optionally, the pressure regulating valve has a diaphragm biased against a valve seat such that ink pressure on the cartridge side of the valve acts of one side of diaphragm and ink pressure on the printhead side acts on the other side of the diaphragm.

Optionally, the diaphragm has an aperture through with ink flows when the pressure regulating valve is open.

Optionally, the pressure regulating valve has a filter on the cartridge side of the diaphragm to remove air bubbles and contaminants from the ink.

Optionally, the cartridge further comprises a variable volume structure in the ink storage volume for expanding as ink is drawn through the ink outlet to keep a constant head of ink above the outlet valve.

Optionally, the variable volume structure is an air bag with an air inlet vented to atmosphere.

Optionally, the air inlet has a frangible seal that is ruptured upon installation in the printer.

Optionally, the air inlet is spaced from the outlet valve, and, the outlet valve and the air inlet are configured for engagement with complementary formations on the printer such that the ink outlet and the air inlet are both opened upon installation of the cartridge in the printer.

Optionally, the cartridge further comprises a rigid housing, the housing having a docking face for abutting a complementary face on the printer, wherein the outlet valve and the air inlet are both in the docking face.

Optionally, the outlet valve and the air inlet are spaced from each other.

Optionally, the complementary face has a raised formation for rupturing the frangible seal on the air inlet upon installation of the cartridge.

Optionally, the complementary face has a valve actuator for opening the outlet valve.

Optionally, the outlet valve and the air inlet are opened simultaneously as the cartridge is installed.

Optionally, the docking face is substantially flat.

Optionally, the valve actuator has a peripheral seal that engages the outlet valve to form a seal prior to the outlet valve opening.

Optionally, the cartridge further comprises a conduit in the ink storage volume, one end of the conduit being connected to the outlet valve and other end being open to ink within the ink storage volume and positioned such that it does not get obstructed by the air bag as it inflates.

Optionally, the ink storage volume is partially defined by a roof wall, the roof wall being substantially flat, parallel to, and directly opposite the docking wall such that the cartridges are vertically stackable on eachother.

Optionally, the docking face defines part of the ink storage volume and the air bag is adjacent the docking face such that in use, the air bag expands upwardly in the storage volume.

Optionally, the air bag has flat top and bottom sheets separated by side walls folded in a concertina fashion when the air bag is deflated.

In a tenth aspect the present invention provides an ink cartridge for a printer with an inkjet printhead, the ink cartridge comprising:

an ink storage volume;

an outlet valve for fluid communication with the printhead; and, an air inlet spaced from the outlet valve for letting air into the ink storage volume as ink is drawn out through the outlet valve; wherein, the outlet valve and the air inlet are configured for engagement with complementary formations on the printer such that the ink outlet and the air inlet are both opened upon installation of the cartridge in the printer.

Separating the air inlet from the outlet valve minimizes the ink leakage, if any, should someone tamper with the outlet valve prior to installation. Without air flow into the cartridge, the ink is much less able to flow though the outlet.

Optionally, the air inlet is in fluid communication with a variable volume structure within the ink storage volume.

Optionally, the variable volume structure is an air bag such that upon installation in the printer, the air inlet vents the air bag to atmosphere.

Optionally, the air inlet has a frangible seal that is ruptured upon installation in the printer.

Optionally, during use the variable volume structure in the ink storage volume expands to keep a constant head of ink above the outlet valve.

In a further aspect there is provided an ink cartridge further comprising a rigid housing, the housing having a docking face for abutting a complementary face on the printer, wherein the outlet valve and the air inlet are both in the docking face.

Optionally, the outlet valve and the air inlet are recessed into the docking face.

Optionally, the complementary face has a raised formation for rupturing the frangible seal on the air inlet upon installation of the cartridge.

Optionally, the complementary face has a valve actuator for opening the outlet valve.

Optionally, the outlet valve and the air inlet are opened simultaneously as the cartridge is installed.

Optionally, the docking face is substantially flat.

Optionally, the valve actuator has a peripheral seal that engages the outlet valve to form a seal prior to the outlet valve opening.

Optionally, the printer has a pressure regulating valve that is biased closed, such that in use, it opens in response to a predetermined pressure difference between the ink on the cartridge side and the ink on the printhead side.

Optionally, the pressure regulating valve has a diaphragm biased against a valve seat such that ink pressure on the cartridge side of the valve acts of one side of diaphragm and ink pressure on the printhead side acts on the other side of the diaphragm.

Optionally, the diaphragm has an aperture through with ink flows when the pressure regulating valve is open.

Optionally, the pressure regulating valve has a filter on the cartridge side of the diaphragm to remove air bubbles and contaminants from the ink.

Optionally, the cartridge further comprises a conduit in the ink storage volume, one end of the conduit being connected to the outlet valve and other end being open to ink within the ink storage volume and positioned such that it does not get obstructed by the air bag as it inflates.

Optionally, the ink storage volume is partially defined by a roof wall, the roof wall being substantially flat, parallel to, and directly opposite the docking wall such that the cartridges are vertically stackable on eachother.

Optionally, the docking face defines part of the ink storage volume and the air bag is adjacent the docking face such that in use, the air bag expands upwardly in the storage volume.

Optionally, the air bag has flat top and bottom sheets separated by side walls folded in a concertina fashion when the air bag is deflated.

In an eleventh aspect the present invention provides an ink reservoir for a printer with an inkjet printhead, the ink reservoir comprising:

a sealed ink storage volume;

an ink outlet for sealed fluid communication between the printhead and the ink storage volume; and, a variable volume structure in the ink storage volume for expanding as ink is drawn through the ink outlet to keep a constant head of ink above the outlet valve.

A variable volume structure that expands as the printhead uses ink, ensures that the ink level in the reservoir remains constant. Hence the hydrostatic pressure at the outlet is likewise constant.

Preferably, the ink reservoir is a replaceable ink cartridge for installation in the printer and the ink outlet has an outlet valve that is biased closed and opens upon installation in the printer. In a further preferred form, the variable volume structure is an air bag with an air inlet vented to atmosphere.

Optionally, the air inlet has a frangible seal that is ruptured upon installation. In some embodiments, the air inlet is spaced from the outlet valve, and, the outlet valve and the air inlet are configured for engagement with complementary formations on the printer such that the ink outlet and the air inlet are both opened upon installation of the cartridge in the printer.

Preferably, the cartridge further comprises a rigid housing, the housing having a docking face for abutting a complementary face on the printer, wherein the outlet valve and the air inlet are both in the docking face. In a further preferred form, the outlet valve and the air inlet are spaced from each other.

Optionally, the complementary face has a raised formation for rupturing the frangible seal on the air inlet upon installation of the cartridge.

In some embodiments, the complementary face has a valve actuator for opening the outlet valve.

Preferably, the printer has a pressure regulating valve that is biased closed, such that in use, it opens in response to a predetermined pressure difference between the ink on the cartridge side and the ink on the printhead side. In a particularly preferred form, the docking face defines part of the ink storage volume and the air bag is adjacent the docking face such that in use, the air bag expands upwardly in the storage volume to keep a constant head of ink above the outlet valve. Preferably, the air bag has flat top and bottom sheets separated by side walls folded in a concertina fashion when the air bag is deflated.

Optionally, the ink reservoir is a replaceable ink cartridge for installation in the printer and the ink outlet has an outlet valve that is biased closed and opens upon installation in the printer.

Optionally, the variable volume structure is an air bag with an air inlet vented to atmosphere.

Optionally, the air inlet has a frangible seal that is ruptured upon installation in the printer.

Optionally, the air inlet is spaced from the outlet valve, and, the outlet valve and the air inlet are configured for engagement with complementary formations on the printer such that the ink outlet and the air inlet are both opened upon installation of the cartridge in the printer.

Optionally, the cartridge further comprises a rigid housing, the housing having a docking face for abutting a complementary face on the printer, wherein the outlet valve and the air inlet are both in the docking face.

Optionally, the outlet valve and the air inlet are spaced from each other.

Optionally, the complementary face has a raised formation for rupturing the frangible seal on the air inlet upon installation of the cartridge.

Optionally, the complementary face has a valve actuator for opening the outlet valve.

Optionally, the outlet valve and the air inlet are opened simultaneously as the cartridge is installed.

Optionally, the docking face is substantially flat.

Optionally, the valve actuator has a peripheral seal that engages the outlet valve to form a seal prior to the outlet valve opening.

Optionally, the printer has a pressure regulating valve that is biased closed, such that in use, it opens in response to a predetermined pressure difference between the ink on the cartridge side and the ink on the printhead side.

Optionally, the pressure regulating valve has a diaphragm biased against a valve seat such that ink pressure on the cartridge side of the valve acts of one side of diaphragm and ink pressure on the printhead side acts on the other side of the diaphragm.

Optionally, the diaphragm has an aperture through with ink flows when the pressure regulating valve is open.

Optionally, the pressure regulating valve has a filter on the cartridge side of the diaphragm to remove air bubbles and contaminants from the ink.

Optionally, the cartridge further comprises a conduit in the ink storage volume, one end of the conduit being connected to the outlet valve and other end being open to ink within the ink storage volume and positioned such that it does not get obstructed by the air bag as it inflates.

Optionally, the ink storage volume is partially defined by a roof wall, the roof wall being substantially flat, parallel to, and directly opposite the docking wall such that the cartridges are vertically stackable on eachother.

Optionally, the docking face defines part of the ink storage volume and the air bag is adjacent the docking face such that in use, the air bag expands upwardly in the storage volume.

Optionally, the air bag has flat top and bottom sheets separated by side walls folded in a concertina fashion when the air bag is deflated.

In a twelfth aspect the present invention provides a printhead assembly for an inkjet printer configured for use with at least one replaceable ink cartridge, the printhead comprising:

an ink inlet valve for sealed connection to an outlet on the ink cartridge, the inlet valve having an inlet opening and a movable valve member biased into sealing engagement with the inlet opening, the outlet having a complementary member for depressing the movable valve member out of engagement with the inlet opening to open the valve; wherein, the inlet opening has an external formation about its periphery for sealing against the outlet before the complementary member depresses the movable valve member.

The opening can be dimensioned to provide a suitable ink flow rate, and by forming a seal before the inlet valve opens, the amount of entrained air can be minimized. This keeps any resultant bubbles to a manageable level that can be dealt with by bubble traps along the fluid flow path to the nozzles.

Optionally, the printhead assembly is a printhead cartridge for installation in the inkjet printer.

Optionally, the external formation is an outer surface of a ring member, the inlet opening is the hole defined by the ring member and an inner surface opposite the outer surface provides a valve seat for the movable valve member.

Optionally, the moveable valve member has a conical head for sealing against the valve seat supported on a based of compressible resilient material such that the complementary member compresses the base to open the inlet valve.

Optionally, the conical head has its apex does not extend beyond the outer surface of the ring member so that the complementary member is within the inlet opening when it engages the conical head.

Optionally, the complementary member has a stem with a flange portion on its end, the flange portion having a recess corresponding to the apex end of the conical head, the flange portion having a diameter sized for a loose sliding fit within the inlet opening to displace substantially all the air from between the complementary member and the conical head before the inlet valve is opened.

Optionally, the ink cartridge outlet has an annular collar of resilient material that is biased to seal against the side of the flange portion opposite the recess, such that during use the external formation on the inlet valve seals against the annular collar of resilient material before the flange portion depressed the conical head to open the inlet valve.

Optionally, the external formation on the inlet valve seals against the annular collar immediately adjacent to the sides of the flange portion such that minimal air is trapped between the sides of the flange portion and the external formation.

Optionally, the ring member and the external formation are located within a frustoconical tube that tapers toward the outlet of the ink cartridge to guide the ink cartridge into correct position during installation.

In a further aspect there is provided a printhead further comprising a filter adjacent the inlet valve for trapping air bubbles and contaminants.

Optionally, the filter has a surface area larger than the area of the inlet opening such that its pore size is kept small while adversely constricting the ink flow.

In a further aspect there is provided a printhead assembly further comprising a pressure regulator to cut fluid communication between the inlet valve and the nozzles if the pressure difference across the pressure regulator is below a certain threshold.

Optionally, the pressure regulator has a diaphragm biased to seal against a regulator valve seat such that upstream pressure acts on one side of the diaphragm and down stream pressure acts the opposite side.

Optionally, the diaphragm and the filter are circular, adjacent and have similar diameters.

Optionally, the printhead cartridge has a casing that supports a pagewidth printhead and the printer body has a cradle for holding the printhead cartridge in an operative position such that the pagewidth printhead is adjacent a paper path defined by the printer body; wherein, during insertion, the cradle and the casing interact to form an over centre mechanism whereby, the printhead cartridge rotates against a bias prior until reaching a balance point, after which it is biased to rotate into the operative position.

Optionally, the printhead cartridge has a casing that supports a pagewidth printhead and a plurality of contacts for receiving print data from corresponding contacts on the printer body; the printer body having a cradle for holding the printhead cartridge in an operative position such that the pagewidth printhead is adjacent a paper path defined by the printer body and the contacts on the printhead cartridge are connected to the corresponding contacts on the printer body, the cradle having a fulcrum formation for engaging a complementary formation on the casing upon insertion of the cartridge; such that, the cartridge rotates into the operative position and the casing is a lever for pushing the contacts into engagement with the corresponding contacts on the printer body.

Optionally, the printhead cartridge has a casing that supports a pagewidth printhead, and the printer body has a cradle for holding the printhead cartridge in an operative position such that the pagewidth printhead is adjacent a paper path defined by the printer body, the cradle having a fulcrum formation for engaging a complementary formation on the casing upon insertion of the cartridge so that it rotates into the operative position; wherein, the cradle has a biased locating abutment to apply a compressive force for maintaining the printhead cartridge in the operative position and the casing has a structural member extending from the complementary formation for engaging the fulcrum formation; such that during use, the structural member extends from the locating abutment to the complementary formation and is aligned with the direction of the compressive force.

Optionally, the printhead cartridge has a pagewidth inkjet printhead structure with an array of nozzles for ejecting ink supplied by a plurality of the ink cartridges, each of the ink cartridges having one of the ink inlets respectively, and a plurality of resilient connectors for each of the ink inlets respectively, the resilient connectors forming part of the fluid path to the nozzles corresponding to each ink cartridge, the ink inlets and the resilient connectors being mounted in a docking frame for receiving the ink cartridges; such that, longitudinal expansion and contraction of the pagewidth printhead structure relative to the ink cartridge docking frame is accommodated by the resilient connectors.

Optionally, the docking frame is configured to receive five of the ink cartridges, the ink cartridges containing cyan, magenta, yellow, black and infra red ink respectively.

Optionally, the printhead cartridge has a pagewidth printhead and a maintenance station for engaging the printhead when not in use; the inkjet printer further comprises a maintenance station drive shaft for detachably engaging the maintenance station upon insertion of the printhead cartridge into the printer, the maintenance station drive shaft having an engagement formation at one end for engaging a complementary formation in the maintenance station; such that, when engaging the complementary formation, the engagement formation has limited axial displacement and limited transverse displacement.

In a thirteenth aspect the present invention provides an inkjet printer comprising:

a printer body;

a printhead cartridge for installation in the printer body;

an ink cartridge for supplying the printhead cartridge with ink; wherein, the ink cartridge has formations to interenegage with both the printer body and the printhead cartridge.

Using the ink cartridges to effectively lock the printhead cartridge into its operative position allows the installation of the printhead cartridge into the cradle of the printer to be a simple procedure. Installation of the ink cartridges is an essential step so giving them the dual purpose of ink supply and securely locating the printhead relative to the paper path, simplifies the installation of the printhead cartridge. It also allows the design of the printer cradle to be simplified for lower production costs.

Optionally, the formations on the ink cartridge are an ink outlet valve and an air inlet, the ink outlet engaging an inlet valve on the printhead cartridge, and the air inlet engaging a complementary spigot on the printer body.

Optionally, the printhead cartridge has a casing that supports a printhead, and the printer body has a cradle for holding the printhead cartridge in an operative position such that the printhead is adjacent a paper path defined by the printer body; wherein, during insertion, the cradle and the casing interact to form an over centre mechanism whereby, the printhead cartridge rotates against a bias prior until reaching a balance point, after which it is biased to rotate into the operative position.

Optionally, the casing has a plurality of contacts for receiving print data from corresponding contacts on the printer body when the printhead cartridge is in the operative position; and, the casing is a lever for pushing the contacts into engagement with the corresponding contacts on the printer body.

Optionally, the printhead the cradle has a biased locating abutment to apply a compressive force for maintaining the printhead cartridge in the operative position and the casing has a structural member extending from the fulcrum formation; such that during use, the structural member extends from the locating abutment to the complementary formation and is aligned with the direction of the compressive force.

Optionally, the printhead cartridge has a pagewidth inkjet printhead structure with an array of nozzles for ejecting ink supplied by a plurality of the ink cartridges, each of the ink cartridges connecting to respective ink inlets, a plurality of resilient connectors form part of the fluid paths to the nozzles from each of the ink inlets, the ink inlets and the resilient connectors being mounted in a docking frame for receiving the ink cartridges; such that, longitudinal expansion and contraction of the pagewidth printhead structure relative to the ink cartridge docking frame is accommodated by the resilient connectors.

Optionally, the docking frame is configured to receive five of the ink cartridges, the ink cartridges containing cyan, magenta, yellow, black and infra red ink respectively.

Optionally, the printhead cartridge has a maintenance station for engaging the pagewidth printhead when not in use; the inkjet printer further comprises a maintenance station drive shaft for detachably engaging the maintenance station upon insertion of the printhead cartridge into the printer, the maintenance station drive shaft having an engagement formation at one end for engaging a complementary formation in the maintenance station; such that, when engaging the complementary formation, the engagement formation has limited axial displacement and limited transverse displacement.

Optionally, the ink inlet valves are each configured for sealed connection to respective outlet valves on the ink cartridges, each of the inlet valves having an inlet opening and a movable valve member biased into sealing engagement with the inlet opening, the outlet having a complementary member for depressing the movable valve member out of engagement with the inlet opening to open the valve; wherein, the inlet opening has an external formation about its periphery for sealing against the outlet valve before the complementary member depresses the movable valve member.

Optionally, the external formation is an outer surface of a ring member, the inlet opening is the hole defined by the ring member and an inner surface opposite the outer surface provides a valve seat for the movable valve member.

Optionally, the moveable valve member has a conical head for sealing against the valve seat supported on a based of compressible resilient material such that the complementary member compresses the base to open the inlet valve.

Optionally, the conical head has its apex does not extend beyond the outer surface of the ring member so that the complementary member is within the inlet opening when it engages the conical head.

Optionally, the complementary member has a stem with a flange portion on its end, the flange portion having a recess corresponding to the apex end of the conical head, the flange portion having a diameter sized for a loose sliding fit within the inlet opening to displace substantially all the air from between the complementary member and the conical head before the inlet valve is opened.

Optionally, the ink cartridge outlet has an annular collar of resilient material that is biased to seal against the side of the flange portion opposite the recess, such that during use the external formation on the inlet valve seals against the annular collar of resilient material before the flange portion depressed the conical head to open the inlet valve.

Optionally, the external formation on the inlet valve seals against the annular collar immediately adjacent to the sides of the flange portion such that minimal air is trapped between the sides of the flange portion and the external formation.

Optionally, the ring member and the external formation are located within a frustoconical tube that tapers toward the outlet of the ink cartridge to guide the ink cartridge into correct position during installation.

In a further aspect there is provided a printhead assembly further comprising a filter adjacent the inlet valve for trapping air bubbles and contaminants.

Optionally, the filter has a surface area larger than the area of the inlet opening such that its pore size is kept small while adversely constricting the ink flow.

In a further aspect there is provided a printhead assembly further comprising a pressure regulator to cut fluid communication between the inlet valve and the nozzles if the pressure difference across the pressure regulator is below a certain threshold.

Optionally, the pressure regulator has a diaphragm biased to seal against a regulator valve seat such that upstream pressure acts on one side of the diaphragm and down stream pressure acts the opposite side.

BRIEF DESCRIPTION OF THE DRAWINGS

Preferred embodiments of the invention will now be described by way of example only with reference to the accompanying drawings, in which.

DETAILED DESCRIPTION OF PREFERRED EMBODIMENTS

Printer Casing

Figure 1:
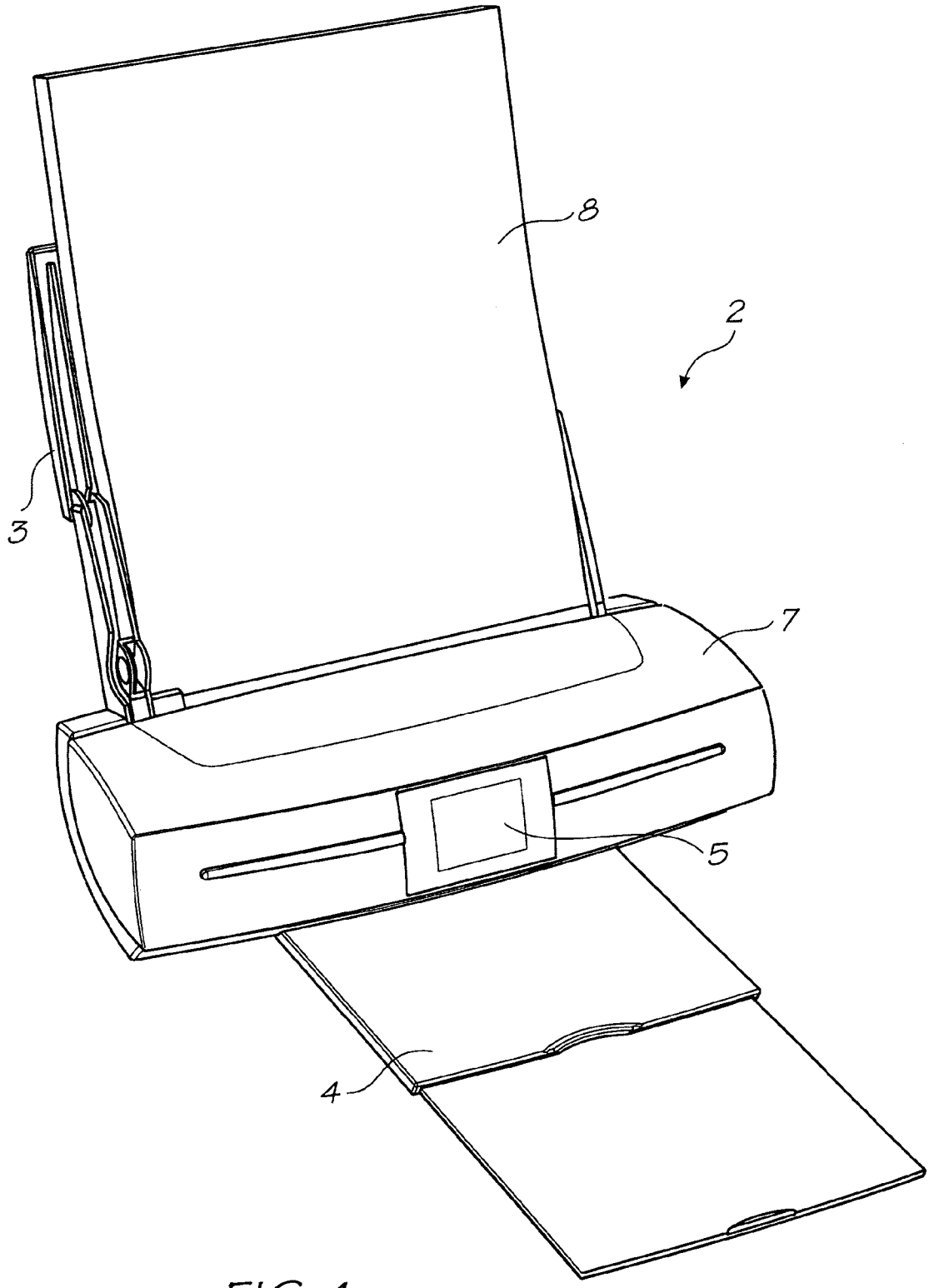
FIG. 1 shows a front perspective view of a printer with paper in the input tray and the collection tray extended.

FIG. 1 shows a printer 2 embodying the present invention. Media supply tray 3 supports and supplies media 8 to be printed by the print engine (concealed within the printer casing). Printed sheets of media 8 are fed from the print engine to a media output tray 4 for collection. User interface 5 is an LCD touch screen and enables a user to control the operation of the printer 2.

Figure 2:
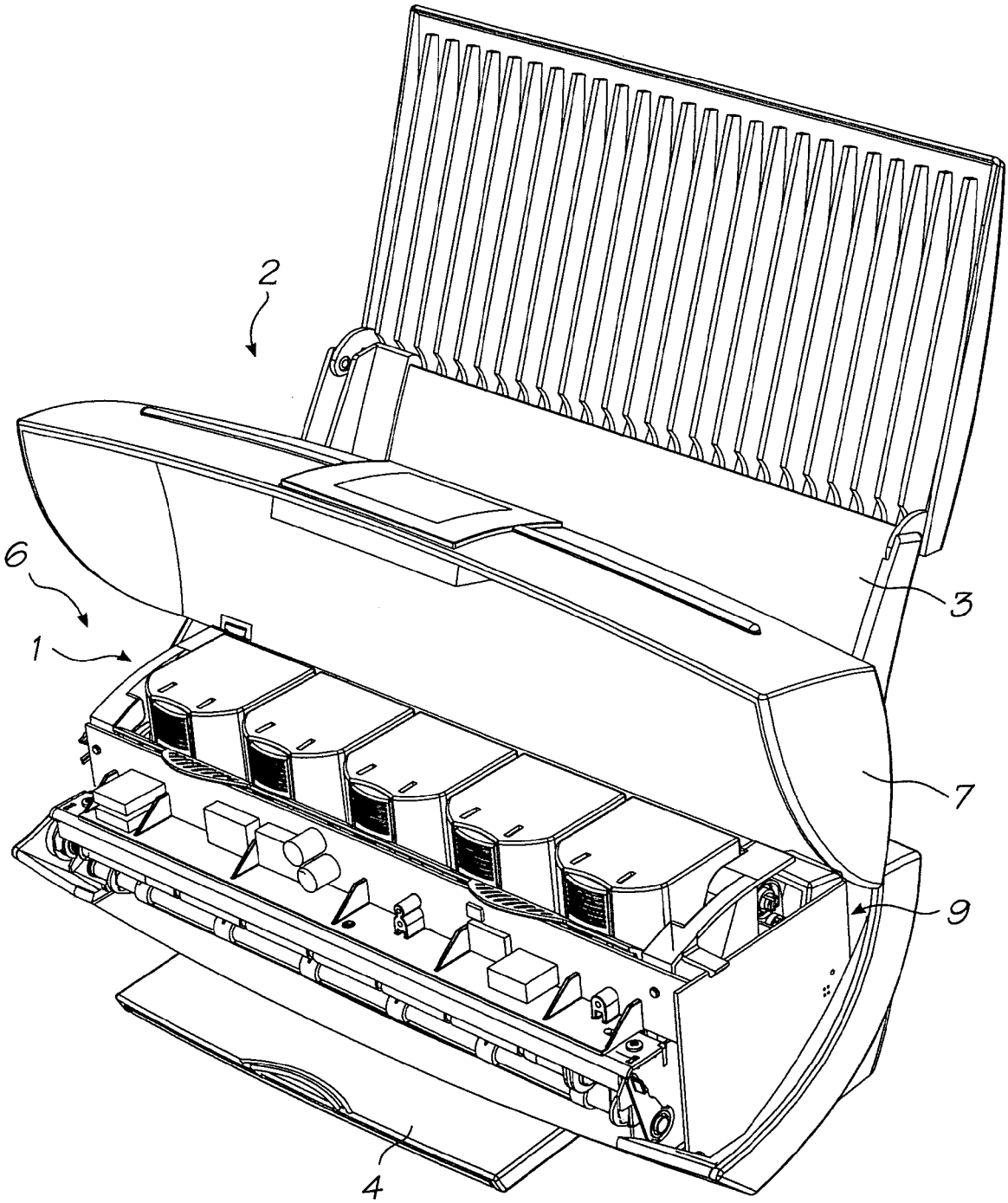
FIG. 2 shows the printer unit of FIG. 1 (without paper in the input tray and with the collection tray retracted) with the casing open to expose the interior.

FIG. 2 shows the lid 7 of the printer 2 open to expose the print engine 1 positioned in the internal cavity 6.

Picker mechanism 9 engages the media in the input tray 3 (not shown for clarity) and feeds individual streets to the print engine 1. The print engine 1 includes media transport means that takes the individual sheets and feeds them past a printhead (described below) for printing and subsequent delivery to the media output tray 4 (shown retracted). The printer 2 shown has an L-shaped paper path which is convenient for desktop printers. However, described below is a printer cradle, printhead cartridge and ink cartridge assembly that can be deployed in a range of different configurations with various media feed paths such as C-path or straight-line path.

Print Engine Pipeline

Figure 3:
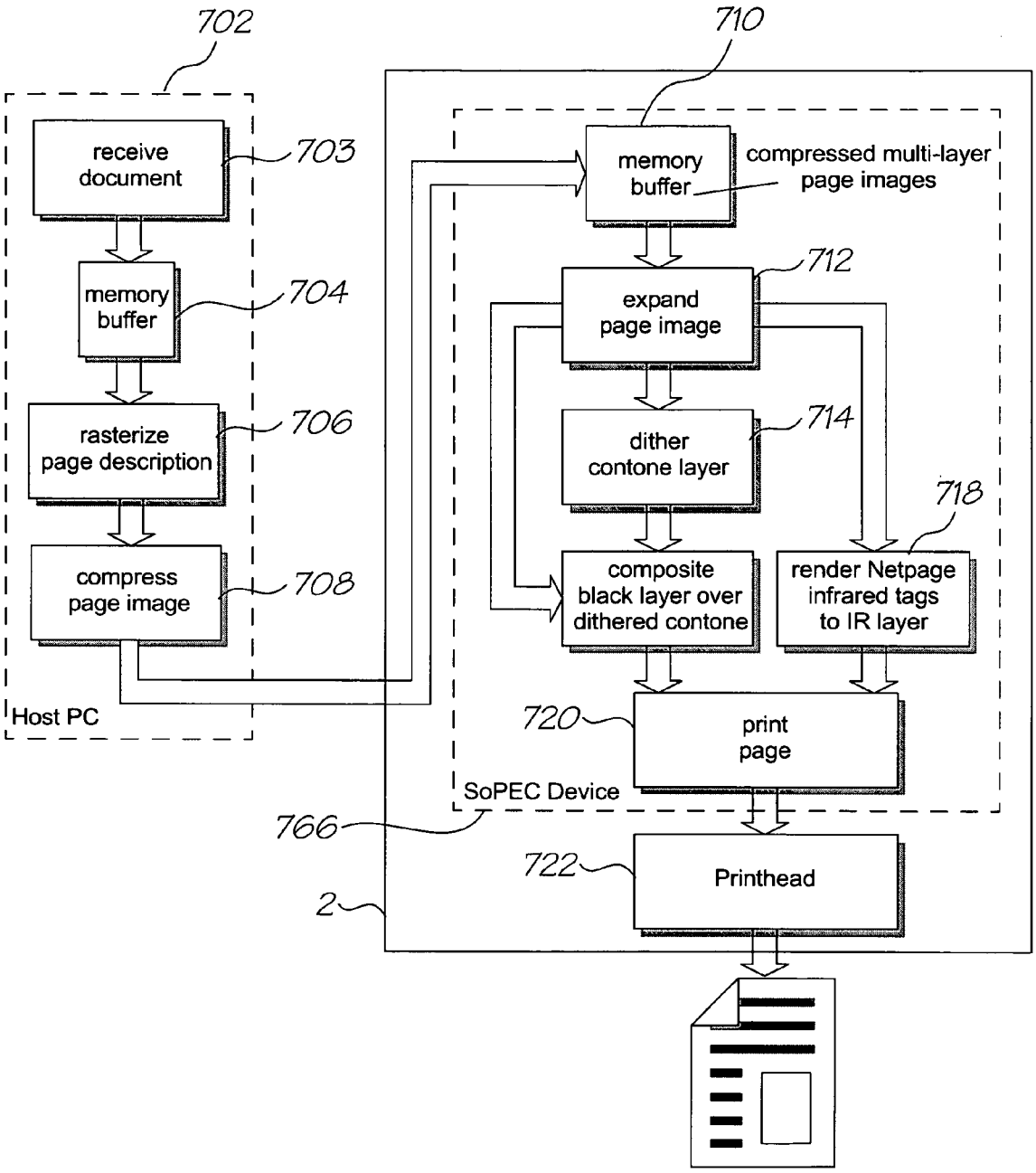
FIG. 3 shows a schematic of document data flow in a printing system according to one embodiment of the present invention.

FIG. 3 schematically shows how the printer 2 may be arranged to print documents received from an external source, such as a computer system 702, onto a print media, such as a sheet of paper. In this regard, the printer 2 includes an electrical connection with the computer system 702 to receive pre-processed data. In the particular situation shown, the external computer system 702 is programmed to perform various steps involved in printing a document, including receiving the document (step 703), buffering it (step 704) and rasterizing it (step 706), and then compressing it (step 708) for transmission to the printer 2.

The printer 2 according to one embodiment of the present invention, receives the document from the external computer system 702 in the form of a compressed, multi-layer page image, wherein control electronics 766 buffers the image (step 710), and then expands the image (step 712) for further processing. The expanded contone layer is dithered (step 714) and then the black layer from the expansion step is composited over the dithered contone layer (step 716). Coded data may also be rendered (step 718) to form an additional layer, to be printed (if desired) using an infrared ink that is substantially invisible to the human eye. The black, dithered contone and infrared layers are combined (step 720) to form a page that is supplied to a printhead for printing (step 722).

In this particular arrangement, the data associated with the document to be printed is divided into a high-resolution bi-level mask layer for text and line art and a medium-resolution contone color image layer for images or background colors. Optionally, colored text can be supported by the addition of a medium-to-high-resolution contone texture layer for texturing text and line art with color data taken from an image or from flat colors. The printing architecture generalises these contone layers by representing them in abstract "image" and "texture" layers which can refer to either image data or flat color data. This division of data into layers based on content follows the base mode Mixed Raster Content (MRC) mode as would be understood by a person skilled in the art. Like the MRC base mode, the printing architecture makes compromises in some cases when data to be printed overlap. In particular, in one form all overlaps are reduced to a 3-layer representation in a process (collision resolution) embodying the compromises explicitly.

Figure 4:
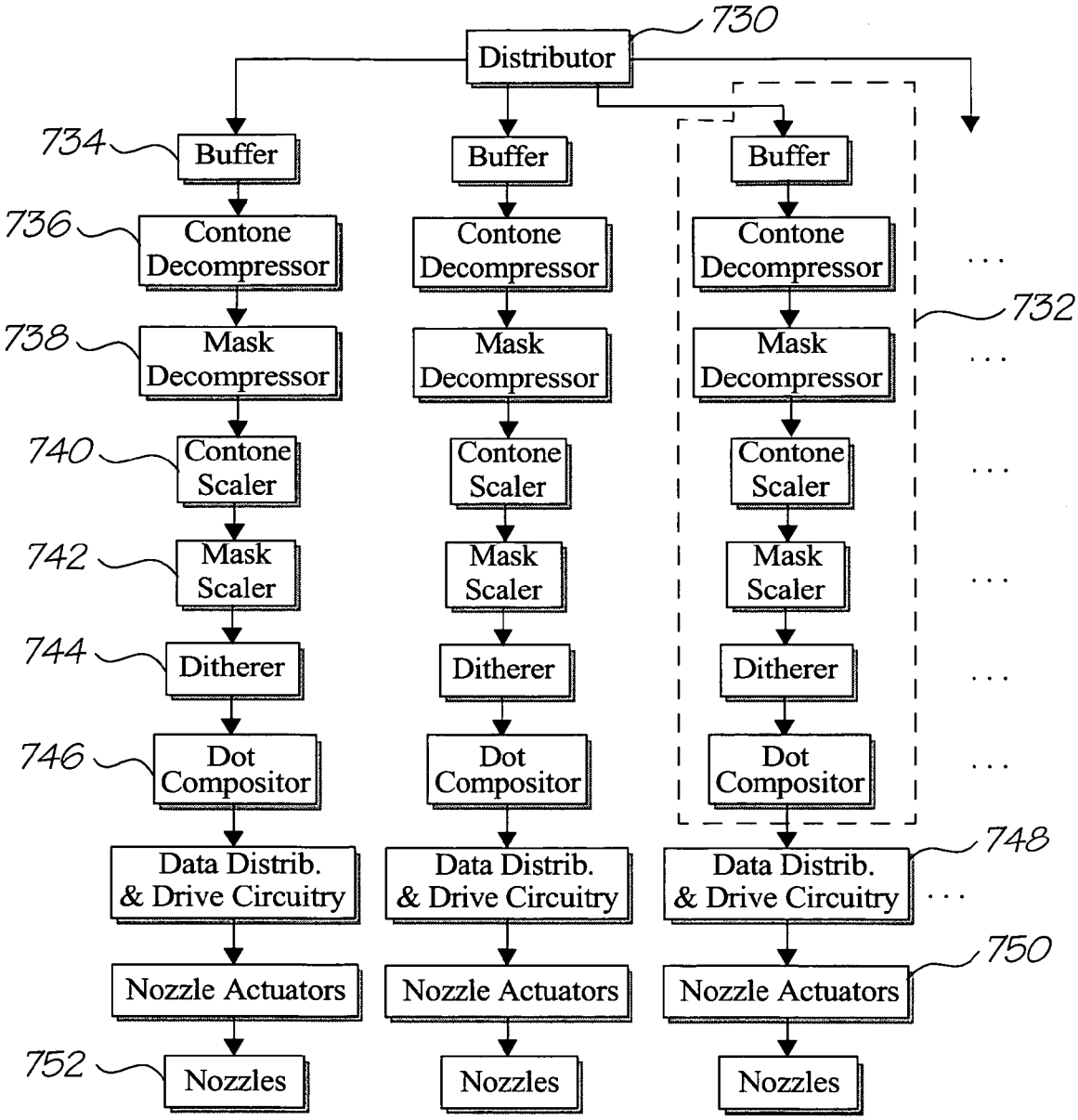
FIG. 4 shows a more detailed schematic showing an architecture used in the printing system of FIG. 3.

FIG. 4 sets out the print data processing by the print engine controller 766. Three separate pipelines are shown and so each would have a print engine controller (PEC) chip. The Applicant's SoPEC (SOHO PEC) chips are usually configured for print speeds of 30 pages per minute. Using the three in parallel as shown in FIG. 4 can achieve 90 ppm. As mentioned previously, data is delivered to the printer unit 2 in the form of a compressed, multi-layer page image with the pre-processing of the image performed by a mainly software-based computer system 702. In turn, the print engine controller 766 processes this data using a mainly hardware-based system.

Upon receiving the data, a distributor 730 converts the data from a proprietary representation into a hardware-specific representation and ensures that the data is sent to the correct hardware device whilst observing any constraints or requirements on data transmission to these devices. The distributor 730 distributes the converted data to an appropriate one of a plurality of pipelines 732. The pipelines are identical to each other, and in essence provide decompression, scaling and dot compositing functions to generate a set of printable dot outputs.

Each pipeline 732 includes a buffer 734 for receiving the data. A contone decompressor 736 decompresses the color contone planes, and a mask decompressor decompresses the monotone (text) layer. Contone and mask scalers 740 and 742 scale the decompressed contone and mask planes respectively, to take into account the size of the medium onto which the page is to be printed.

The scaled contone planes are then dithered by ditherer 744. In one form, a stochastic dispersed-dot dither is used. Unlike a clustered-dot (or amplitude-modulated) dither, a dispersed-dot (or frequency-modulated) dither reproduces high spatial frequencies (i.e. image detail) almost to the limits of the dot resolution, while simultaneously reproducing lower spatial frequencies to their full color depth, when spatially integrated by the eye. A stochastic dither matrix is carefully designed to be relatively free of objectionable low-frequency patterns when tiled across the image. As such, its size typically exceeds the minimum size required to support a particular number of intensity levels (e.g. 16×16×8 bits for 255 intensity levels).

The dithered planes are then composited in a dot compositor 746 on a dot-by-dot basis to provide dot data suitable for printing. This data is forwarded to data distribution and drive electronics 748, which in turn distributes the data to the correct nozzle actuators 750, which in turn cause ink to be ejected from the correct nozzles 752 at the correct time in a manner which will be described in more detail later in the description.

As will be appreciated, the components employed within the print engine controller 766 to process the image for printing depend greatly upon the manner in which data is presented. In this regard it may be possible for the print engine controller 766 to employ additional software and/or hardware components to perform more processing within the printer unit 2 thus reducing the reliance upon the computer system 702. Alternatively, the print engine controller 766 may employ fewer software and/or hardware components to perform less processing thus relying upon the computer system 702 to process the image to a higher degree before transmitting the data to the printer unit 2.

Figure 5:
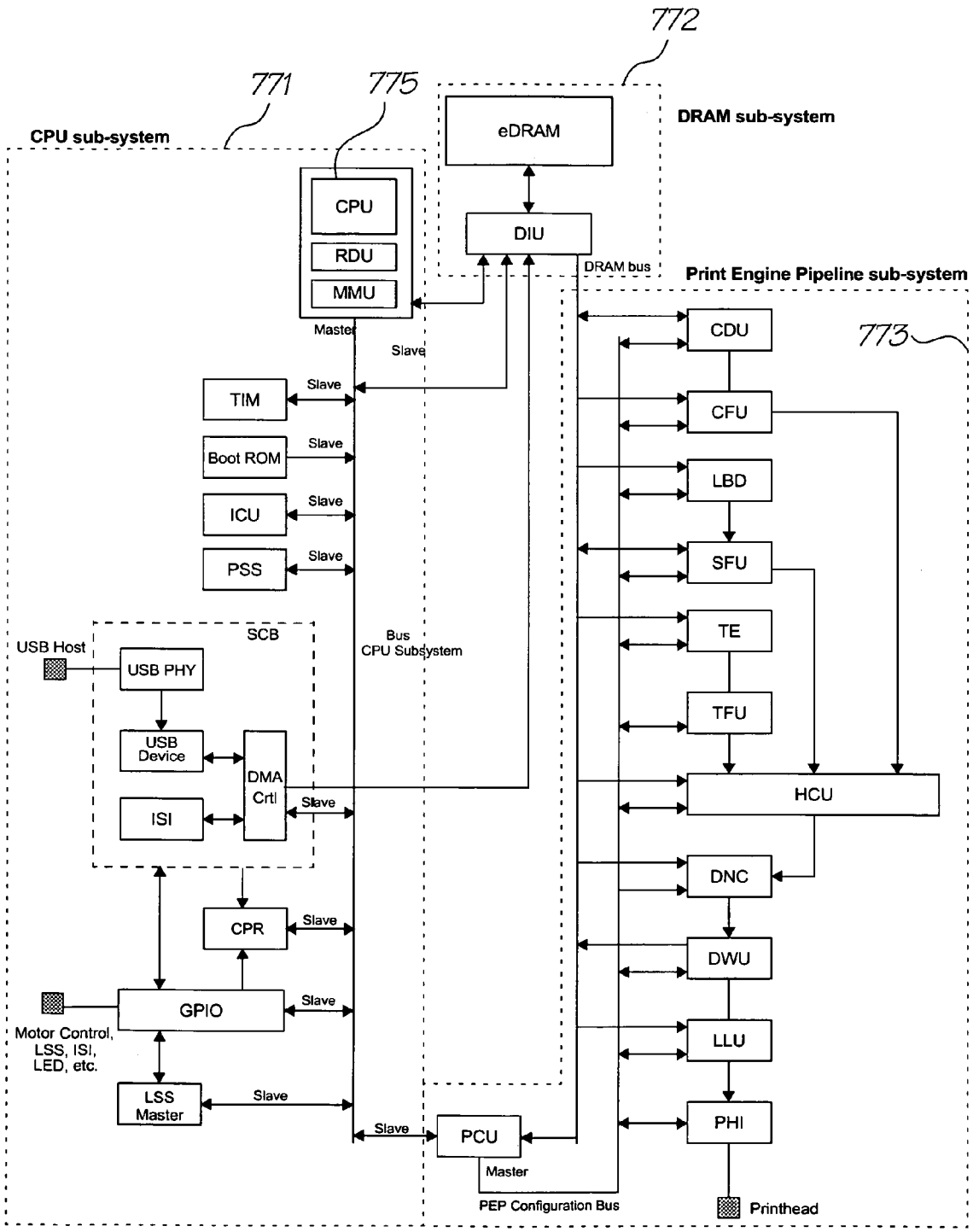
FIG. 5 shows a block diagram of an embodiment of the control electronics as used in the printing system of FIG. 3.

FIG. 5 provides a block representation of the components necessary to perform the above mentioned tasks. In this arrangement, the hardware pipelines 732 are embodied in a Small Office Home Office Printer Engine Chip (SoPEC) 766. As shown, a SoPEC device consists of 3 distinct subsystems: a Central Processing Unit (CPU) subsystem 771, a Dynamic Random Access Memory (DRAM) subsystem 772 and a Print Engine Pipeline (PEP) subsystem 773.

The CPU subsystem 771 includes a CPU 775 that controls and configures all aspects of the other subsystems. It provides general support for interfacing and synchronizing all elements of the print engine 1. It also controls the low-speed communication to QA chips (described below). The CPU subsystem 771 also contains various peripherals to aid the CPU 775, such as General Purpose Input Output (GPIO, which includes motor control), an Interrupt Controller Unit (ICU), LSS Master and general timers. The Serial Communications Block (SCB) on the CPU subsystem provides a full speed USB1.1 interface to the host as well as an Inter SoPEC Interface (ISI) to other SoPEC devices (not shown).

The DRAM subsystem 772 accepts requests from the CPU, Serial Communications Block (SCB) and blocks within the PEP subsystem. The DRAM subsystem 772, and in particular the DRAM Interface Unit (DIU), arbitrates the various requests and determines which request should win access to the DRAM. The DIU arbitrates based on configured parameters, to allow sufficient access to DRAM for all requestors. The DIU also hides the implementation specifics of the DRAM such as page size, number of banks and refresh rates.

The Print Engine Pipeline (PEP) subsystem 773 accepts compressed pages from DRAM and renders them to bi-level dots for a given print line destined for a printhead interface (PHI) that communicates directly with the printhead. The first stage of the page expansion pipeline is the Contone Decoder Unit (CDU), Lossless Bi-level Decoder (LBD) and, where required, Tag Encoder (TE). The CDU expands the JPEG-compressed contone (typically CMYK) layers, the LBD expands the compressed bi-level layer (typically K), and the TE encodes any Netpage tags for later rendering (typically in IR or K ink), in the event that the printer unit 2 has Netpage capabilities (see the cross referenced documents for a detailed explanation of the Netpage system). The output from the first stage is a set of buffers: the Contone FIFO unit (CFU), the Spot FIFO Unit (SFU), and the Tag FIFO Unit (TFU). The CFU and SFU buffers are implemented in DRAM.

The second stage is the Halftone Compositor Unit (HCU), which dithers the contone layer and composites position tags and the bi-level spot layer over the resulting bi-level dithered layer.

A number of compositing options can be implemented, depending upon the printhead with which the SoPEC device is used. Up to 6 channels of bi-level data are produced from this stage, although not all channels may be present on the printhead. For example, the printhead may be CMY only, with K pushed into the CMY channels and IR ignored. Alternatively, any encoded tags may be printed in K if IR ink is not available (or for testing purposes).

In the third stage, a Dead Nozzle Compensator (DNC) compensates for dead nozzles in the printhead by color redundancy and error diffusing of dead nozzle data into surrounding dots.

The resultant bi-level 5 channel dot-data (typically CMYK, Infrared) is buffered and written to a set of line buffers stored in DRAM via a Dotline Writer Unit (DWU).

Finally, the dot-data is loaded back from DRAM, and passed to the printhead interface via a dot FIFO. The dot FIFO accepts data from a Line Loader Unit (LLU) at the system clock rate (pclk), while the PrintHead Interface (PHI) removes data from the FIFO and sends it to the printhead at a rate of ⅔ times the system clock rate.

In the preferred form, the DRAM is 2.5 Mbytes in size, of which about 2 Mbytes are available for compressed page store data. A compressed page is received in two or more bands, with a number of bands stored in memory. As a band of the page is consumed by the PEP subsystem 773 for printing, a new band can be downloaded. The new band may be for the current page or the next page.

Using banding it is possible to begin printing a page before the complete compressed page is downloaded, but care must be taken to ensure that data is always available for printing or a buffer under-run may occur.

The embedded USB 1.1 device accepts compressed page data and control commands from the host PC, and facilitates the data transfer to either the DRAM (or to another SoPEC device in multi-SoPEC systems, as described below).

Multiple SoPEC devices can be used in alternative embodiments, and can perform different functions depending upon the particular implementation. For example, in some cases a SoPEC device can be used simply for its onboard DRAM, while another SoPEC device attends to the various decompression and formatting functions described above. This can reduce the chance of buffer under-run, which can happen in the event that the printer commences printing a page prior to all the data for that page being received and the rest of the data is not received in time. Adding an extra SoPEC device for its memory buffering capabilities doubles the amount of data that can be buffered, even if none of the other capabilities of the additional chip are utilized.

Each SoPEC system can have several quality assurance (QA) devices designed to cooperate with each other to ensure the quality of the printer mechanics, the quality of the ink supply so the printhead nozzles will not be damaged during prints, and the quality of the software to ensure printheads and mechanics are not damaged.

Normally, each printing SoPEC will have an associated printer unit QA, which stores information relating to the printer unit attributes such as maximum print speed. The cartridge unit may also contain a QA chip, which stores cartridge information such as the amount of ink remaining, and may also be configured to act as a ROM (effectively as an EEPROM) that stores printhead-specific information such as dead nozzle mapping and printhead characteristics. The refill unit may also contain a QA chip, which stores refill ink information such as the type/colour of the ink and the amount of ink present for refilling. The CPU in the SoPEC device can optionally load and run program code from a QA Chip that effectively acts as a serial EEPROM. Finally, the CPU in the SoPEC device runs a logical QA chip (i.e., a software QA chip).

Usually, all QA chips in the system are physically identical, with only the contents of flash memory differentiating one from the other.

Each SoPEC device has two LSS system buses that can communicate with QA devices for system authentication and ink usage accounting. A large number of QA devices can be used per bus and their position in the system is unrestricted with the exception that printer QA and ink QA devices should be on separate LSS busses.

In use, the logical QA communicates with the ink QA to determine remaining ink. The reply from the ink QA is authenticated with reference to the printer QA. The verification from the printer QA is itself authenticated by the logical QA, thereby indirectly adding an additional authentication level to the reply from the ink QA.

Data passed between the QA chips is authenticated by way of digital signatures. In the preferred embodiment, HMAC-SHA1 authentication is used for data, and RSA is used for program code, although other schemes could be used instead.

As will be appreciated, the SoPEC device therefore controls the overall operation of the print engine 1 and performs essential data processing tasks as well as synchronising and controlling the operation of the individual components of the print engine 1 to facilitate print media handling.

Printhead Cartridge and Printer Cradle Assembly Overview

Figure 6:
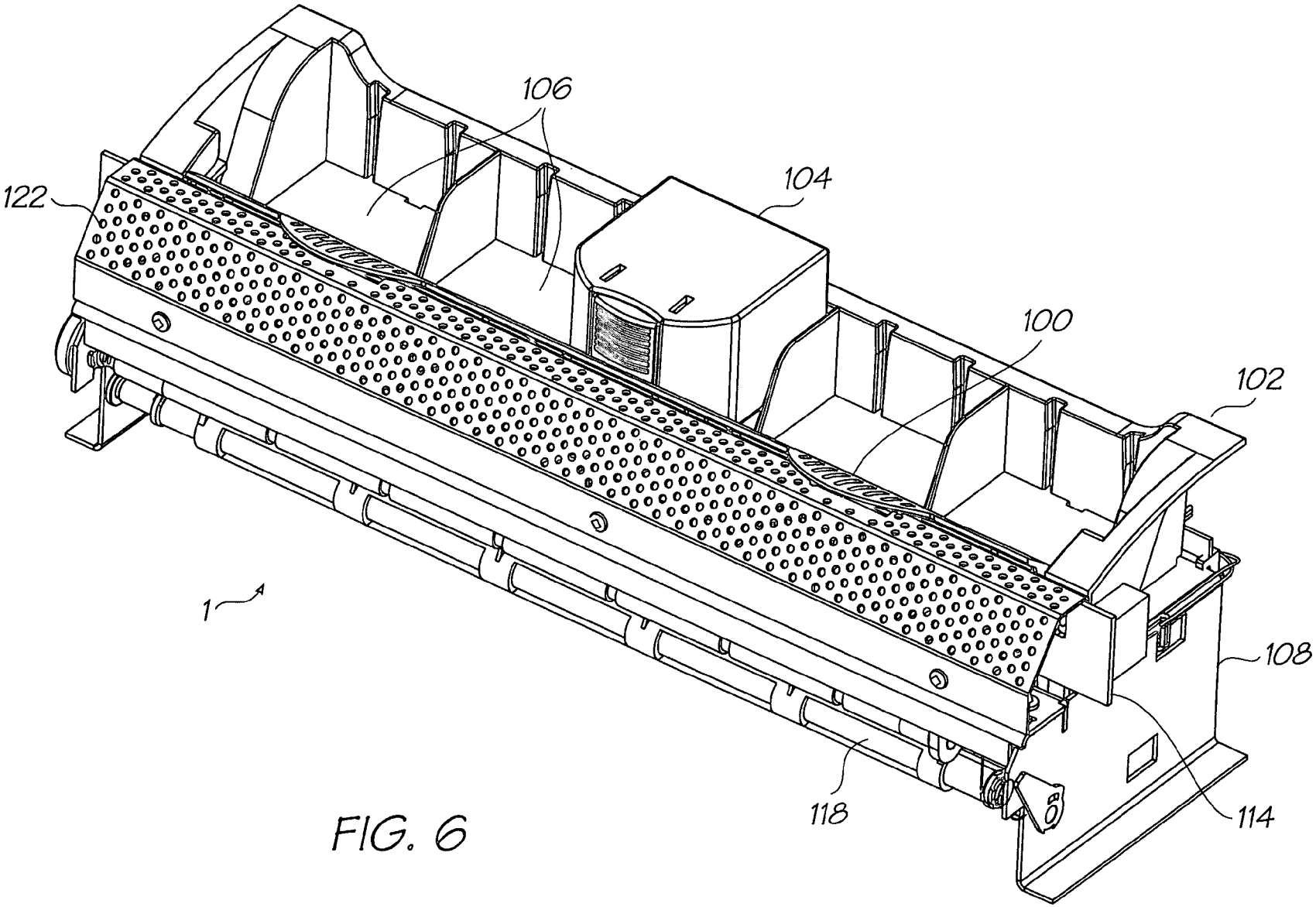
FIG. 6 is a front and top perspective of the printhead cartridge in the printer cradle with one ink cartridge installed.
Figure 7B:
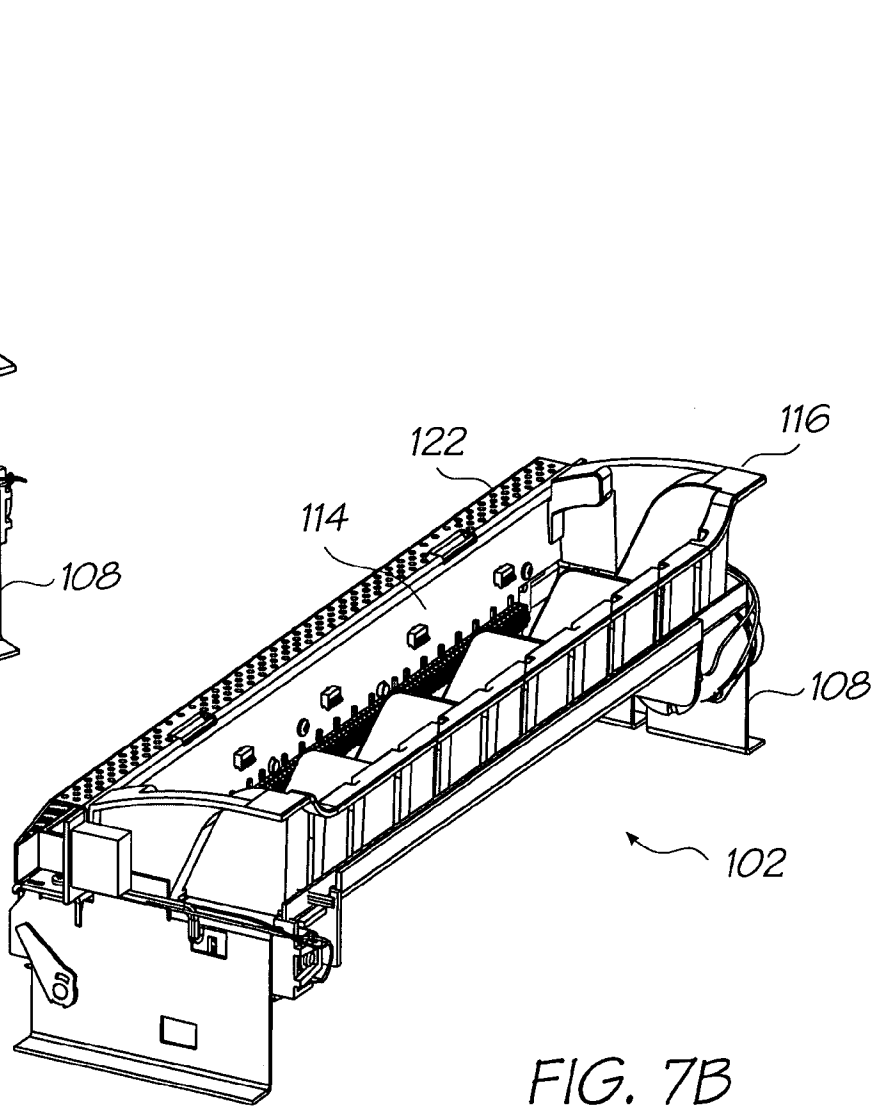
FIGS. 7*a* to 7*d* show perspectives of the printer cradle in isolation.
Figure 7A:
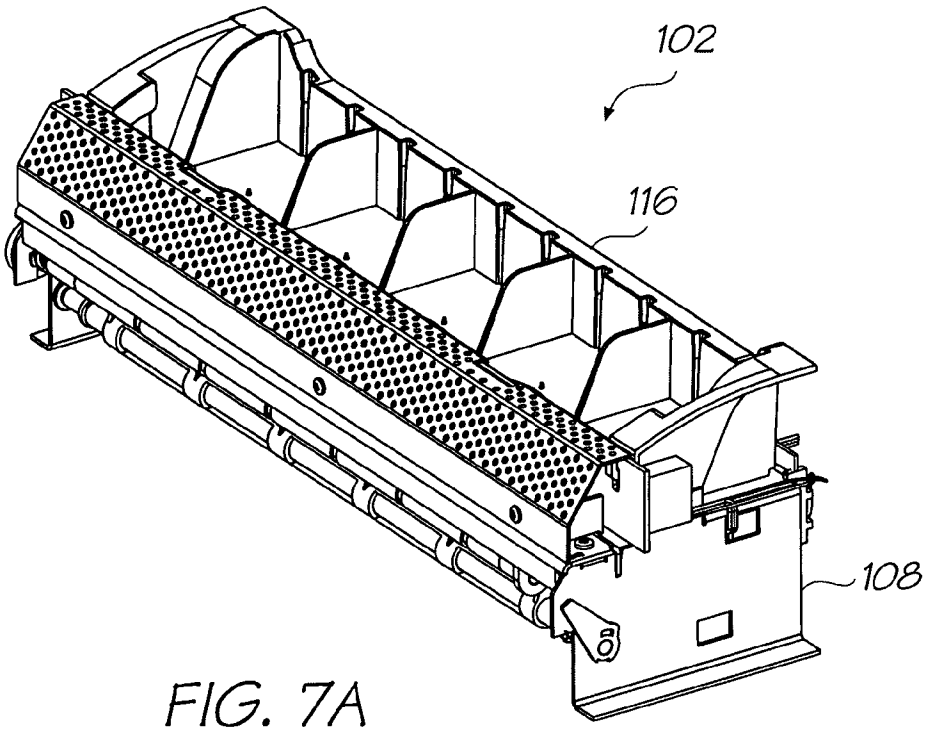
Figure 7D:
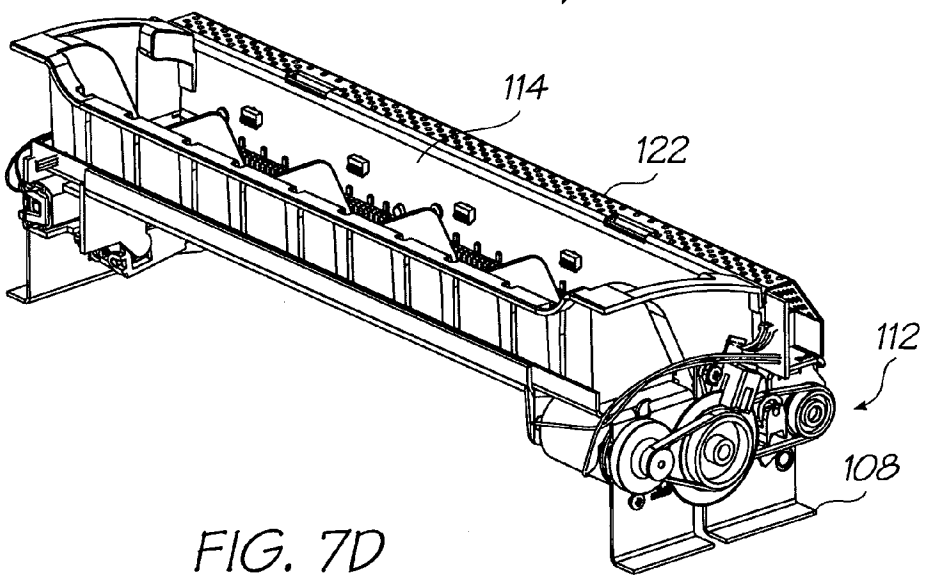
Figure 7C:
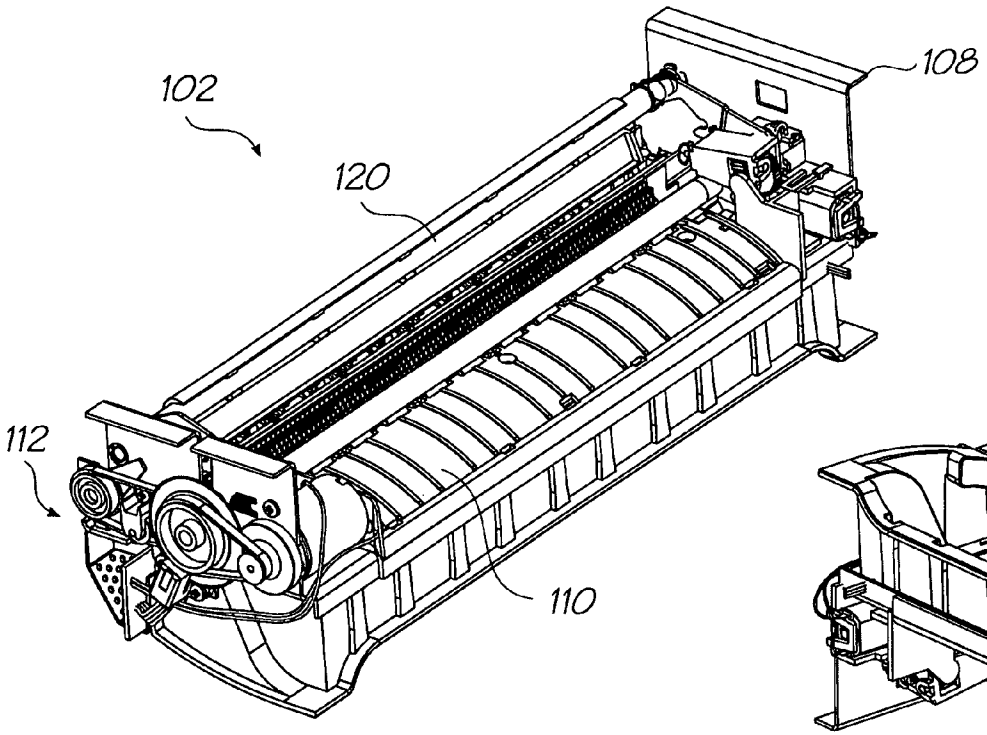

As shown in FIG. 6, the print engine 1 is a printhead cartridge 100 and printer cradle 102 assembly. Also shown is one of the five ink cartridges 104 that are installed in respective docking bays 106 formed by the cradle and printhead cartridge. The ink cartridges can supply CMYK and IR (for printing invisible coded data) or CMYKK.

The printer cradle 102 is permanently installed in the printer casing with the desired configuration for the product application e.g. L-path, C-path, straight path etc. The printhead cartridge 100 is installed into the cradle 102. As nozzles in the printhead (described below) clog or otherwise fail, the printhead cartridge 100 can be replaced to maintain print quality, instead of replacing the entire printer.

Printer Cradle

Figure 8:
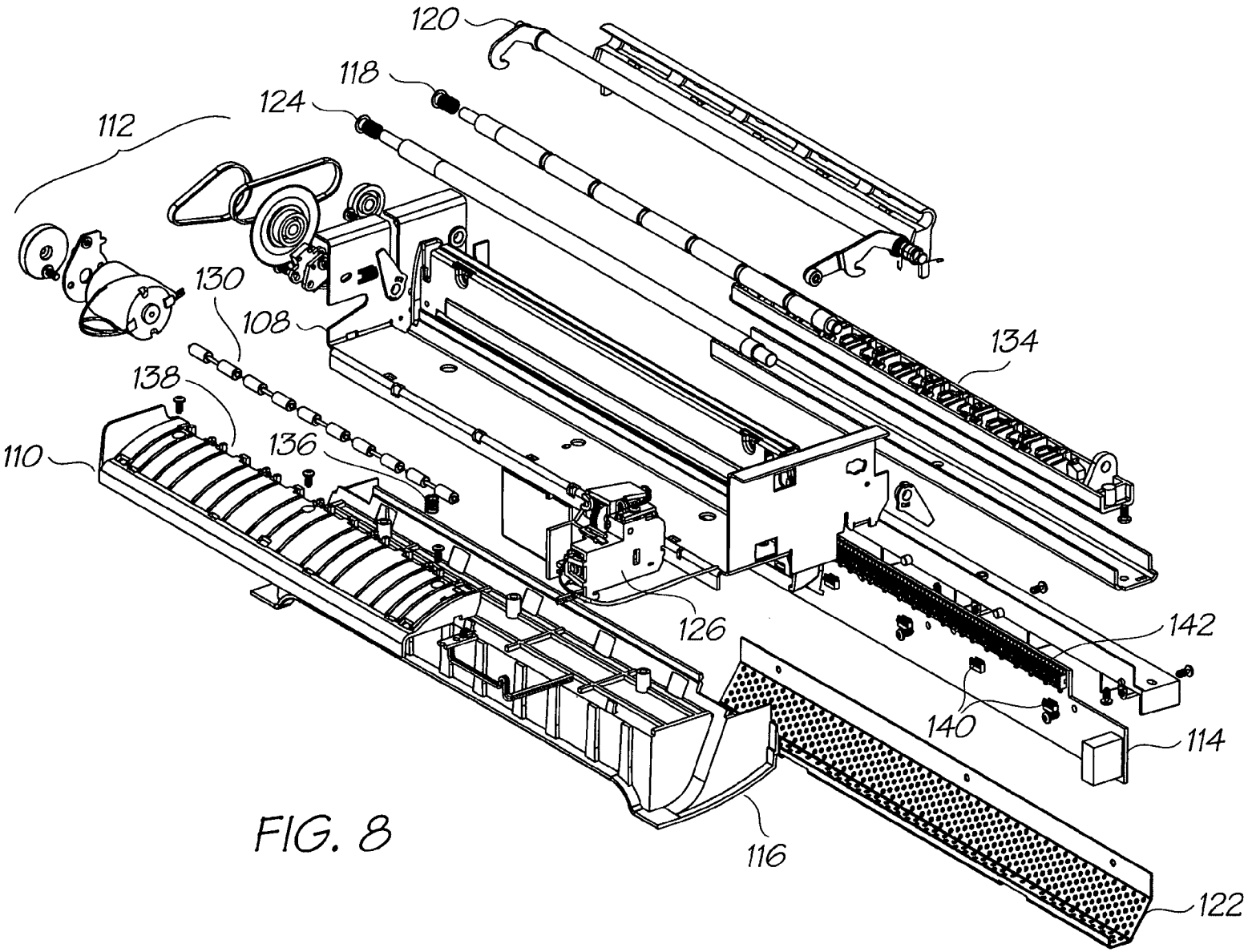
FIG. 8 is an exploded rear perspective of the printer cradle.
Figure 9:
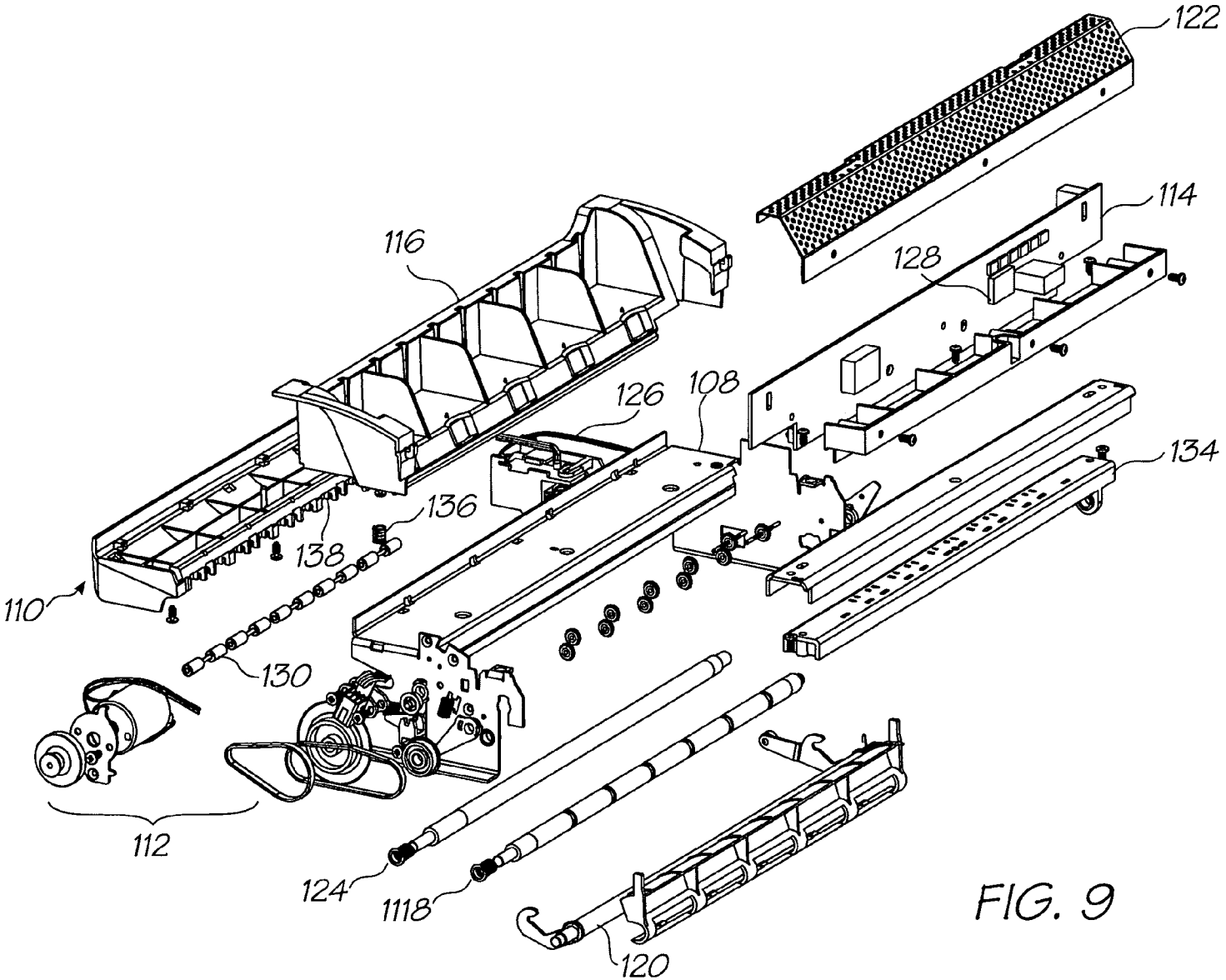
FIG. 9 is an exploded front perspective of the printer cradle.

FIGS. 7*a* to 7*d* shows perspectives of the cradle 102 from various angles. Together with the exploded views of FIGS. 8 and 9, they illustrate the assembly of the component parts. The cradle chassis 108 is a pressed metal component 108 that supports the other components within the printer casing to complete the media feed path from the media feed tray to the output tray.

Sheets of blank media are guided by the guide molding 110 into the nip between the input drive roller 124 and the sprung rollers 130. The sprung rollers 130 are supported in the sprung roller mounts 138 formed on the guide molding 110 and biased into engagement with the rubberized surface of the drive roller 124 with springs 136 (one only shown). The drive roller 124 is driven by the media feed drive assembly 112.

The media is fed past the printhead in the printhead cartridge (not shown) and into the nip between the spike wheels 132 and the output drive roller 118. The spike wheels 132 are supported in the spike wheel bearing molding 134 and the output drive roller 118 is also driven by the media feed drive assembly 112.

The control electronics for operating the printhead integrated circuits (described below) is provided on the printed circuit board (PCB) 114. The outer face of the PCB 11 shown in FIG. 9 has the SoPEC device 128 while the inner face (FIG. 8) has sockets 140 for receiving power and print data from an external source and distributing it to the SoPEC 128, and a line of sprung PCB contacts 142 for transmitting print data to the printhead IC discussed in greater detail below.

The heatshield 122 is attached to the PCB 114 to cover and protect the SoPEC 128 from any EMI in the vicinity of the printer. It also prevents user contact with any hot parts of the SoPEC or PCB.

The capper retraction shaft 120 is rotatably mounted below the output drive shaft 118 for engagement with the maintenance drive assembly 126. The maintenance drive assembly 126 mounts to the side of the cradle chassis 108 opposite to the media feed drive assembly 112.

Maintenance Drive Assembly

Figure 10B:
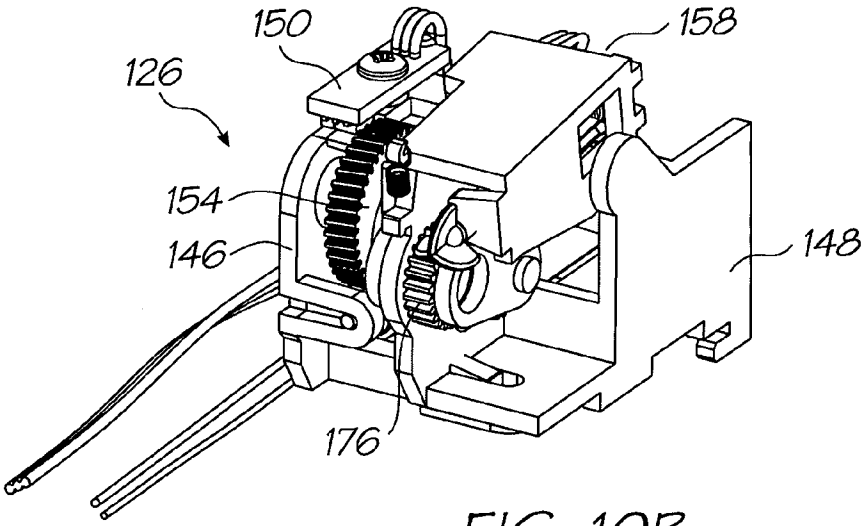
FIGS. 10*a* to 10*c* show perspectives of the maintenance drive assembly.
Figure 10C:
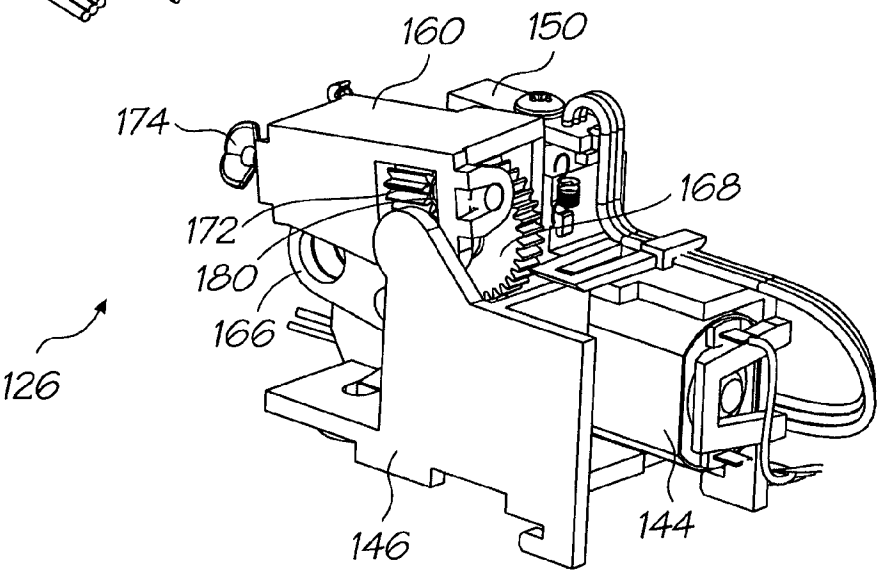
Figure 10A:
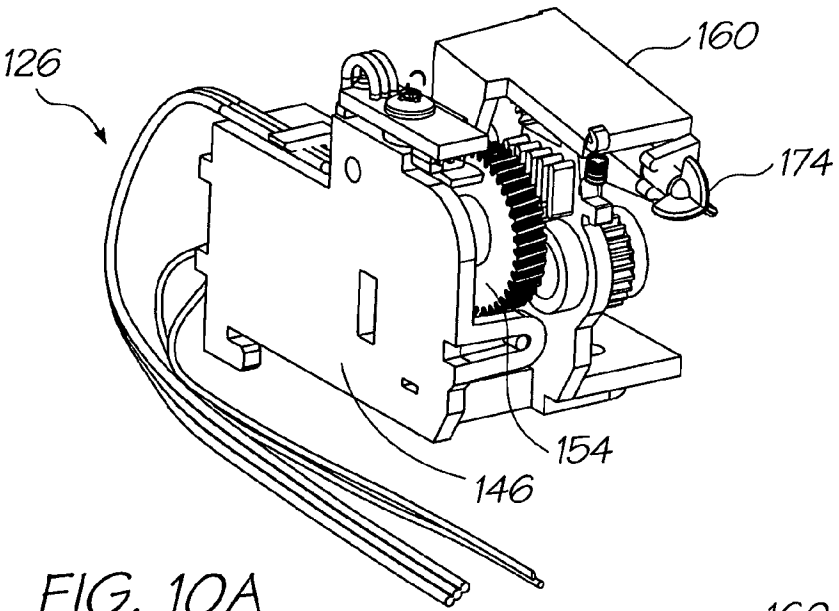
Figure 11A:
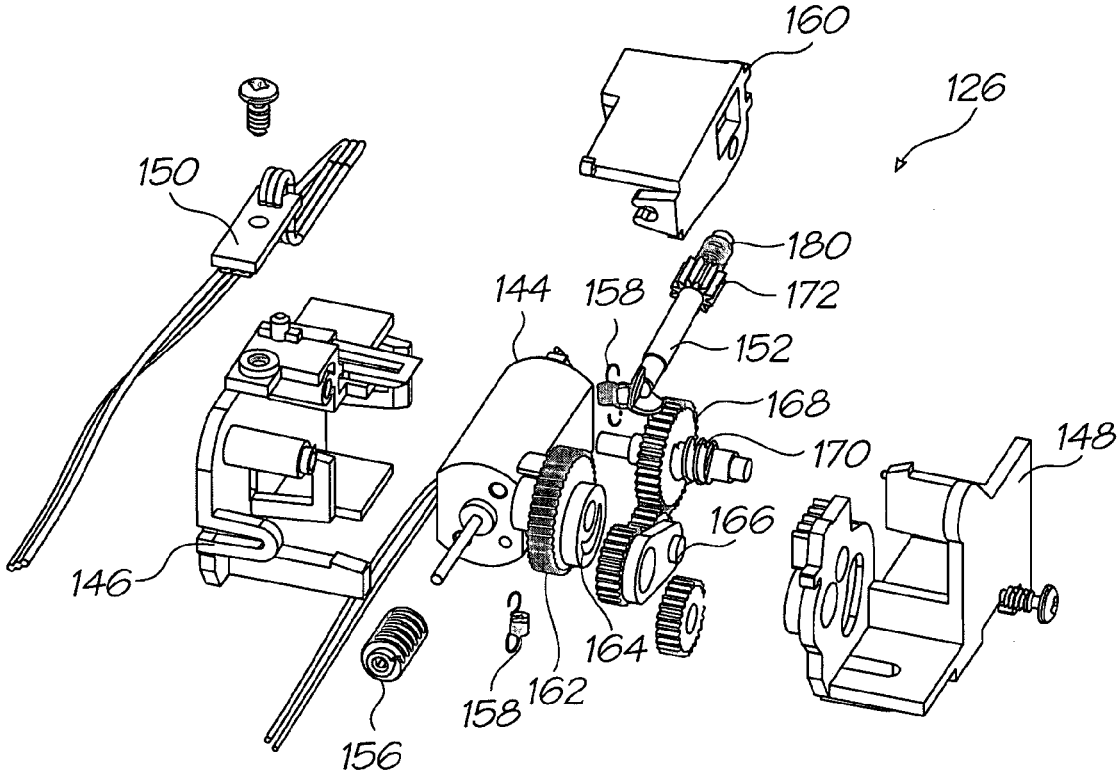
FIGS. 11*a* to 11*c* show exploded perspectives of the maintenance drive assembly.
Figure 11B:
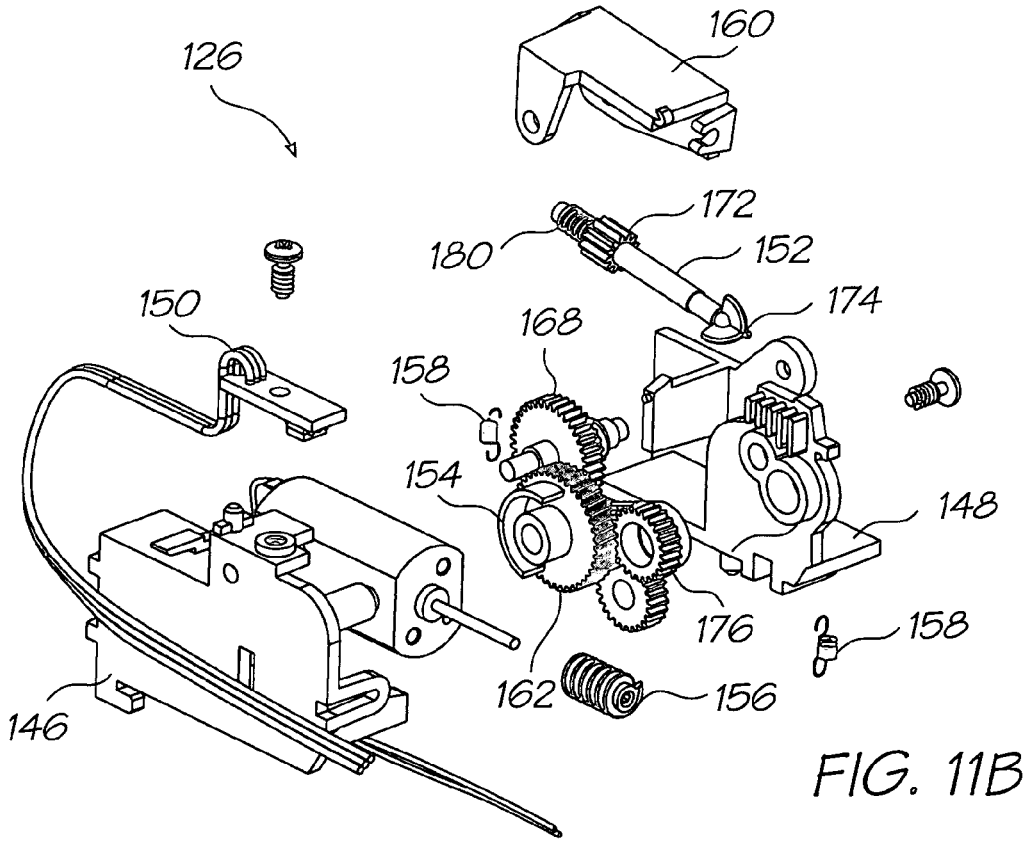
Figure 11C:
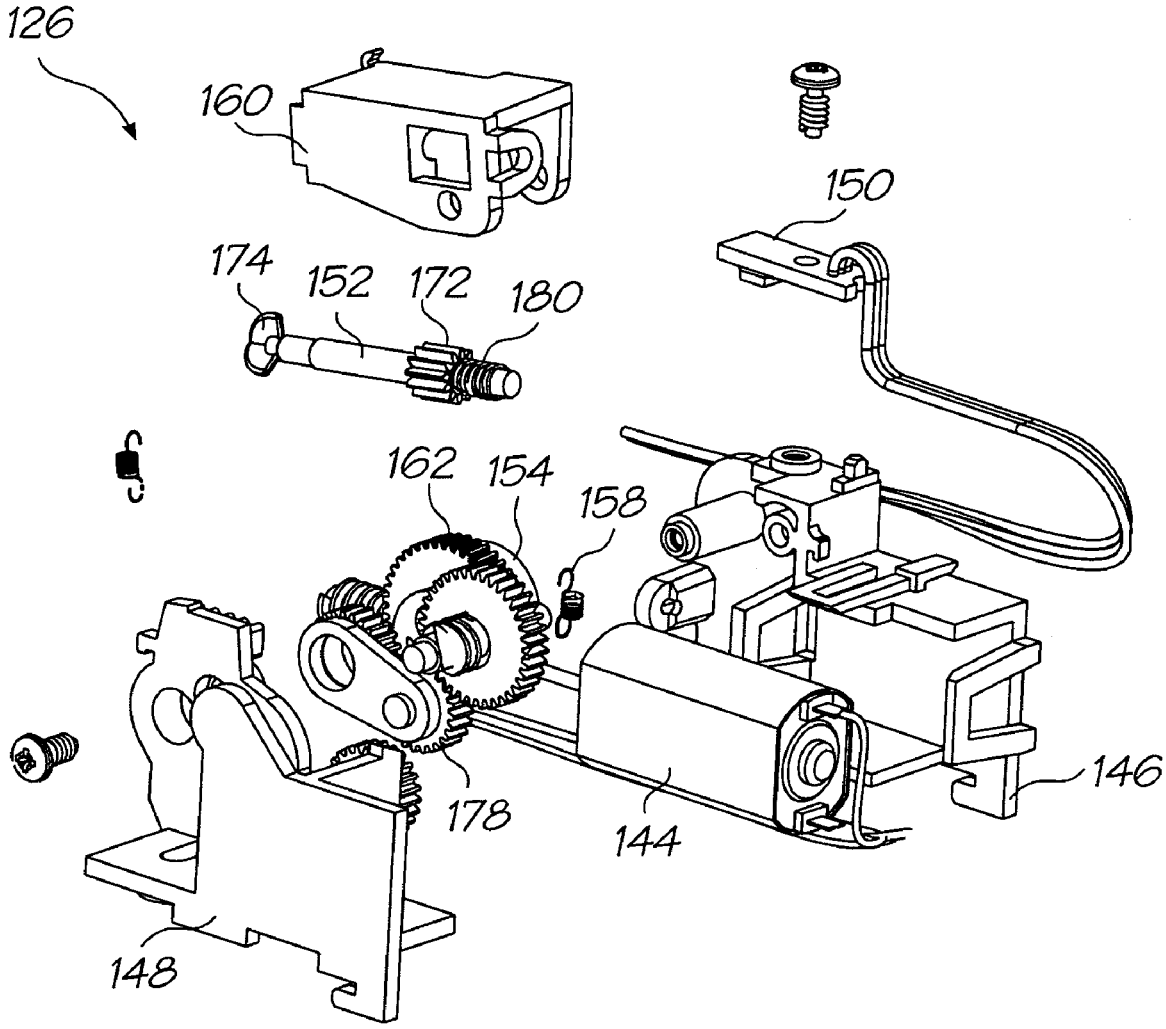

FIGS. 10*a* to 10*c* are perspective views of the maintenance drive assembly 126 from different angles. The exploded perspectives of FIGS. 11*a* to 11*c* are provided to clarify the assembly of its components.

A maintenance drive motor 144 is mounted between two side moldings 146 and 148. The motor powers the output worm gear 156 which is engaged with the main spur gear 162. On one side of the main spur gear is a coder 154 and on the opposite side is a cam 164. The coder 154 is sensed by an opto-electric transceiver 150 to inform the SoPEC 128 of the position of the cam 164. The eccentric driving gear 176 is fixedly mounted to the cam 164 and engages the drive idler gear 178. The idler drive gear is rotatably mounted to the pivoting link arm 166. The idler drive gear 178 meshes with the drive shaft spur gear 168 which is integrally formed with the drive shaft worm gear 170. The drive shaft worm gear 170 engages the spline 172 of the drive shaft 152. The drive shaft 152 is mounted in the drive shaft housing 160. The drive shaft housing 160 is pivotally mounted between the side moldings 146 and 148 so that the drive vanes 174 at the end of the drive shaft 152 have limited vertical travel. This allows the vanes 174 to remain engaged with the complementary socket in the maintenance station of the printhead cartridge (described below) as the capper chassis is retracted and extended.

Printhead Cartridge

Figure 19:
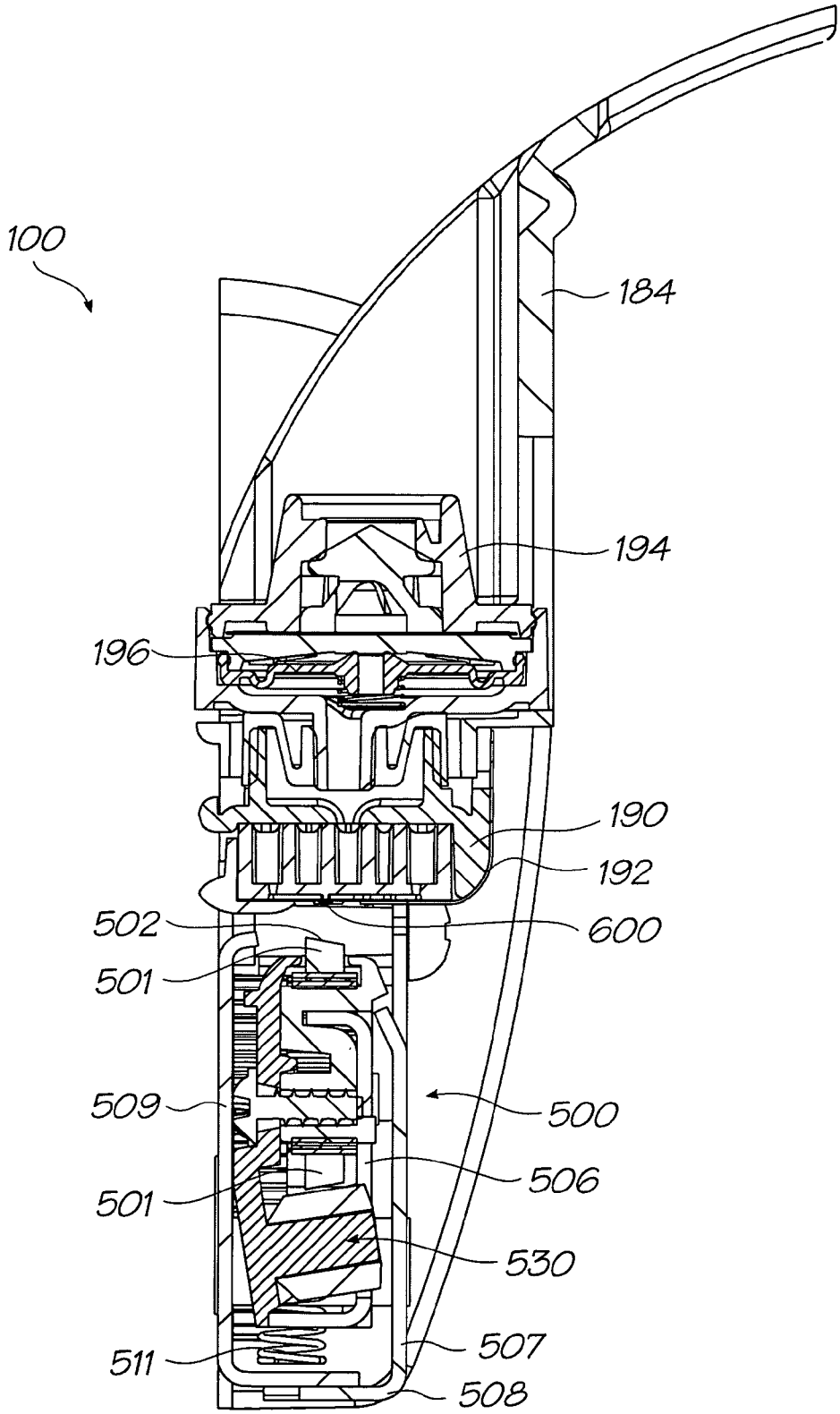
FIG. 19 is transverse section of the printhead cartridge, showing the belt in a second position, disengaged from the printhead.

FIG. 19 shows a transverse section of the printhead cartridge 100 in isolation. The casing 184 houses the inlet valve 194, the pressure regulator 196, the LCP molding assembly 190, flex PCB 192, printhead 600 and printhead maintenance station 500. These components will be described in more detail below. However, initially the insertion of the printhead cartridge 100 into the printer cradle 102 will be described with reference to FIGS. 12, 13 and 14.

Figure 12:
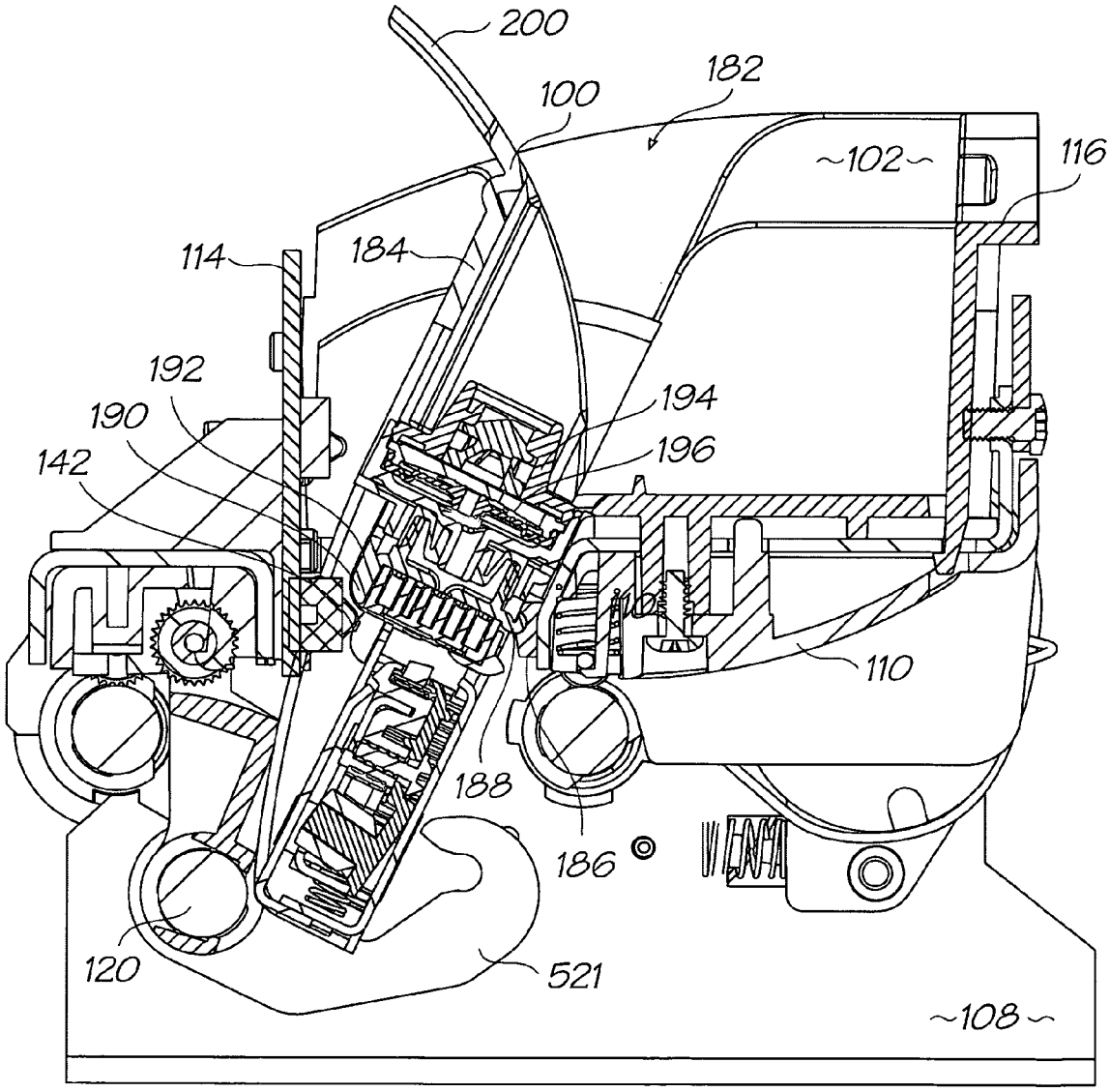
FIG. 12 is a lateral cross section showing the printhead cartridge being inserted into the printer cradle.

FIG. 12 shows the first stage of inserting the cartridge 100. The user holds the grip tabs 200 at the top of the casing 184 and slides the cartridge into the cavity 182 provided in the printer cradle 102. The cartridge 100 slides into the cavity 182 until the rounded lip 188 engages the complementary shaped fulcrum 186 on the side of the cavity. At this point, the user starts to rotate the cartridge 100 anti-clockwise about the fulcrum 186.

Figure 13:
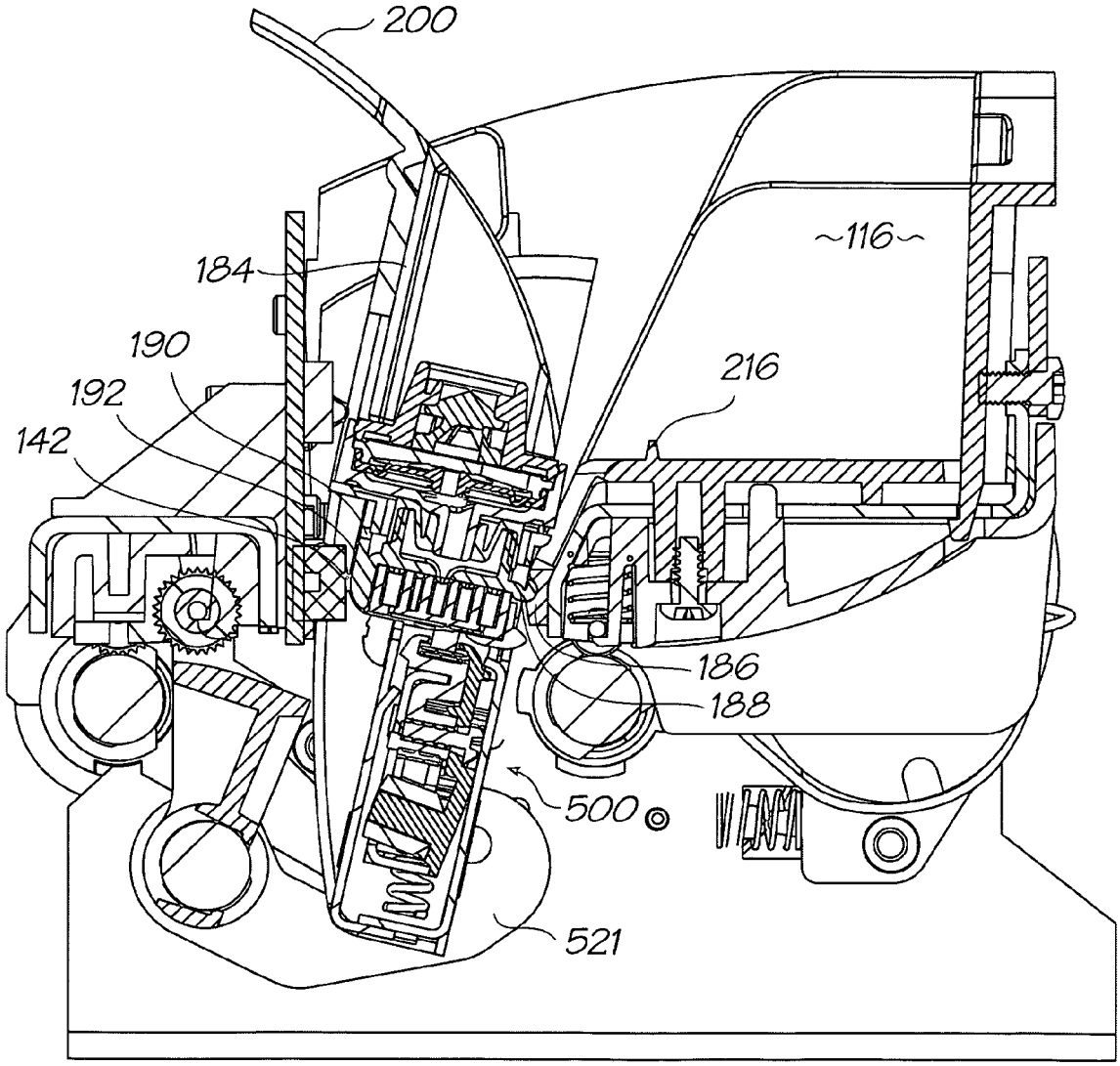
FIG. 13 is a lateral cross section showing the printhead cartridge rotated to the balance point of the over-centre mechanism as it inserted into the printer cradle.

As shown in FIG. 13, rotation of the cartridge anti-clockwise in the cavity is against the bias applied by the line sprung power and data contacts 142. The LCP molding assembly 190 has a curved outer surface around which is wrapped the flex PCB 192 leading to the printhead 600. The curved outer surface of the assembly 190 is configured so that the sprung contacts 142 are at a maximum point of compression before the cartridge 100 is fully rotated into its operative position. FIG. 13 shows the cartridge at this point of maximum compression.

Figure 14:
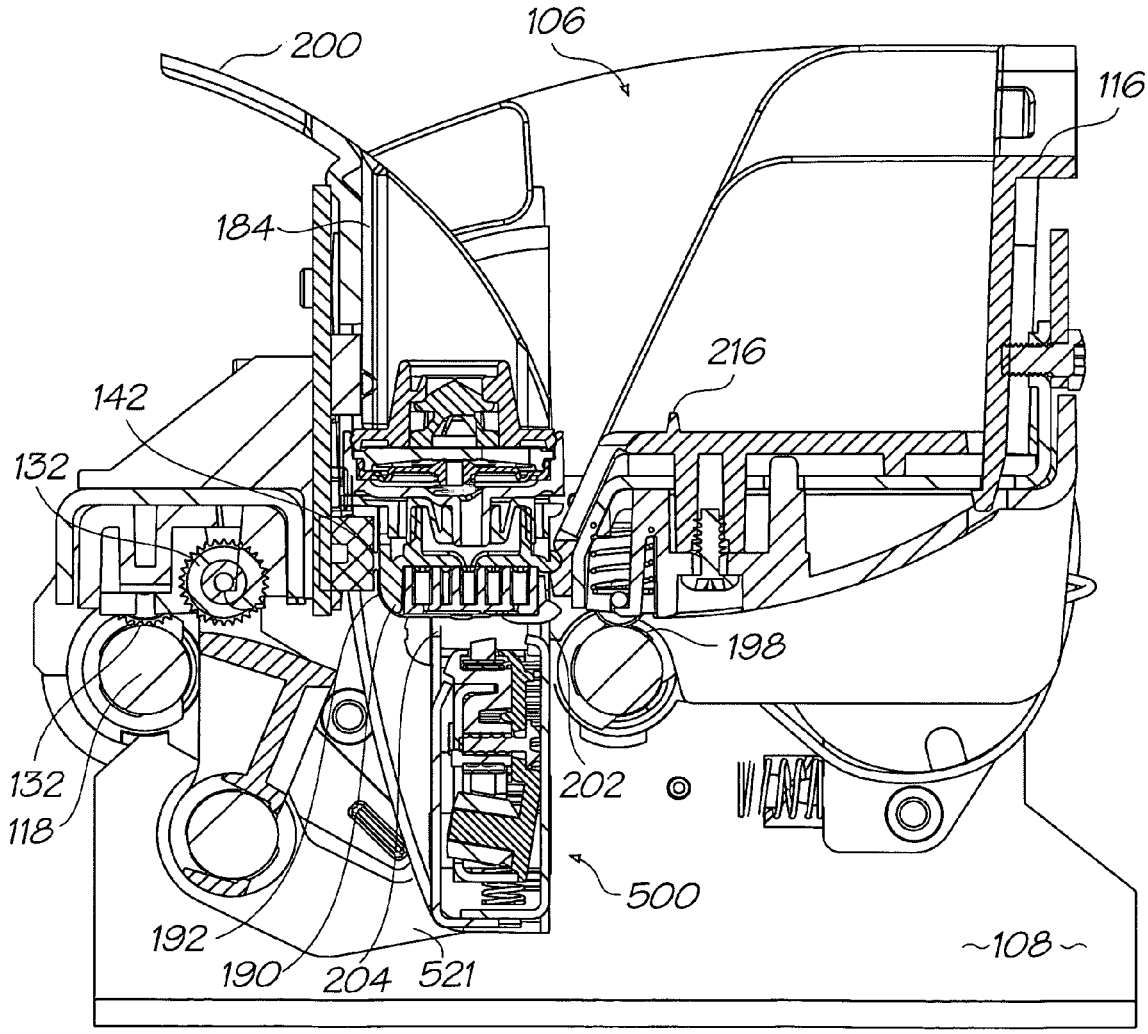
FIG. 14 is a lateral cross section showing the printhead cartridge biased into its operative position within the printer cradle.

FIG. 14 shows the cartridge 100 rotated past this point of maximum compression and into its operative position. The sprung contacts 142 have de-compressed slightly as they come into abutment with contact pads (not shown) on the flex PCB 192. In this way, the interaction between the printhead cartridge and the printer cradle is that of an overcentre mechanism. The cartridge 100 is biased clockwise until the balance point shown in FIG. 13, after which the cartridge is biased anti-clockwise into its operative position. This bias securely holds the printhead cartridge 100 in the operative position so that the media inlet aperture 202 is directly in front of the nip 198 of the input media feed rollers. Likewise, the media exit aperture 204 directly faces the output feed roller 118 and spike wheels 132 to complete the paper path. Also the cartridge casing 184 and the docking bay molding 116 properly combine to provide the correctly dimensioned ink cartridge docking bays 106.

The stiffness of each of the individual sprung contacts 142 is such that each contact presses onto its corresponding pad of the flex PCB 192 with the specified contact pressure. Compressing all the sprung contacts 142 simultaneously requires significant force (approx. 100N) but the casing 184 and the fulcrum 186 are in effect a first class lever that gives the user a substantial mechanical advantage. It can be seen from FIGS. 12 to 14 that the lever arm from the fulcrum 186 to the grip tabs 200 far exceeds the lever arm from the fulcrum to the curved outer surface of the LCP assembly 190.

Printhead Maintenance Station

Figure 20:
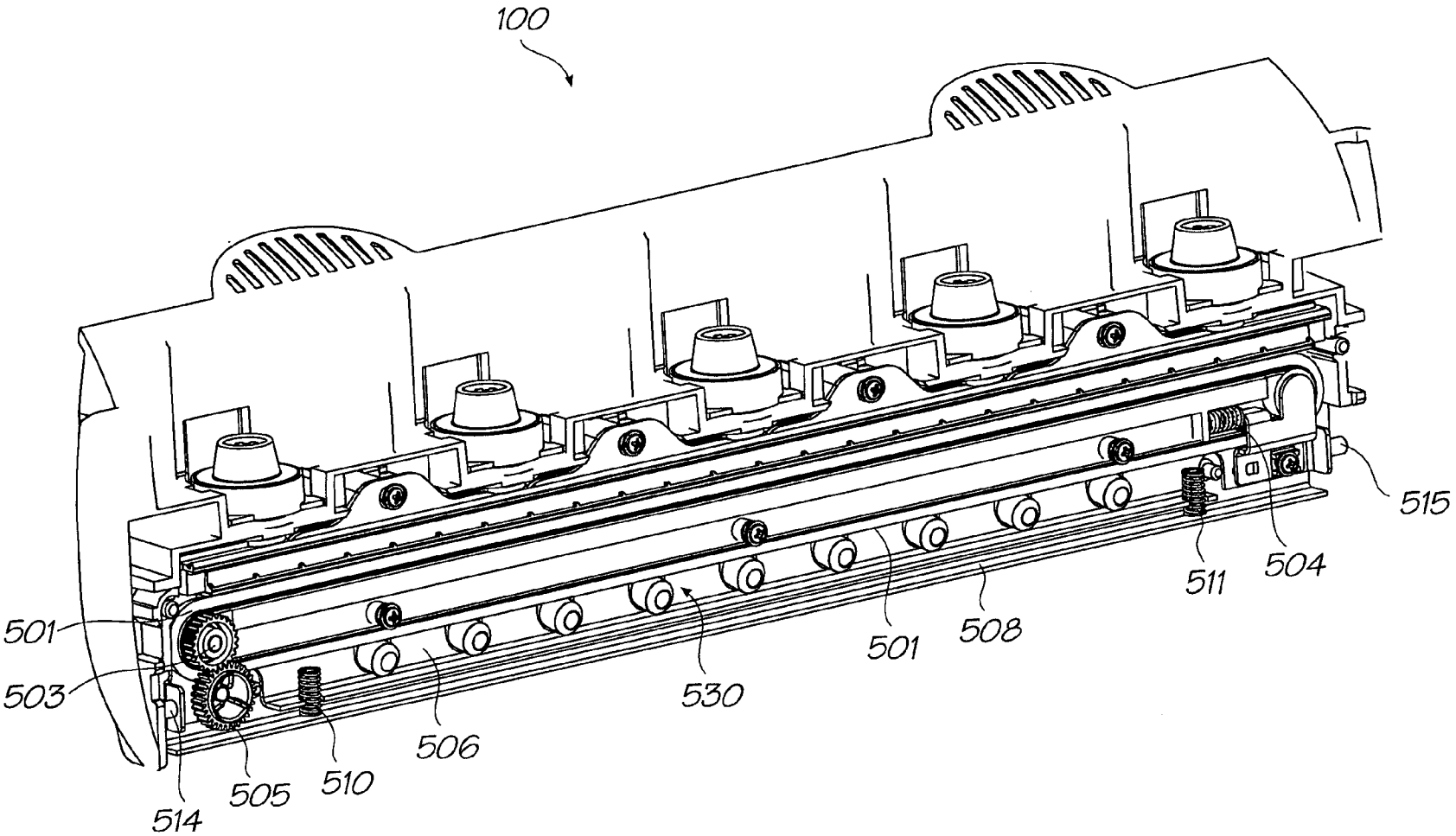
FIG. 20 is a perspective cutaway view of the printhead cartridge with internal components of the printhead maintenance station exposed.

FIGS. 19 to 22 show in detail the printhead maintenance station 500 for maintaining the printhead 600 in an operable condition. As shown in FIGS. 19 and 20, the printhead maintenance station 500 forms an integral part of the printhead cartridge 600 and is therefore always available for maintenance operations, either in between printing sheets or when the printer is idle.

The printhead maintenance station 500 comprises an elastically deformable belt 501 having a contact surface 502 for sealing engagement with an ink ejection face 601 of the printhead 600. Typically, the belt is comprised of silicone rubber mounted on a plastics support, although it will be appreciated that other elastically deformable or resilient materials, such as polyurethane, Neoprene®, Santoprene® or Kraton® may also be used in place of silicone.

Figure 21:
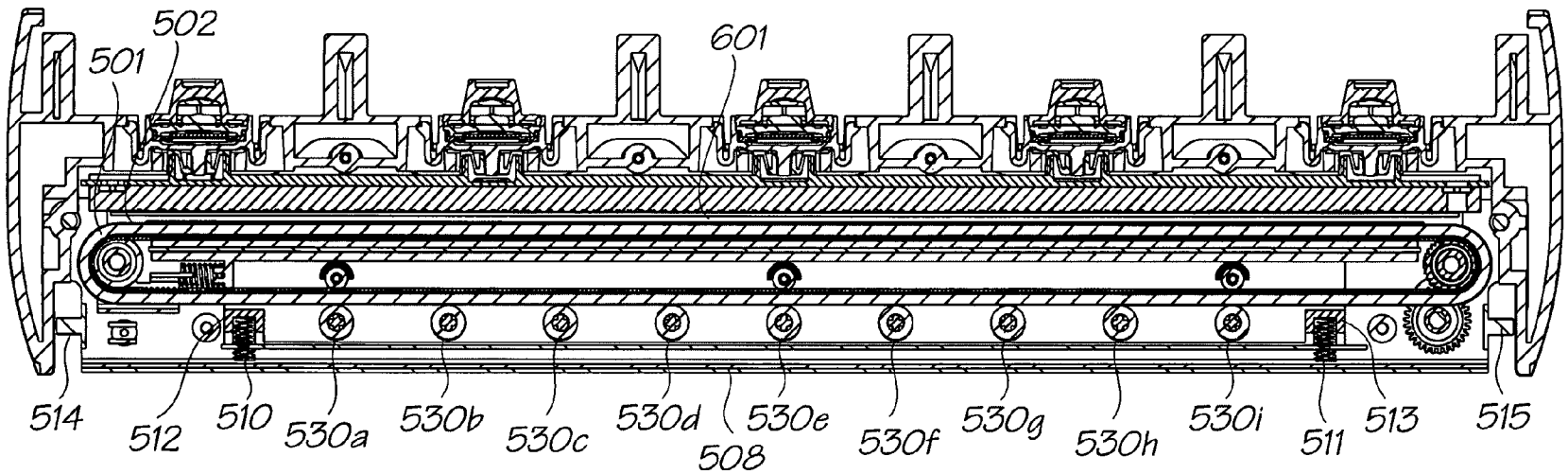
FIG. 21 is a longitudinal section of the printhead cartridge showing the belt in a second position, disengaged from the printhead.
Figure 22:
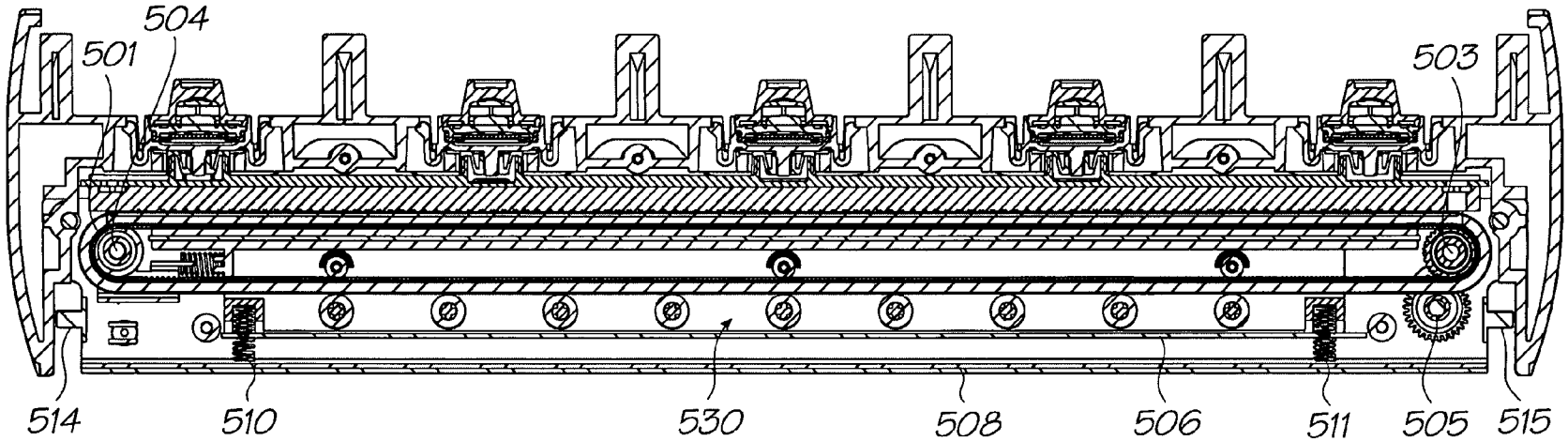
FIG. 22 is a longitudinal section of the printhead cartridge showing the belt in a first position, engaged with the printhead.

Referring to FIGS. 21 and 22, the belt 501 is reciprocally moveable between a first position (shown in FIG. 22) in which part of the contact surface 502 is sealingly engaged with the ink ejection face 601, and a second position (shown in FIG. 21) in which the contact surface is disengaged from the ink ejection face. The part of the contact surface 502 engaged with the ink ejection face 601 is substantially coextensive therewith so that nozzles across the whole length of the pagewidth printhead 600 are maintained for use.

As shown most clearly in FIG. 19, the contact surface 502 is sloped with respect to the ink ejection face 601. As explained in our earlier application U.S. Ser. No. 11/246,676, filed Oct. 11, 2005 (the contents of which is herein incorporated by reference), a sloped contact surface 502 provides progressive engagement with and peeling disengagement from the ink ejection face 601, with simple linear movement of the belt 501 perpendicularly with respect to the ink ejection face. This type of engagement with the ink ejection face 601 allows the belt 501 to clean flooded ink from the printhead 600 and remediate blocked nozzles in the printhead. Moreover, during idle periods, the contact surface 502 is sealed against the ink ejection face 601, preventing the ingress of particulates and minimizing evaporation of water from ink in the nozzles (a phenomenon generally known in the art as decap).

Figure 23A:
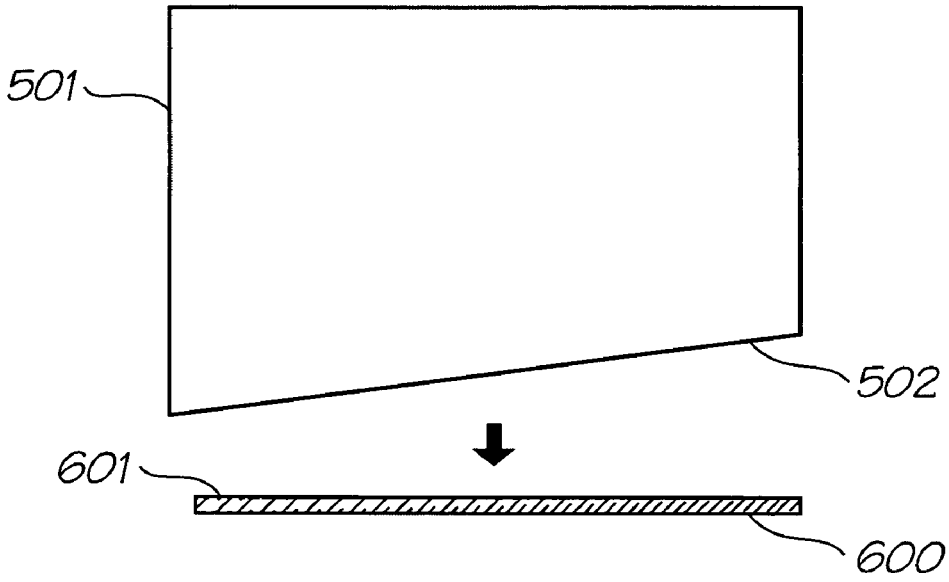
FIGS. 23A-D show, schematically, various stages of engagement of the belt with the printhead.
Figure 23B:
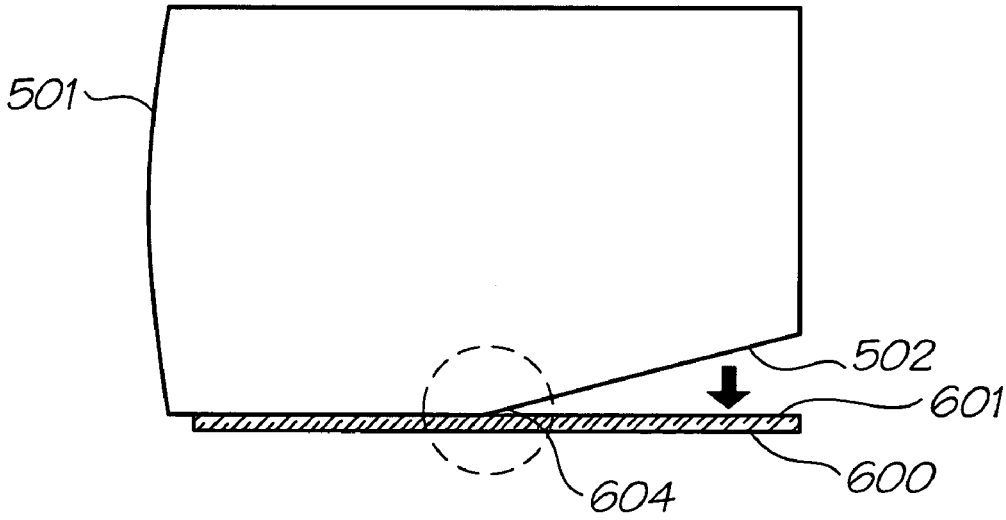
Figure 23C:
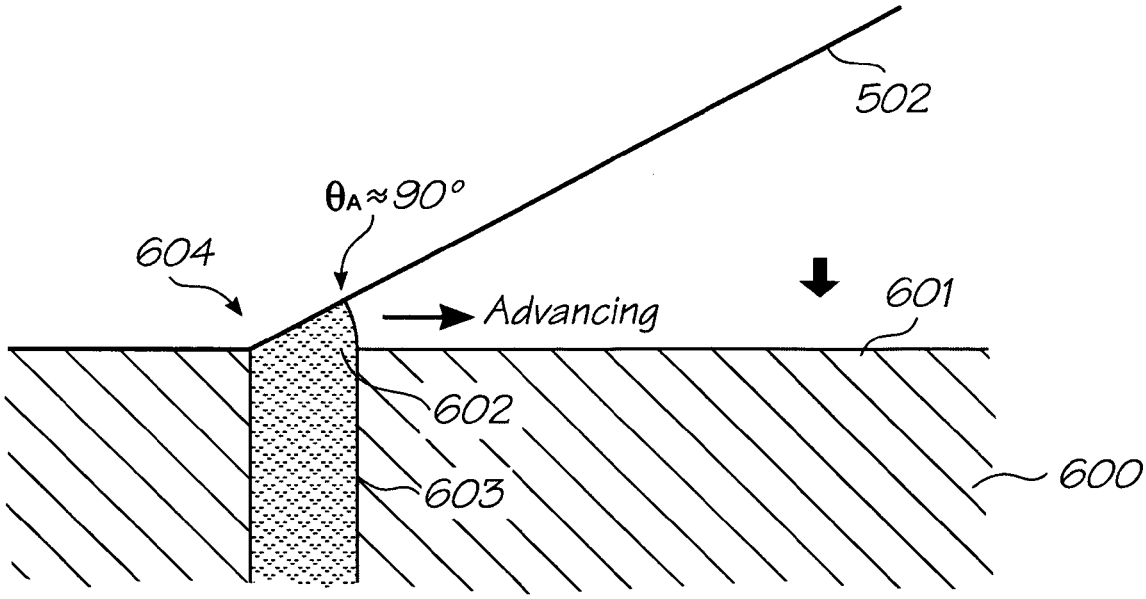
Figure 23D:
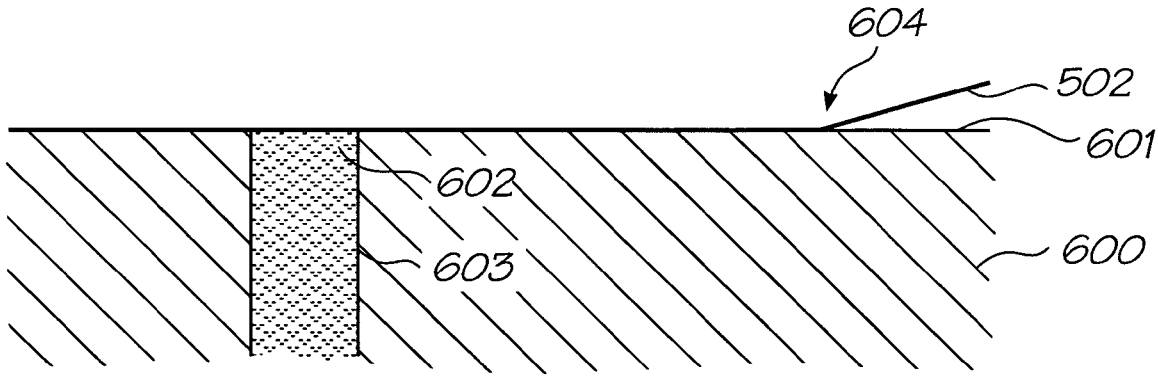

A detailed explanation of the operating principles of the cleaning/maintenance action is provided in our earlier application, U.S. Ser. No. 11/246,676, filed Oct. 11, 2005, (the contents of which is herein incorporated by reference). However, a brief explanation will be provided here for the sake of clarity. FIGS. 23A and 23B show in detail the belt 501 having a contact surface 502 being progressively brought into contact with the ink ejection face 601 of the printhead 600. FIG. 23C shows an exploded view of a peel zone 604 in FIG. 23B, when the contact surface 502 is partially in contact with the ink ejection face 601. FIG. 23C shows in detail the behaviour of ink 602 as the surface 502 is contacted with a nozzle opening 603 on the printhead. Ink 602 in the nozzle opening 603 makes contact with the contact surface 502 as it advances across the printhead 600. However, since an advancing contact angle $\theta_A$ of the ink 602 on the contact surface 502 is relatively non-wetting (about 90°), the ink has little or no tendency to wet onto the contact surface. Hence, as shown in FIG. 23D, the ink 602 remains on the ink ejection face 502 or in the nozzle 603, and the peel zone 604 advancing across the ink ejection face is relatively dry.

Figure 24A:
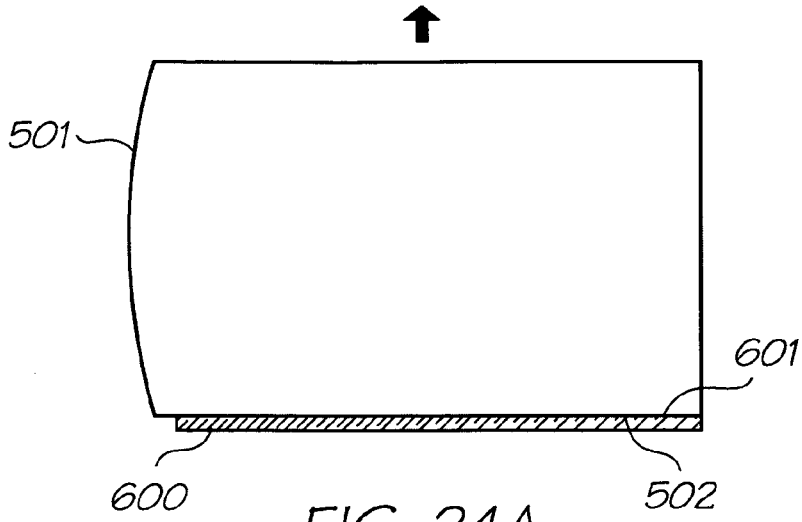
FIGS. 24A-E show, schematically, various stages of disengagement of the belt from the printhead.
Figure 24B:
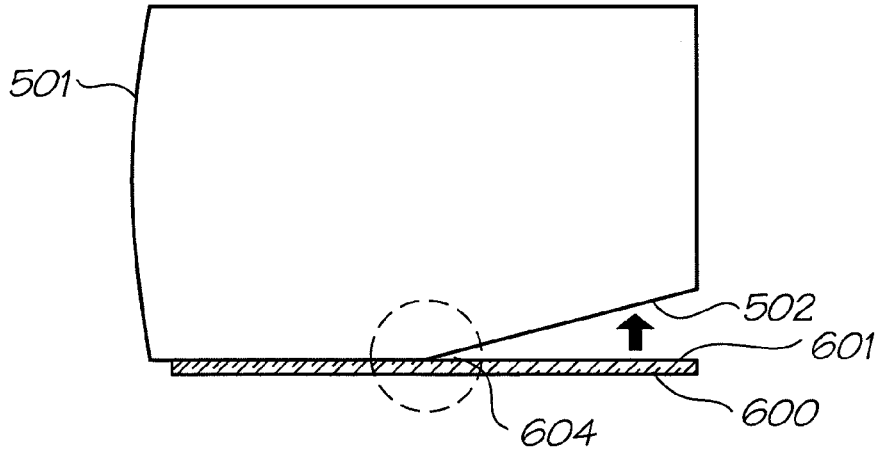
Figure 24C:
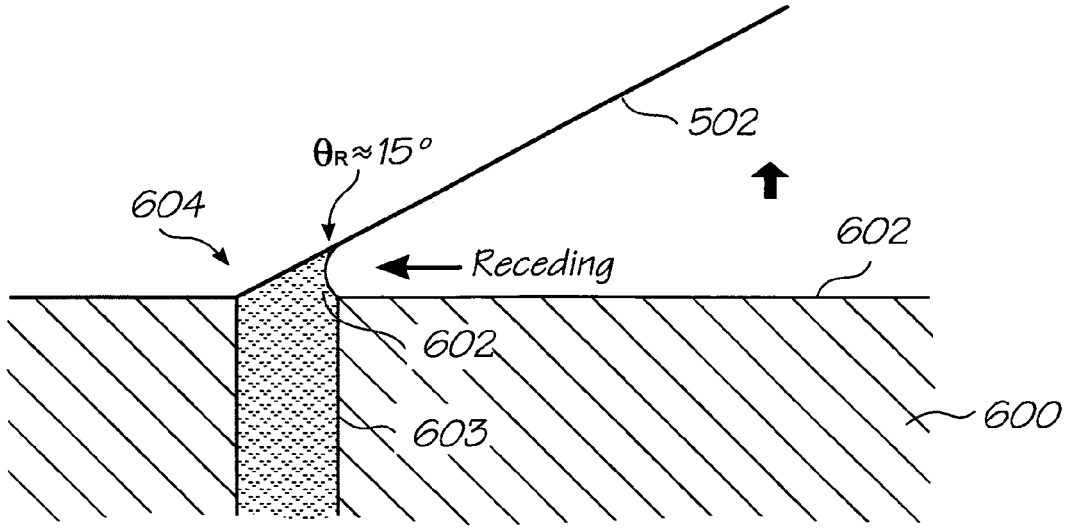
Figure 24D:
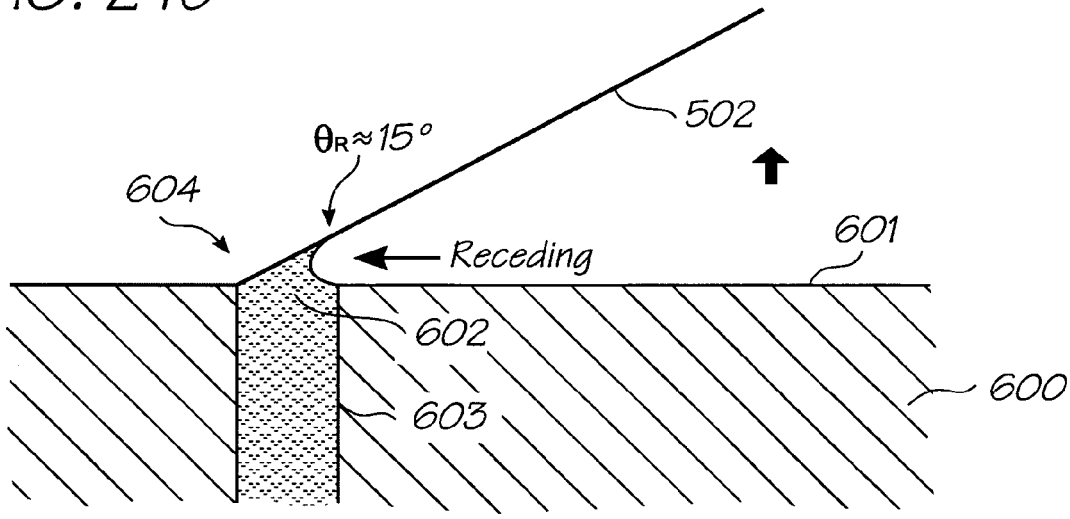
Figure 24E:
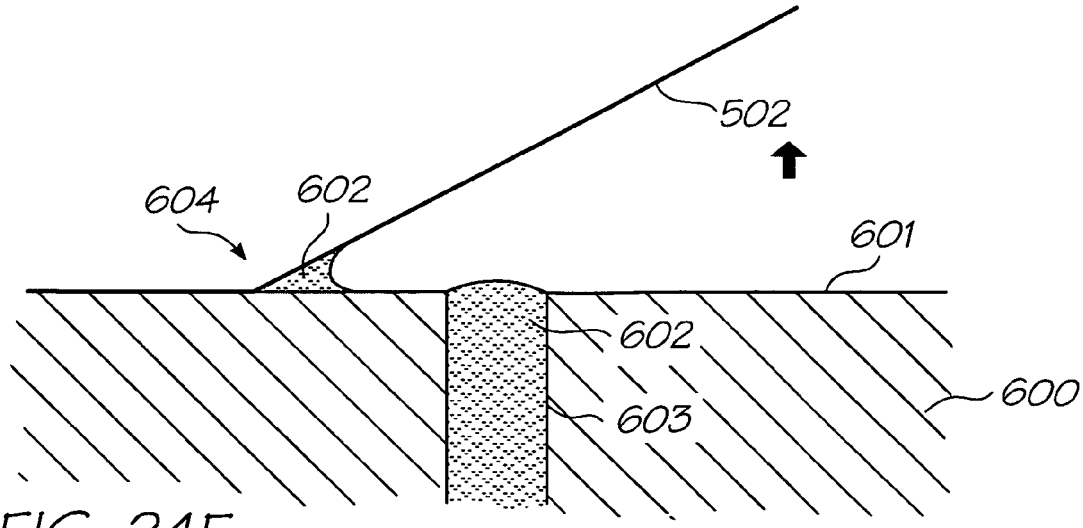

In FIGS. 24A and 24B, the reverse process is shown as the belt 501 is peeled away from the ink ejection face 601. Initially, as shown in FIG. 24A, the contact surface 502 is sealingly engaged with the ink ejection face 601. In FIG. 24B, the contact surface 502 is peeled away from the ink ejection face 601, and the peel zone 604 retreats across the face. FIG. 24C shows a magnified view of the peel zone 604 as the contact surface 502 is peeled away from the nozzle opening 603 on the printhead 600. Ink 602 in the nozzle opening 603 makes contact with the contact surface 502 a it recedes across the ink ejection face 601. However, since a receding contact angle $\theta_R$ of the ink 602 on the surface 502 is relatively wetting (about 15°), the ink in the nozzle opening 603 now tends to wet onto the contact surface 502. Hence, as shown in FIGS. 24D and 24E, the peel zone 604 retreating across the ink ejection face 601 is wet, carrying with it a droplet of ink 602 drawn from the nozzle opening 603 or from the ink ejection face 601. This has the effect of clearing blocked nozzles in the printhead 600 and cleaning ink flooded on the ink ejection face 601. Optimum cleaning performance is achieved when the contact surface 502 is substantially uniform and free from any microscopic scratches or indentations, which can potentially harbour small quantities of ink.

Figure 25:
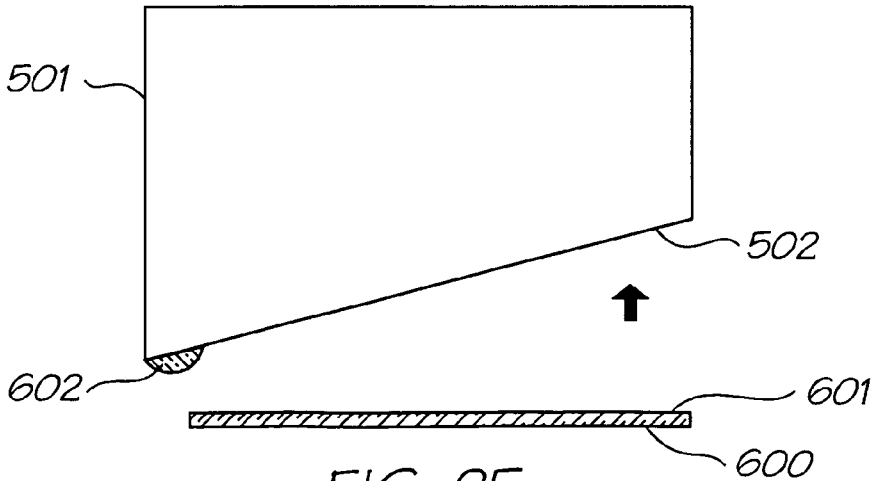
FIG. 25 shows, schematically, the belt fully disengaged from the printhead.

FIG. 25 shows the belt 501 as the last part of the contact surface 502 is peeled away from the ink ejection face 601. The contact surface 502 has collected a bead of ink 602 along a longitudinal edge portion at the final point of contact with the printhead 600.

From the foregoing, and referring again now to FIGS. 19 to 22, it will appreciated that in the printhead maintenance station 500, the contact surface 502 of the belt 501 will collect ink along a longitudinal edge portion after disengagement from the ink ejection face 601. In our earlier applications U.S. Ser. No. 11/246,704, U.S. Ser. No. 11/246,710, U.S. Ser. No. 11/246,688, U.S. Ser. No. 11/246,716, U.S. Ser. No. 11/246,715, all filed Oct. 11, 2005, we described various means for removing ink from a longitudinal edge portion of a flexible pad. The printhead maintenance station 500 of the present invention cleans the contact surface 502 by providing it on an endless belt 501 and using a conveyor mechanism to convey the belt past a cleaning station 530, after disengagement of the contact surface from the ink ejection face 601.

Accordingly, and referring to FIG. 20, the belt 501 is mounted around a pair of spools 503 and 504. One of the spools 503 has a toothed portion, which intermeshes and engages with a drive gear 505. The drive gear 505 is, in turn, driven by the drive motor 144 via the drive vane 174 (shown in FIGS. 11A-C). Hence, the spool 503 is a drive spool, while the spool 504 is an idle spool. The drive spool 503, drive gear 505 and drive motor 144 together form part of a conveyor mechanism for conveying the belt 501 in a direction substantially parallel with a longitudinal axis of the printhead 600. Hence, the conveyor mechanism can carry an inked portion of the contact surface 502 away from the printhead 600 and towards a cleaning station 530.

Referring to FIG. 21, the cleaning station 530 comprises a set of rollers 530*a-i*, which may perform various cleaning, rinsing and/or drying functions. For example, the first three rollers 530*a*, 530*b* and 530*c* may comprise a pad soaked with solvent or surfactant solution for cleaning, the next three rollers 530*d*, 530*e* and 530*f* may comprise a pad soaked with deionized water for rinsing, and the last three rollers 530*g*, 530*h* and 530*i* may comprise dry pads for drying the contact surface 502. As just described with reference to FIG. 21, the belt 501 is conveyed in a counterclockwise direction through the cleaning station 530. Furthermore, and as shown in FIG. 19, each roller in the cleaning station 530 is angled to complement the sloped contact surface 502 of the belt 501, thereby maximizing cleaning contact and cleaning efficiency.

The drive gear 505, drive spool 503, idle spool 504 and cleaning station 530 are all mounted on a moveable chassis 506. The chassis 506 is moveable perpendicularly with respect to the ink ejection face 601, such that the contact surface 502 can be engaged and disengaged from the ink ejection face with the peeling action described above. During engagement or disengagement, the belt 501 is stationary with respect to the chassis 506. However, after disengagement from the ink ejection face 601, an inked part of the contact surface 502 may be conveyed past the cleaning station 530 using the conveyor mechanism.

The chassis 506 is biased towards the first position, wherein the contact surface 502 is sealingly engaged with the ink ejection face 601. This is the normal configuration of the maintenance station 500 when the printhead is not being used to print (e.g. during transport, storage, idle periods or when the printer is switched off).

The chassis 506, together with all its associated components, is contained in a housing 507 having a base 508 and sidewalls 509. The chassis 506 is slidably moveable relative to the housing 507 and biased towards the engaged position by means of a pair of springs 510 and 511. The springs 510 and 511 are fixed to the base 508 and urge against corresponding biasing abutment surfaces 512 and 513 respectively, which are integrally formed with the chassis 506.

The chassis 506 further comprises engagement formations in the form of lugs 514 and 515, positioned at respective ends of the chassis. These lugs 514 and 515 are provided to slidably move the chassis 506 relative to the printhead 600 by means of the engagement mechanism 520 shown in FIG. 26.

Figure 26:
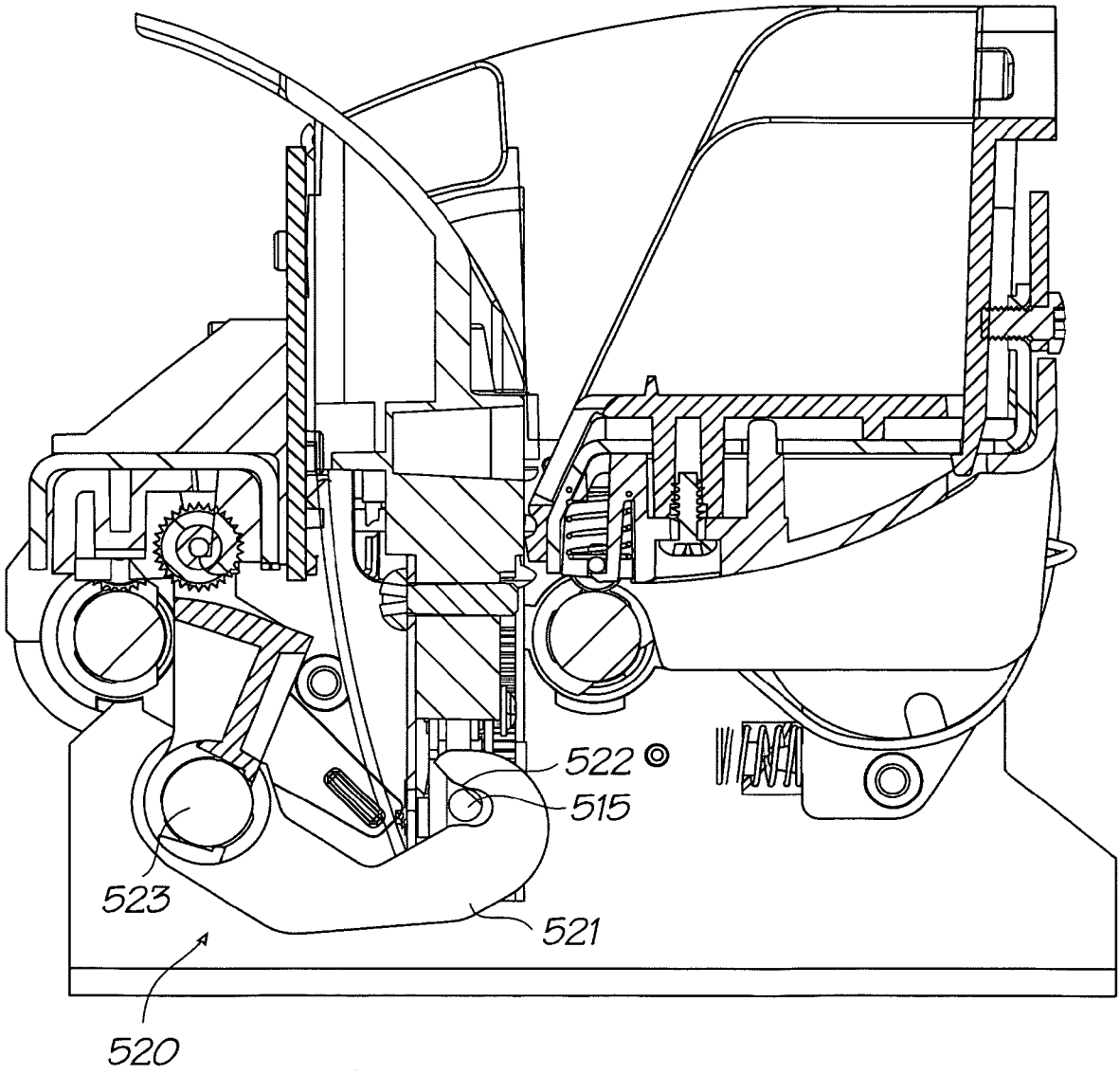
FIG. 26 shows engagement of the engagement arm with the printhead maintenance station in transverse section.

The engagement mechanism 520 comprises a pair of engagement arms. In FIG. 26, there is shown one of the engagement arms 521 engaged with its corresponding lug 515. A first end of the engagement arm 521 has a cam surface 522, which abuts against the lug 515. A second end of the engagement arm is rotatably mounted about a pivot 523 and is rotated by an engagement motor (not shown). Accordingly, it can be seen from FIG. 26 that as the engagement arm 521 is rotated clockwise, abutment of the cam surface 522 against the lug 515 causes the lug, and therefore the chassis 506, to move downwards and away from the printhead 600.

A typical maintenance operation will now be described with reference to FIGS. 19 to 22 and FIG. 26. In a printing configuration, the printhead maintenance station 500 is configured as shown in FIG. 21 with the contact surface 502 disengaged from the printhead 600, thereby leaving a gap for paper (not shown) to be fed transversely past the printhead. After printing is completed, or when printhead maintenance is required, the engagement arms (e.g. 521) are rotated anticlockwise, allowing the springs 510 and 511 to urge against corresponding biasing abutment surfaces 512 and 513 on the chassis 506, thereby sliding the chassis upwards towards the printhead 600. This sliding movement of the chassis 506 brings the uppermost part of the contact surface 502, which is substantially coextensive with the printhead 600, into sealing engagement with its ink ejection face 601. Due to the sloped nature of the contact surface 502 with respect to the ink ejection face 601, the contact surface progressively contacts the ink ejection face during engagement.

After a predetermined period of time, the engagement arms (e.g. 521) are actuated to rotate clockwise, thereby sliding the chassis 506 downwards and away from the printhead 600 by abutment of, for example, the cam surface 522 against the lug 515. This sliding movement of the chassis 506 disengages the contact surface 502 from the ink ejection face 601. Due to the sloped nature of the contact surface 502, the contact surface is peeled away from the ink ejection face 601 during disengagement. As described earlier, this peeling action deposits ink along a longitudinal edge portion of the contact surface 502 and generates an inked part of the contact surface.

After disengagement, the drive motor 144 is actuated, which drives the drive spool 503 in an anticlockwise direction via the drive gear 505. Accordingly, the belt 501 is driven anticlockwise, thereby conveying the inked part of the contact surface 502 past the cleaning station 530, comprising cleaning rollers 530*a-i*. As the inked part of the contact surface 502 is conveyed past the cleaning station 530, it is successively cleaned, rinsed and dried, resulting in a cleaned part of the contact surface 502.

The drive motor 144 is driven until a cleaned part of the contact surface 502 is positioned adjacent the printhead 600, ready for the next maintenance cycle. Depending upon the condition of the printhead 600, several maintenance cycles as described above may optionally be required before the printhead is sufficiently remediated for printing.

Ink Cartridge

Figure 27:
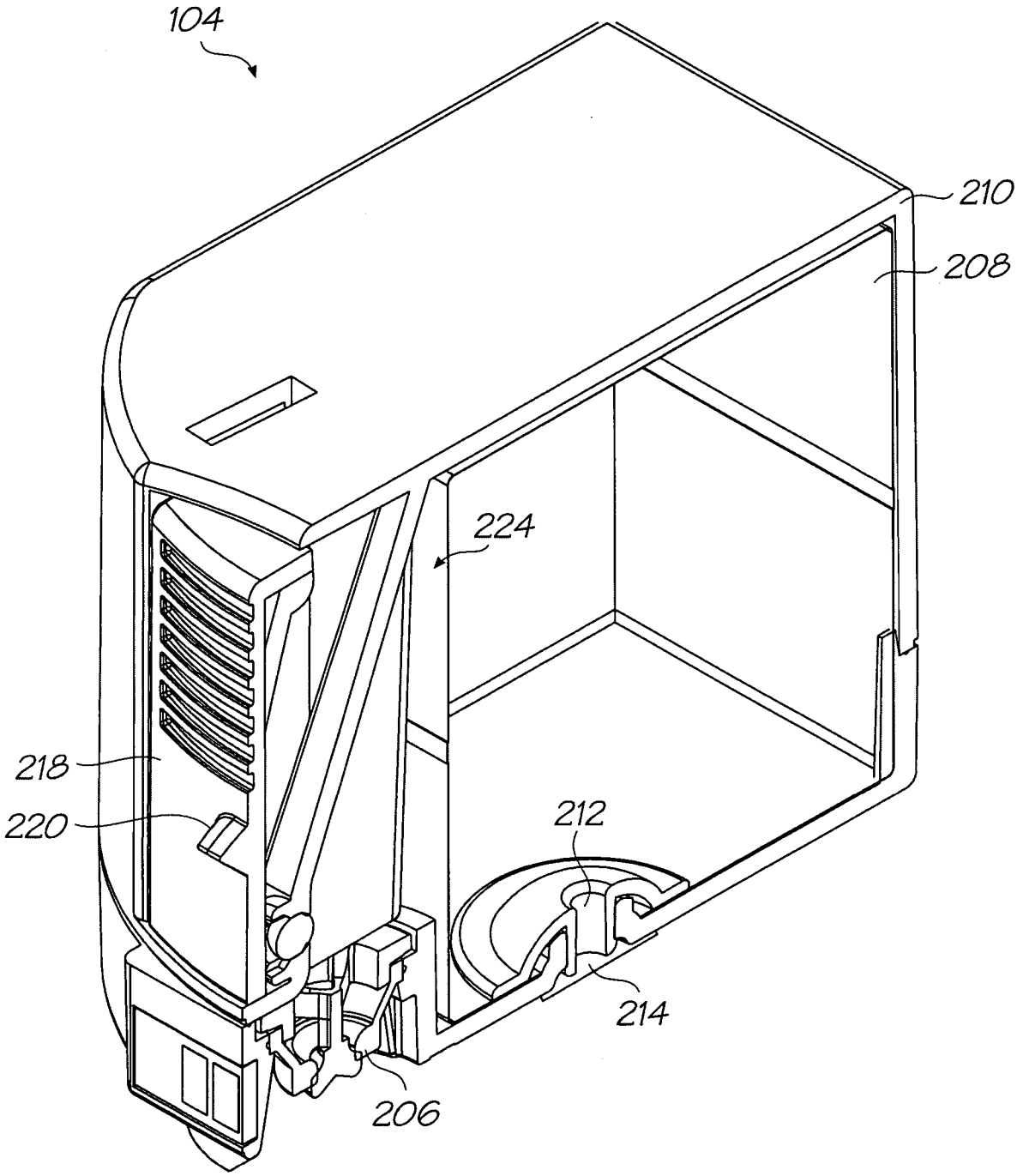
FIG. 27 is a cutaway perspective of an ink cartridge.

FIG. 27 is a sectioned perspective of the ink cartridge 104. Each of the five ink cartridges has an air tight outer casing 210, an outlet valve 206 and an air-inlet 212 covered by a frangible seal 214. The air seal helps to avoid ink leakage if the user tampers with the outlet valve 206 prior to installation. A thumb grip 218 is colored to indicate the stored ink. For IR ink, the thumb grip may be otherwise marked. The thumb grip can inwardly flex and it has a snap lock spur 220 to hold the cartridge within the docking bay 106.

Figure 15:
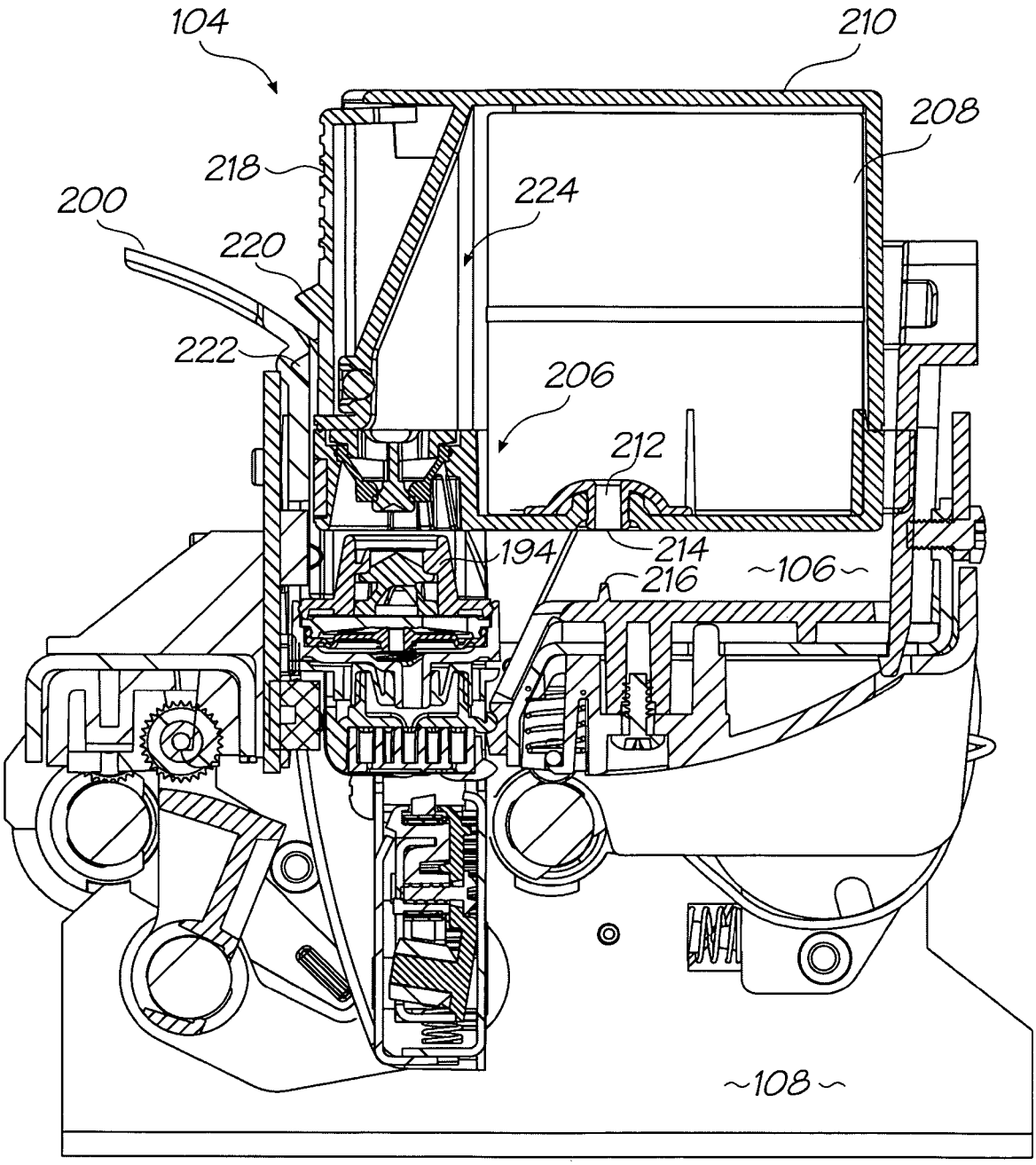
FIG. 15 is a lateral cross section of the printhead cartridge and printer cradle with the ink cartridge immediately prior to its installation.

FIGS. 15, 16, 17, 18 and 27 show the ink cartridge 104 and its interaction with the printhead cartridge 100 and printer cradle 102. FIG. 15 shows the ink cartridge in the docking bay 106 but not yet engaged with the inlet valve 194 of the printhead cartridge 100. For clarity, the air bag 208 is shown fully inflated and the remaining volume of ink storage is indicated by 224. Of course, in reality the air bag would be fully collapsed prior to installation and fully inflated upon removal. Inflating an air bag within the ink storage volume rather than collapsing provides a more efficient use of ink. Collapsible ink bags have a certain amount of resistance to collapsing further, once they have drained below a certain level. The ejection actuators of the printhead must draw against this resistance which can impact on the operation of the printhead. This can be addressed by deeming the cartridge to be empty before it has collapsed completely. This leaves a significant amount of residual ink in the cartridge when it is discarded. To avoid this, the present ink cartridges use an air bag that inflates into the ink volume as the ink is consumed. The air bag expands into the areas evacuated by the ink relatively easily and completely so that there is much less residual ink in the cartridge when it is discarded. Also, by inflating an air bag in the ink storage volume instead of collapsing an ink bag, the hydrostatic pressure of the ink at the cartridge outlet can be kept constant. This helps to keep the drop ejection characteristics of the printhead more uniform.

Figure 16:
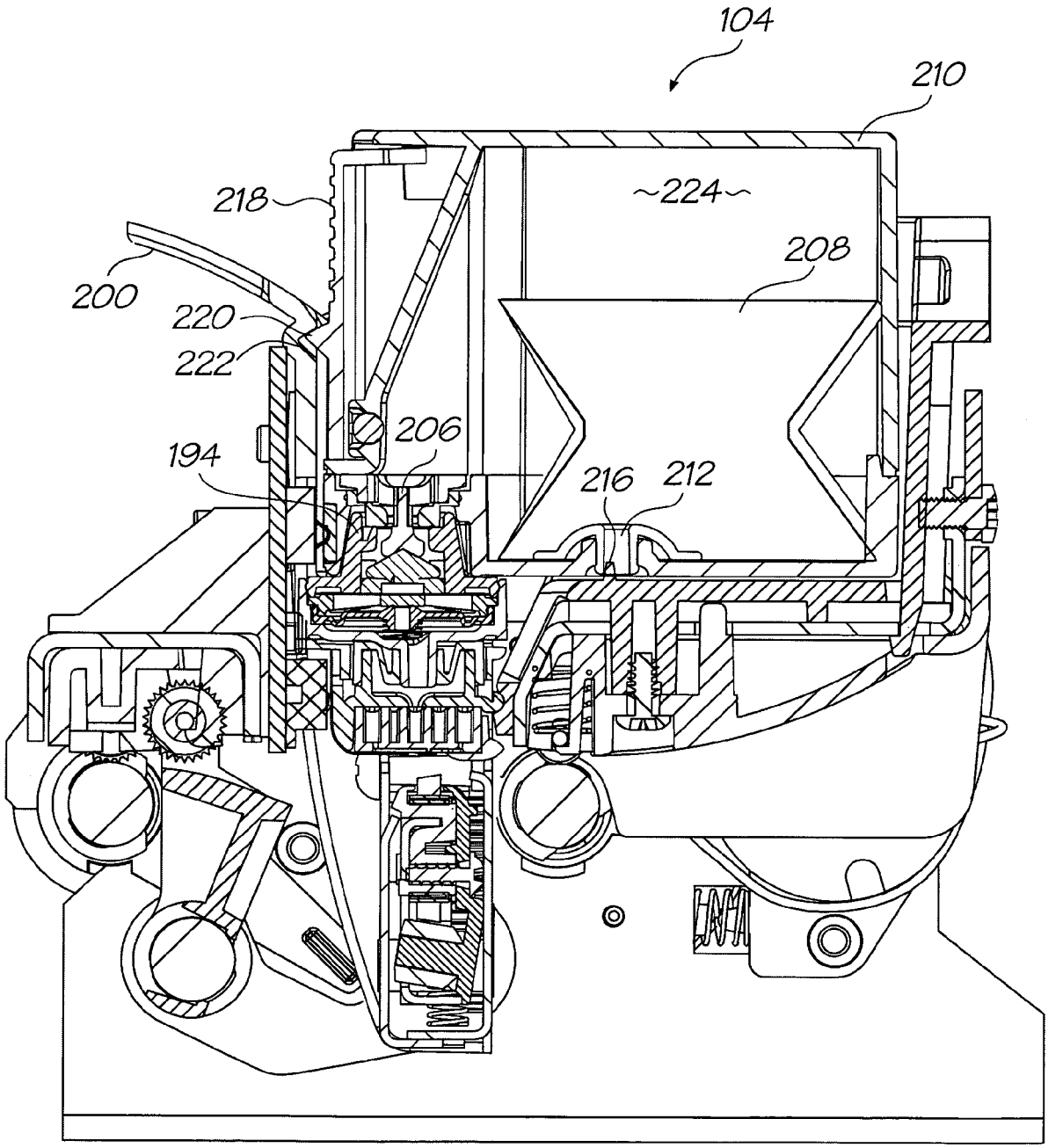
FIG. 16 is a lateral cross section of the printhead cartridge and printer cradle with the ink cartridge installed.

FIG. 16 shows the ink cartridge 104 fully engaged with the printer cradle 102 and the printhead cartridge 100. The spigot 216 in the floor of the docking bay 106 ruptures the frangible air seal 214 to allow air though the inlet 212 to inflate the air bag 208. FIG. 16 shows the air bag 208 partially inflated to illustrate its concertina fold structure. The outlet valve 206 in the ink cartridge 104 engages with the inlet valve 194 in the printhead cartridge 100. As the ink cartridge engages both the printer cradle and the printhead cartridge, the printhead cartridge is locked in its operative position.

Mutually Engaging and Actuating Outlet and Inlet Valves

Figure 17:
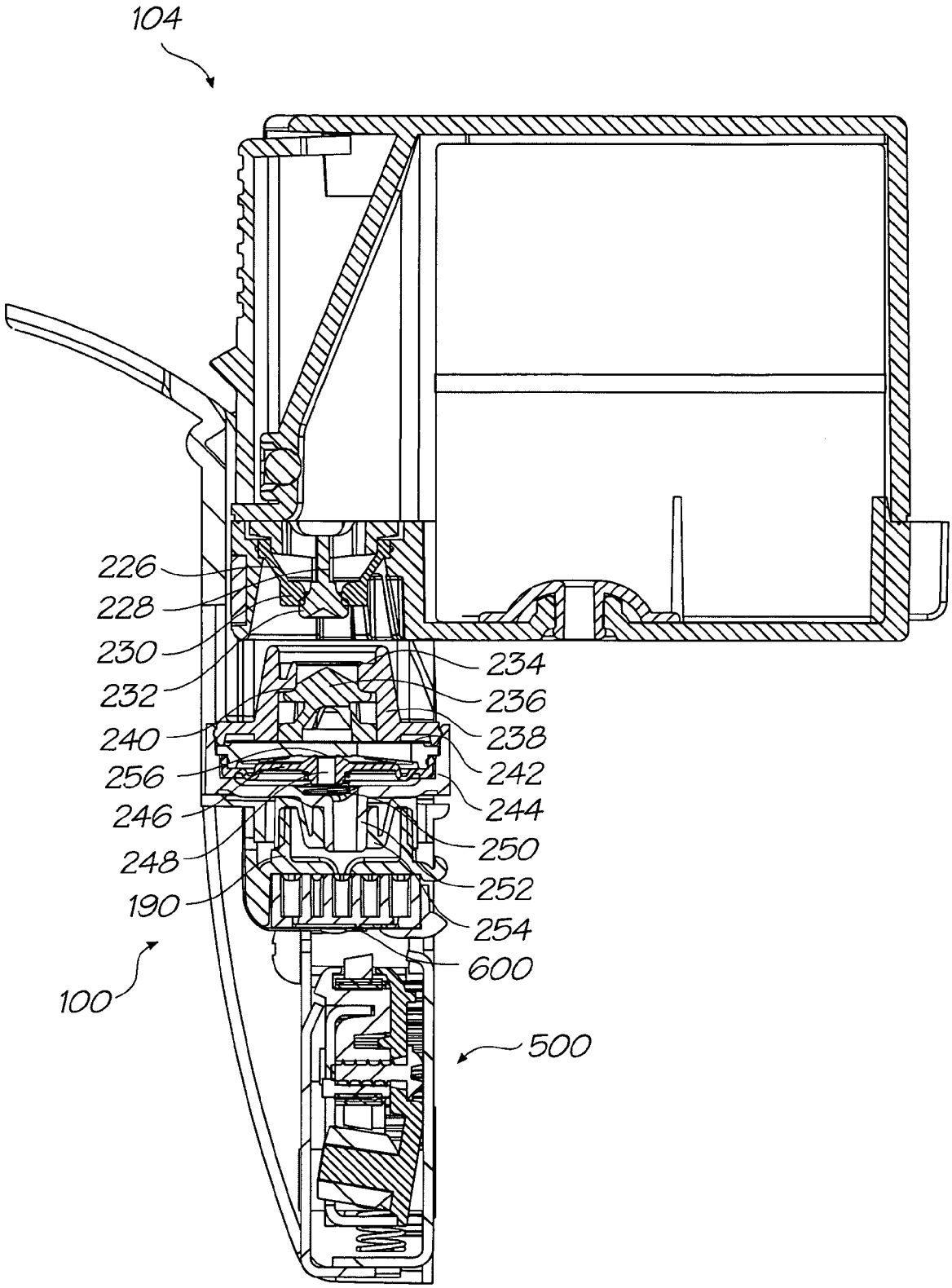
FIG. 17 is an enlarged lateral cross section of the ink cartridge immediately prior to engagement with the printhead cartridge.
Figure 18:
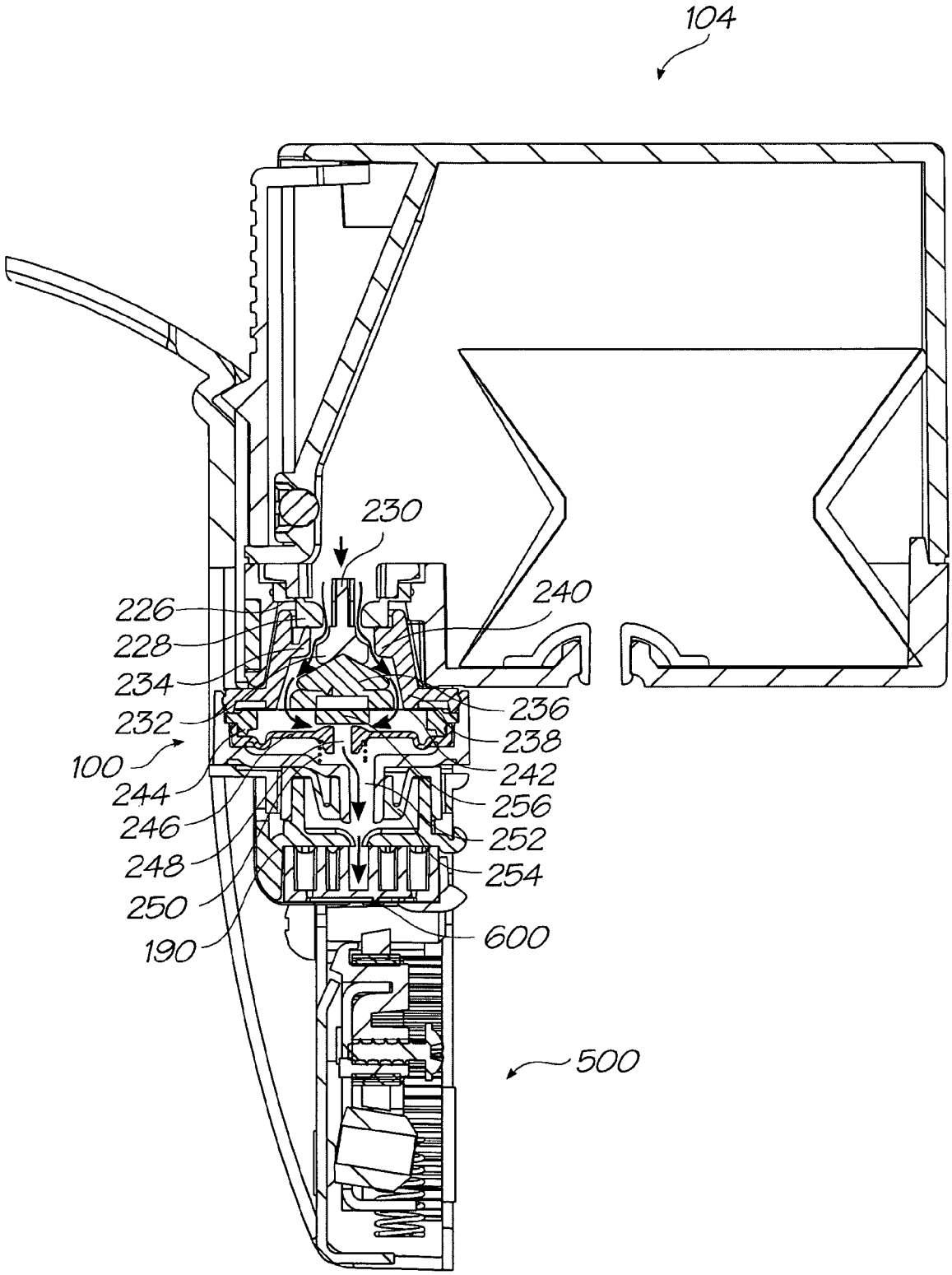
FIG. 18 is an enlarged lateral cross section of the ink cartridge engaged with the printhead cartridge.
Figure 29:
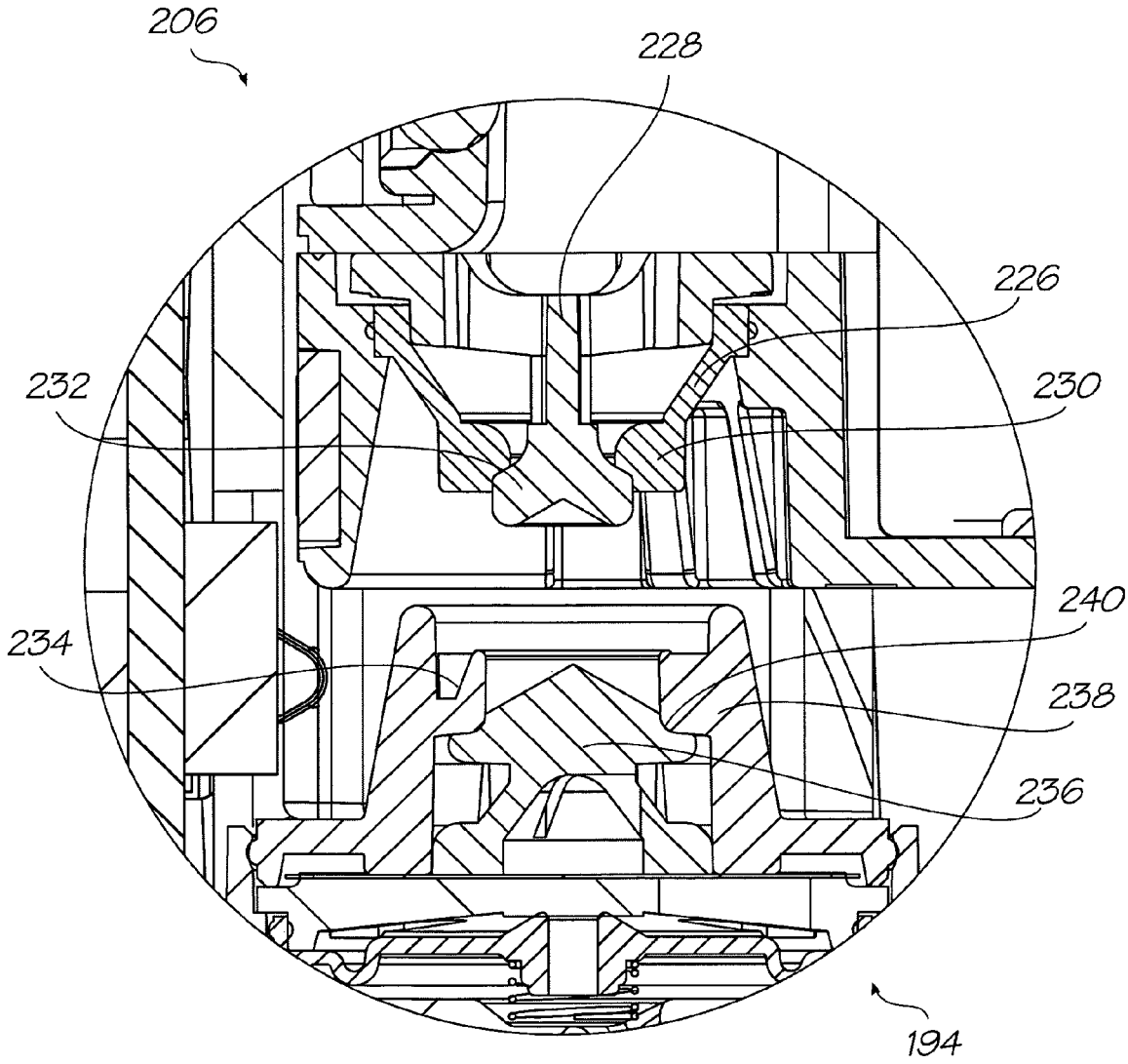
FIG. 29 is a section of the outlet valve of the ink cartridge immediately prior to engagement with the inlet valve of the printhead cartridge.

FIGS. 17 and 18 show the ink cartridge 104 and the printhead cartridge 100 in isolation to more clearly illustrate the inter-engagement of the valves. To further assist the reader, FIG. 29 shows only the ink cartridge outlet valve 206 and the printhead cartridge inlet valve 194 prior to engagement. The outlet valve of the ink cartridge has a central stem 230 with a flanged end 232. A skirt 226 of resilient material has an annular seal 228 biased against the upper surface of the flanged end 232 so that the outlet valve is normally closed.

The inlet valve of the printhead cartridge has frusto-conical inlet opening 238 with a valve seat 240 that extends radially inwardly. A depressible valve member 236 is biased into sealing engagement with the valve seat 240 so that the printhead inlet is also normally closed.

As best shown in FIG. 18, when the inlet and outlet valves interengage, a skirt engaging portion 234 on the frusto-conical inlet opening 238 seals against the annular seal portion 228 of the resilient skirt 226. As soon as the seal between the skirt engaging portion 234 and the annular seal portion 228 forms, the underside of the flanged end 232 of the stem 230 engages the top of the depressible member 236. As the ink cartridge is pushed into further engagement, the resilient skirt 226 is unseated from the upper surface of the flanged end 232 of the stem to open the outlet valve. At the same time, the stem 230 pushes the depressible member 236 down to unseat it from the valve seat 240 thereby opening the inlet valve to the printhead cartridge 100. Simultaneous opening of both valves, after an external seal has formed between them, reduces the chance of excessive air being entrained into the ink flow to the printhead nozzles. Furthermore, the underside of the flanged end 232, the top of the depressible member 236 and the skirt engaging portion are configured and dimension so that substantially all air is displaced from between the valves before the seal between them forms. Ordinary workers will understand that compressible air bubbles that reach the ink chambers in the printhead can prevent a nozzle from ejecting ink by absorbing the pressure pulse from the ink ejection actuator. Needle valve are commonly used to avoid entraining air, however they necessarily lack the capacity for the high ink flow rates demanded by a pagewidth printhead. The Applicant's mutually actuating design does not have the throttling flow constriction of a needle valve.

Ink Filter and Pressure Regulator

Figure 30A:
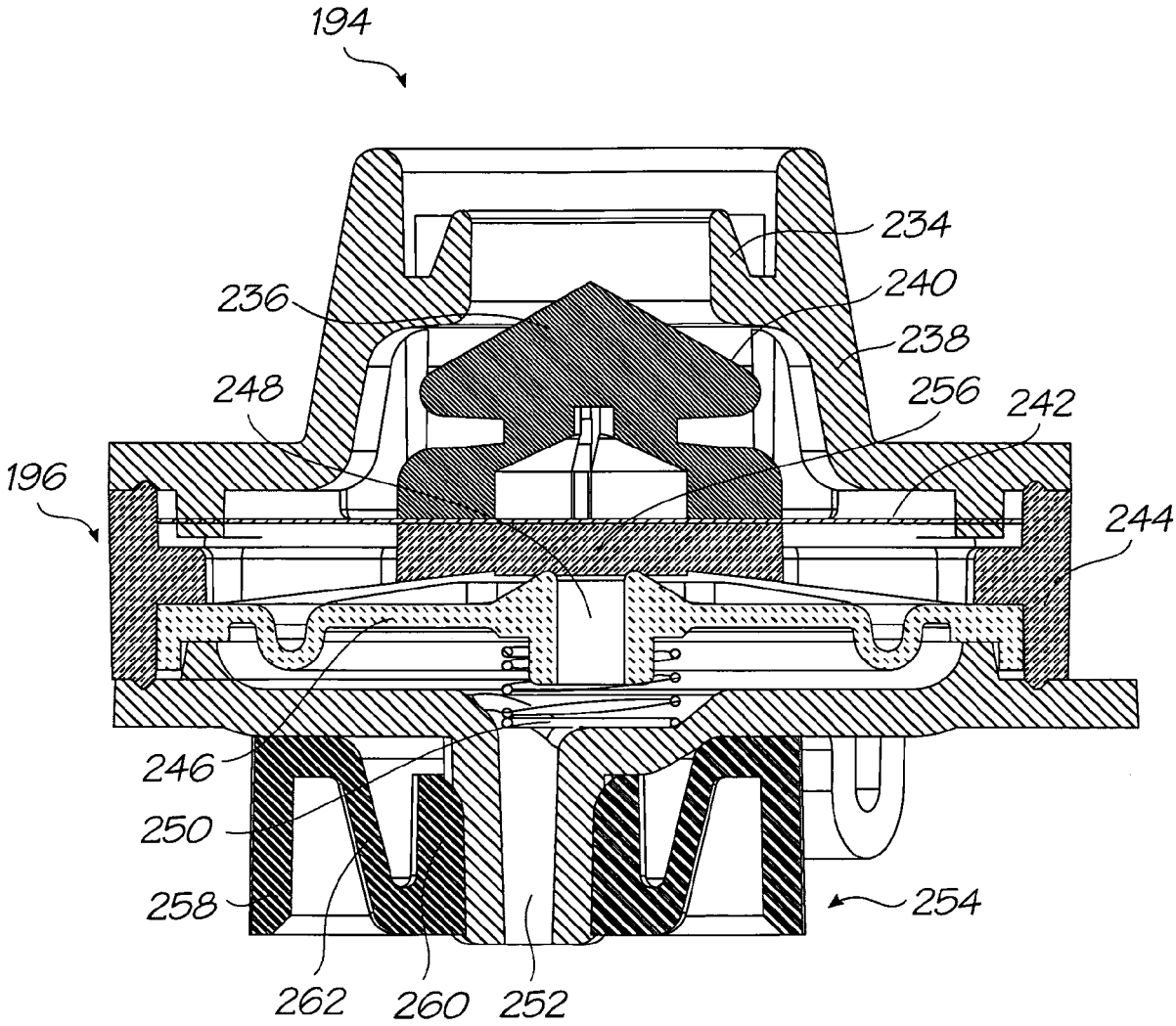
FIG. 30*a* is an enlarged section of the inlet valve and pressure regulator in isolation.
Figure 30B:
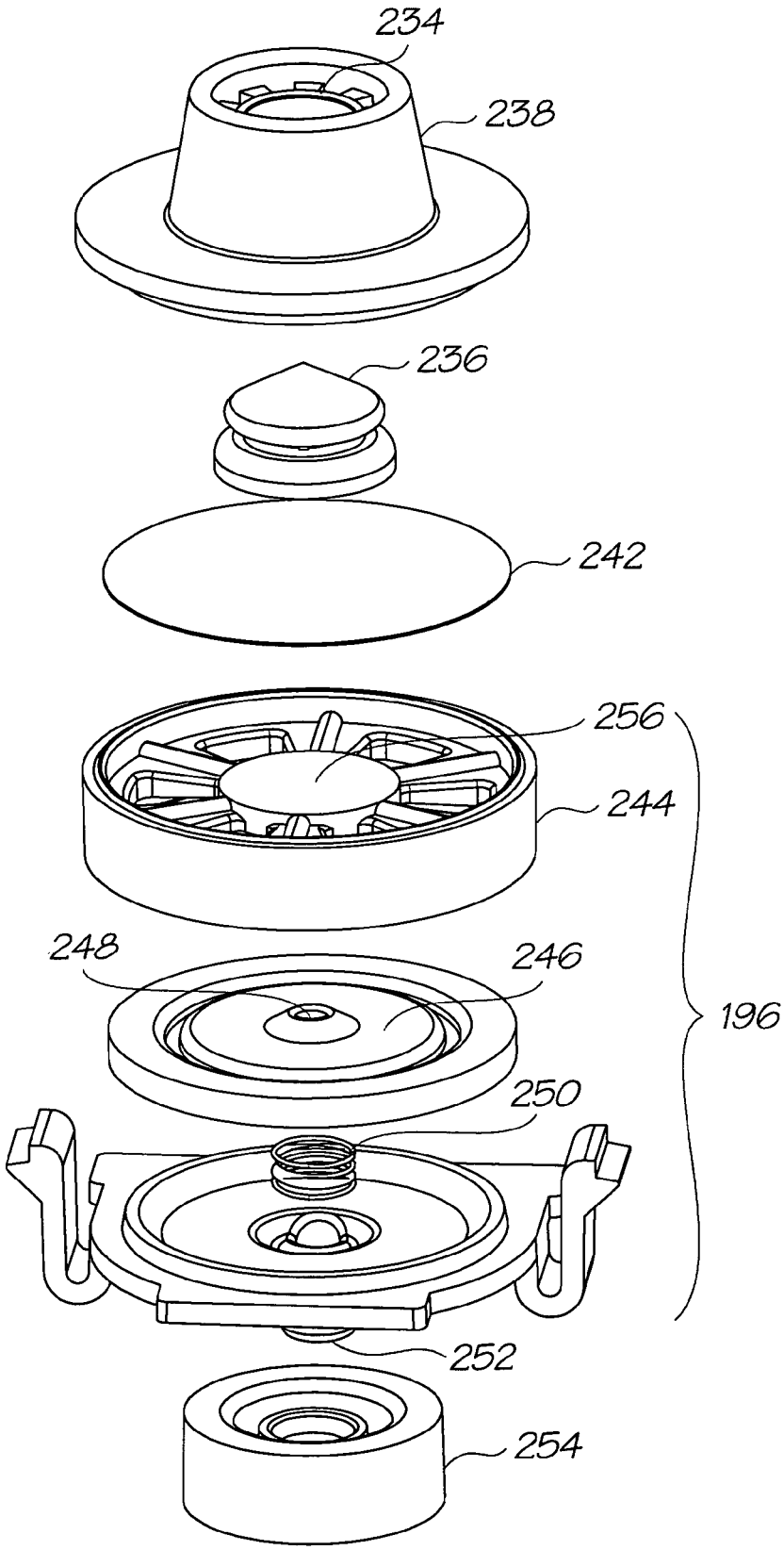
FIG. 30*b* is an exploded perspective of the inlet valve and pressure regulator in isolation.
Figure 31A:
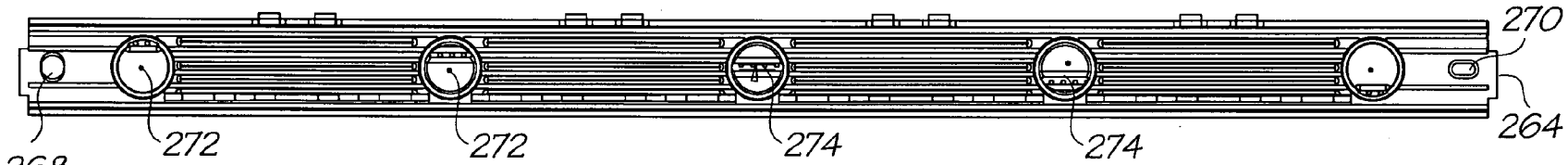
FIG. 31*a* is a plan view of the LCP molding assembly.
Figure 31B:
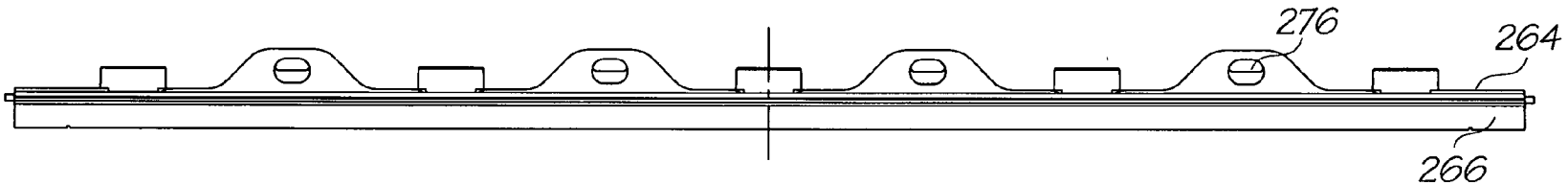
FIG. 31*b* is a front elevation of the LCP molding assembly.
Figure 31C:
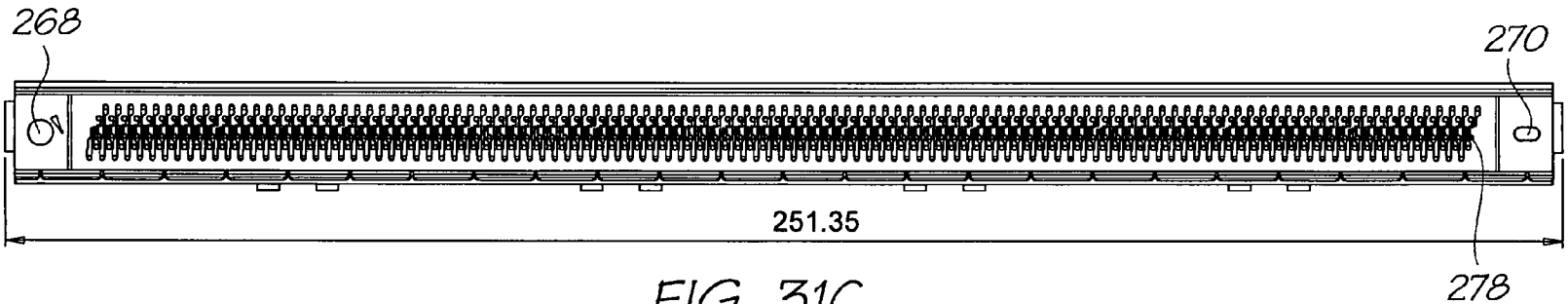
FIG. 31*c* is a bottom view of the LCP molding assembly.
Figure 31D:
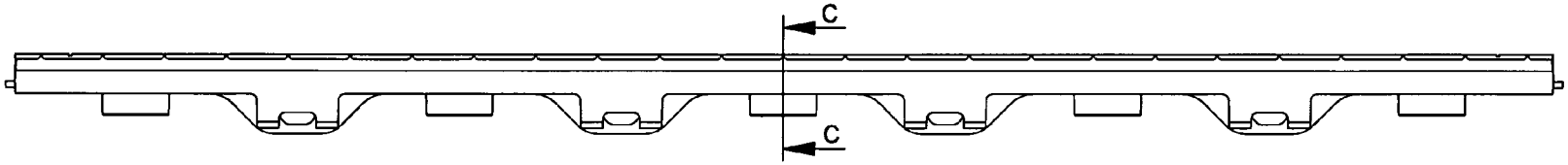
FIG. 31*d* is a rear view of the LCP molding assembly.
Figure 31E:
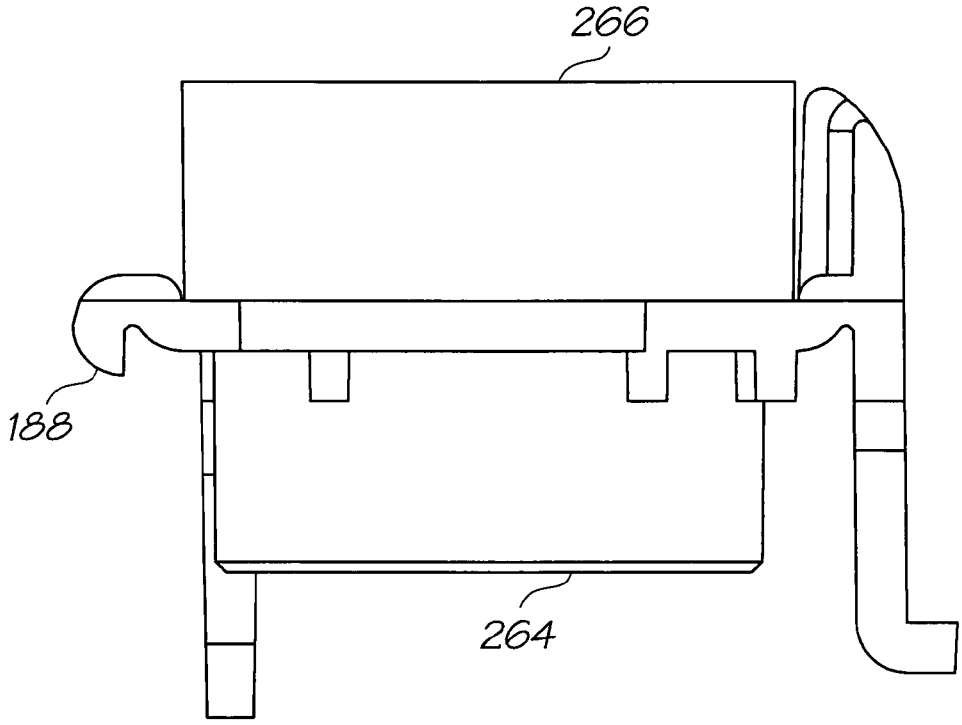
FIG. 31*e* is an end view of the LCP molding assembly.
Figure 32:
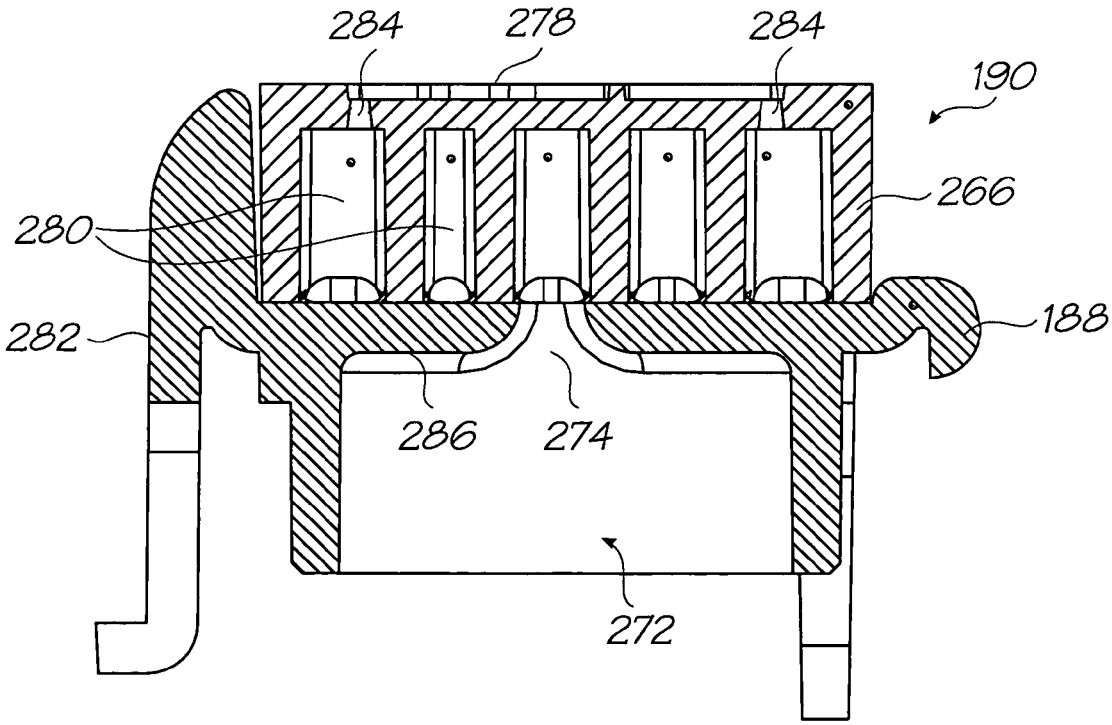
FIG. 32 is cross section C-C of the LCP molding assembly.

As best shown in FIGS. 30*a* and 30*b*, the printhead cartridge has a pressure regulator 196 downstream of its inlet valve 194. Briefly referring back to FIG. 18, ink from the ink cartridge flows smoothly around the flanged end of the stem and the depressible member to an ink filter 242. The ink filter 242 extends beyond the radial extent of the depressible member 236 so that the ink flow contacts a relatively large surface area of the filter. This allows the filter to have a pore size small enough to remove any air bubbles but not overly retard the ink flow rate.

The pressure regulator 196 has a diaphragm 246 with a central inlet opening 248 that is biased closed by the spring 250. The hydrostatic pressure of the ink in the cartridge acts on the upper or upstream side of the diaphragm. As discussed above, the head of ink-remains constant during the life of the ink cartridge because it has an inflatable air bag rather than a collapsible ink bag.

On the lower or downstream surface acts the static ink pressure at the regulator outlet 252 and the regulator spring 250. As long as the downstream pressure and the spring bias exceeds the upstream pressure, the regulator inlet 248 remains sealed against the central hub 256 of the spacer 244.

During operation, the printhead (described below) acts as a pump. The ejection actuators forcing ink through the nozzle array lowers the hydrostatic pressure of the ink on the downstream side of the diaphragm 246. As soon as the downstream pressure and the spring bias is less than the upstream pressure, the inlet 248 unseats from the central hub 256 and ink flows to the regulator outlet 252. The inflow through the inlet 248 immediately starts to equalize the fluid pressure on both sides of the diaphragm 246 and the force of the spring 250 again becomes enough to re-seal the inlet 248 against the central hub 256. As the printhead continues to operate, the inlet 248 of the pressure regulator successively opens and shuts as the pressure difference across the diaphragm oscillates by minute amounts about the threshold pressure difference required to balance the force of the spring 250. Accordingly, the pressure regulator 196 maintains a relatively constant negative hydrostatic pressure in the ink. This is used to keep the ink meniscus at each nozzle drawn inwards rather than bulging outwards. A bulging meniscus is prone contact with paper dust or other contaminants which can break the surface tension and wick ink out of the printhead. This leads to leakage and possibly artifacts in any prints.

Resilient Connectors

Figure 28:
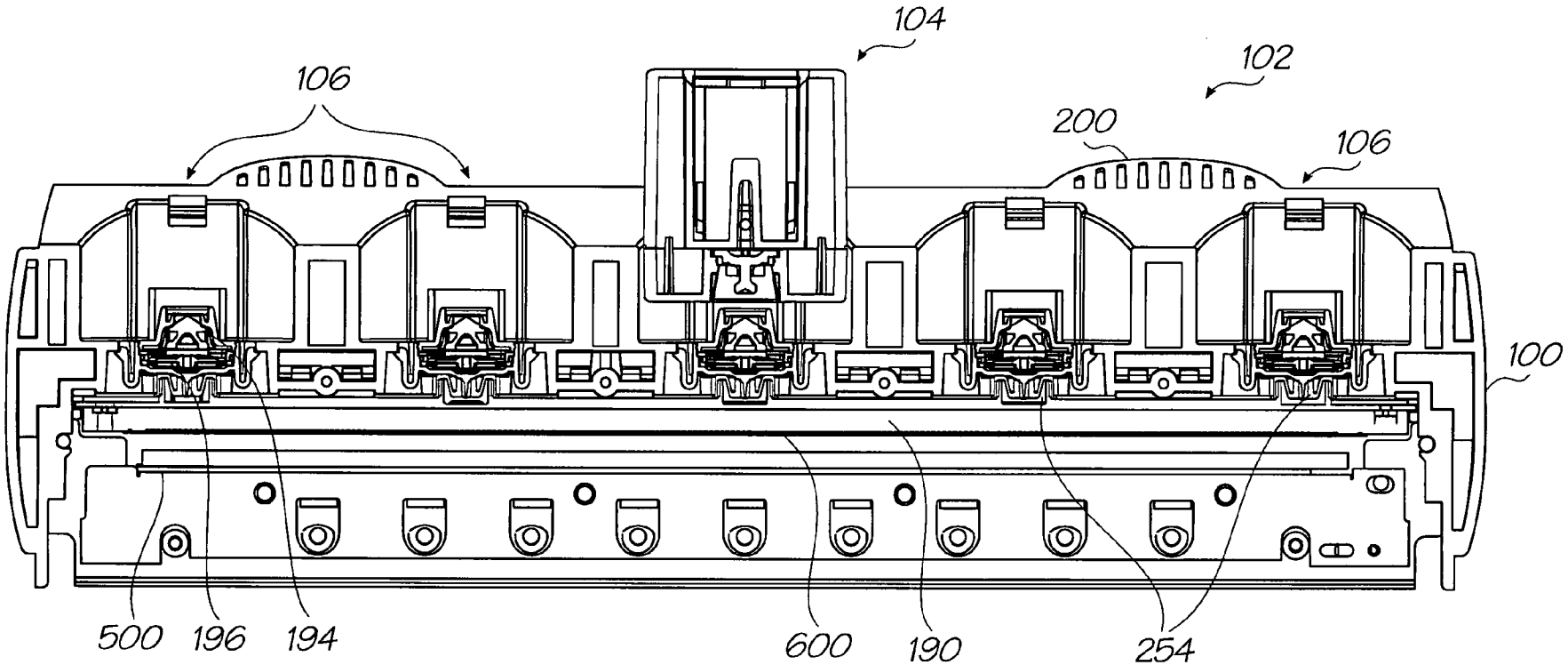
FIG. 28 is a longitudinal partial section through the printhead cartridge immediately prior to engagement with an ink cartridge.

The pressure regulators 196 are fluidly connected to the printhead 600 via respective resilient connectors 254. FIG. 28 shows a longitudinal section through the printhead cartridge 100 with an ink cartridge 104 partially inserted into one of the five docking bays 106. Each of the inlet valves 194 and pressure regulators 196 have a resilient connector 254 establishing sealed fluid communication with the LCP molding assembly 190. The printhead 600 (described in greater detail below) is a MEMS device fabricated on a silicon wafer substrate and mounted to the LCP molding assembly 190. LCP (liquid crystal polymer) and silicon have similar coefficients of thermal expansion (the CTE of the LCP is taken in the direction of the molding flow). However, the CTE's of other components within the printhead cartridge 100 are significantly different to that of silicon or LCP. To avoid structural stresses and deflections from CTE differentials, the LCP molding assembly 190 can be mounted within the printhead cartridge to have some play in the longitudinal direction while the resilient connectors 254 accommodate the different thermal expansions and maintain a sealed fluid flow path to the printhead 600.

As best shown in FIG. 30*a*, the resilient connector 254 has an outer connector collar 258 that has an interference fit with inlet openings (not shown) of the LCP molding assembly 190. Likewise, an inner connector collar 260 receives the outlet 252 of the pressure regulator 196 in an interference fit. A diagonally extending web 262 connects the inner and outer connector collars and permits a degree of relative movement between the two collars.

LCP Molding Assembly and Printhead

FIGS. 31 to 40 show the LCP molding assembly 190 and the printhead 600. Referring firstly to FIGS. 31*a* to 31*e*, the various elevations of the LCP molding assembly 190 are shown. The assembly comprises a lid molding 264 and a channel molding 266. It mounts to the printhead cartridge casing 184 via screw holes 268 and 270. The lid molding also has side mounting holes 276. As discussed above, the screw holes 270 and 276 allow a certain amount of longitudinal play between the assembly 190 and the rest of the cartridge 100 to tolerate some relative movement from CTE mismatch. Ink from the pressure regulators is fed to the lid inlets 272 via the resilient connectors 254. At the base of each lid inlet 272 is a channel inlet 274 in fluid communication with respective channels 280 in the channel molding 266 (best shown in the section C-C shown in FIG. 32).

Figures 33A, 33B:
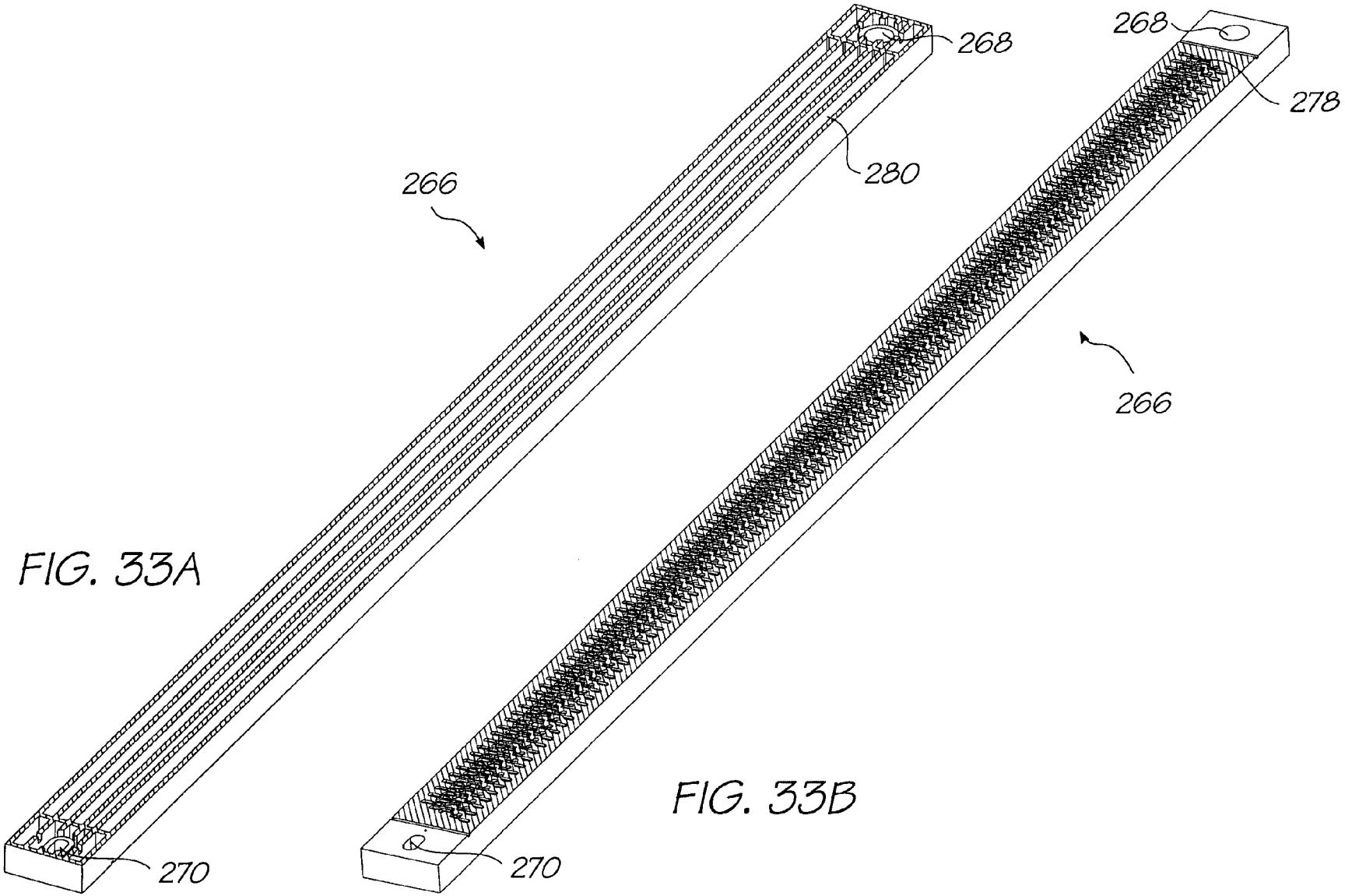
FIGS. 33*a* and 33*b* are top and bottom perspective views of the LCP channel molding.
Figure 34:
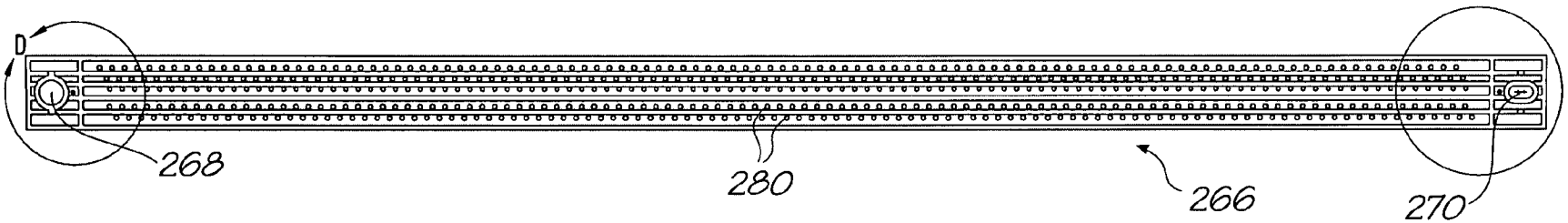
FIG. 34 is a plan view of the LCP channel molding.
Figure 36:
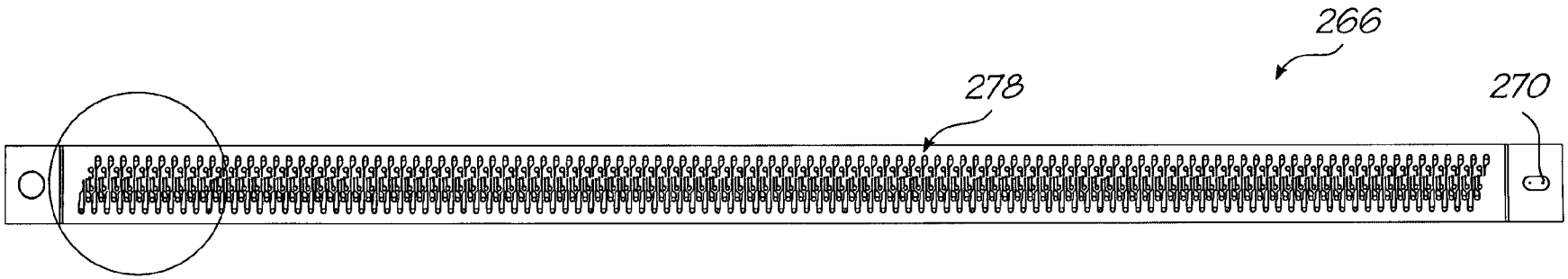
FIG. 36 is a bottom view of the LCP channel molding.
Figure 35:
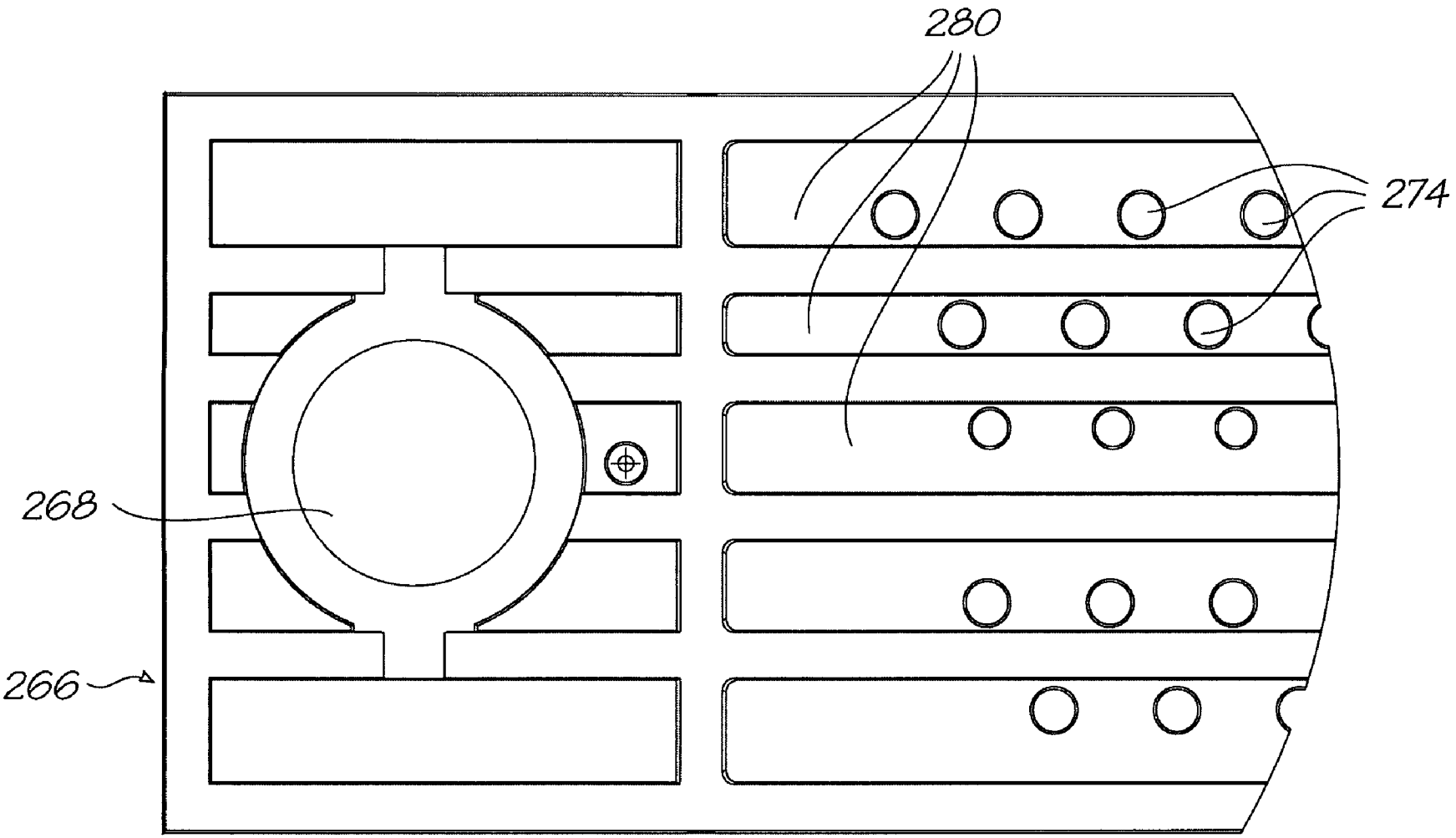
FIG. 35 is an enlarged plan view of inset D shown in FIG. 34.
Figure 37:
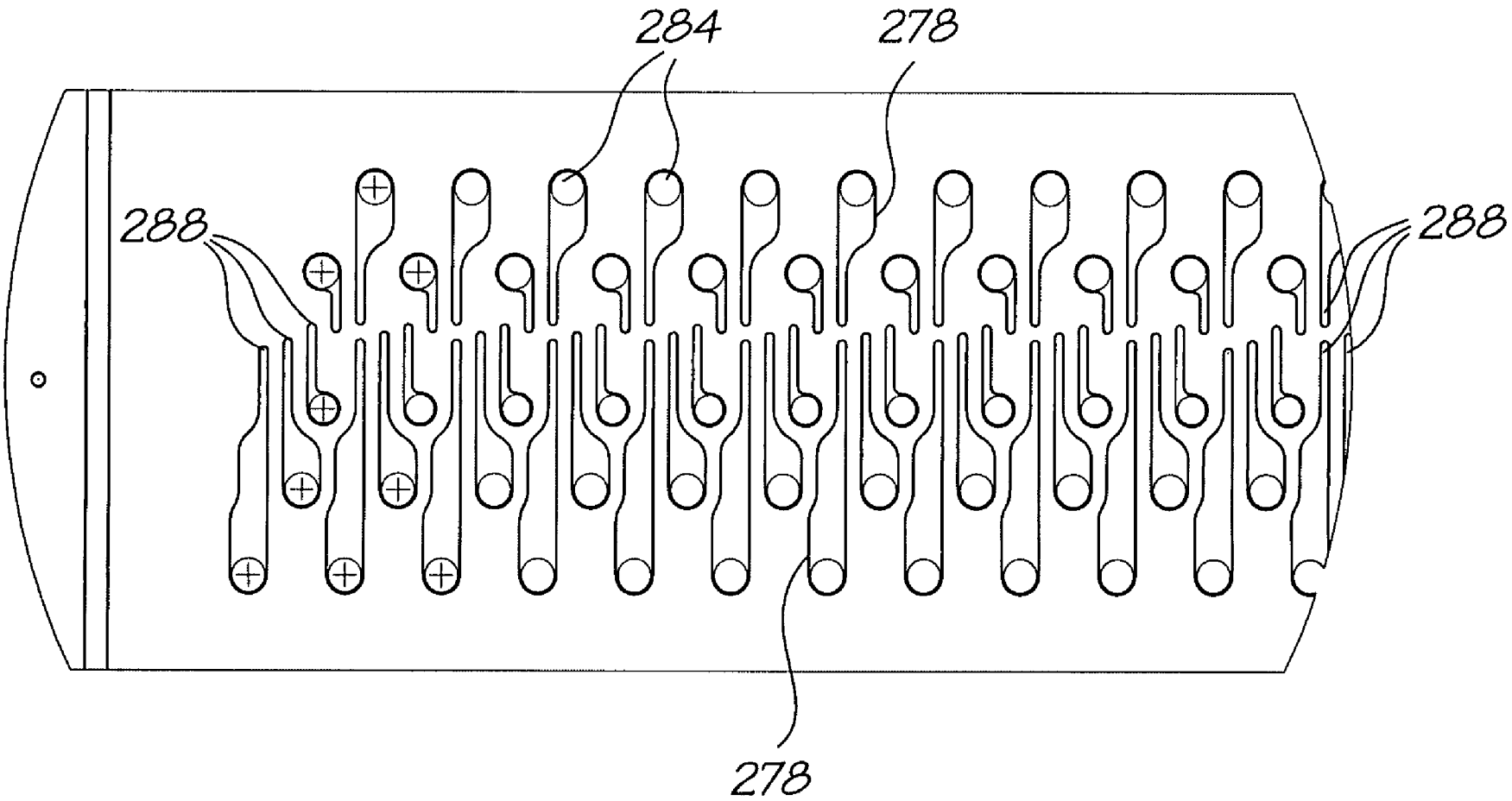
FIG. 37 is an enlarged bottom view of the LCP channel molding.

Each channel 280 runs substantially the full length of the channel molding 266 in order to feed the printhead 600 with one of the five ink colors (CMYK & IR). At the bottom of each channel 280 is a series of ink apertures 284 that feeds ink through to the ink conduits 278 formed in outer surface. FIGS. 33*a* and 33*b* are perspectives of the channel molding in isolation and FIGS. 34 and 35 is a plan view of the channel molding together with a partial enlargement showing the series of ink apertures 284 along the bottom of each channel 280. As shown in FIGS. 36 and 37, the ink apertures 284 lead to the outer ends of the ink conduits 278. The inner ends 288 of the ink conduits 278 are along a central strip corresponding to the position of the printhead 600 (not shown). The ink conduits 278 are sealed with an adhesive polymer sealing film (not shown) which also mounts the MEMS printhead 600 to the channel molding 266. Ink in the conduits 278 flows to the printhead 600 through laser drilled holes in the sealing film that are aligned with the inner ends 288 of the ink conduits 278. The film may be a thermoplastic film such as a PET or Polysulphone film, or it may be in the form of a thermoset film, such as those manufactured by AL technologies and Rogers Corporation. In the interests of brevity, the reader is referred to co-pending U.S. application Ser. No. 11/014,769 filed Dec. 20, 2004 for additional details regarding the sealing film.

The lid molding 264 also has the rim formation 188 that engages the fulcrum 186 in the printer cradle 102 (see again to FIG. 12). On the opposite side of the lid molding 264 is the bearing surface 282 where the line of sprung PCB contacts press against the contact pads on the flex PCB (not shown). Extending between the bearing surface 282 and the rim formation 188 is the main lateral section 286 of the lid molding 264. The compressive force acting between the rim 188 and the bearing surface 264 runs directly through the main lateral section 286 to minimize and structural deflection on the LCP molding assembly 190 and therefore the printhead 600.

The use of LCP offers a number of advantages. It can be molded so that its coefficient of thermal expansion (CTE) is similar to that of silicon. It will be appreciated that any significant difference in the CTE's of the printhead 600 (discussed below) and the underlying moldings can cause the entire structure to bow. However, as the CTE of LCP in the mold direction is much less than that in the non-mold direction (~5 ppm/° C. compared to ~20 ppm/° C.), care must be take to ensure that the mold direction of the LCP moldings is unidirectional with the longitudinal extent of the printhead 600. LCP also has a relatively high stiffness with a modulus that is typically 5 times that of 'normal plastics' such as polycarbonates, styrene, nylon, PET and polypropylene.

Figure 40:
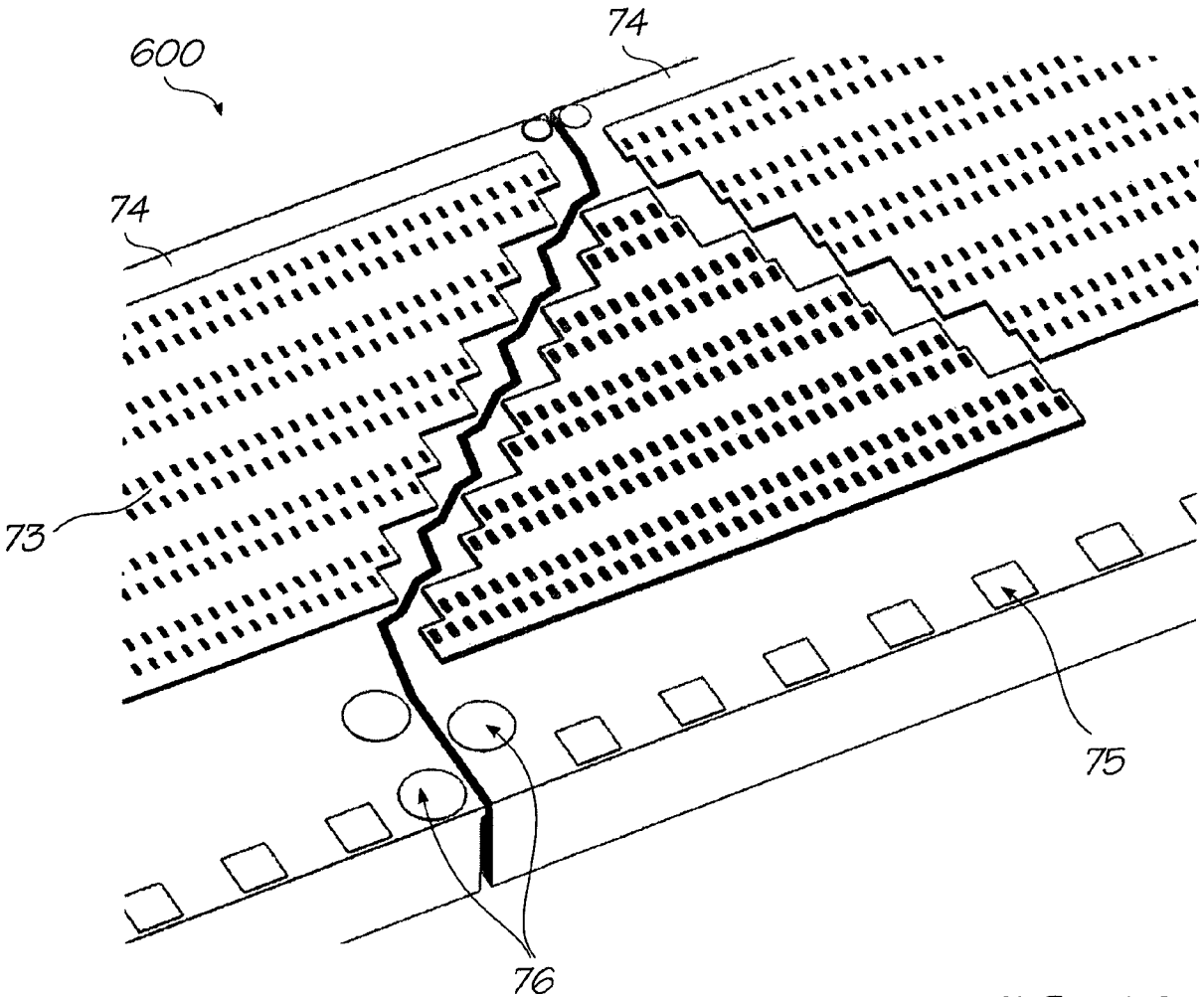
FIG. 40 shows a magnified perspective view of the join between two printhead integrated circuit modules.

The printhead 600 is shown in FIGS. 37-40. The printhead is a series of contiguous but separate printhead IC's 74, each printhead IC being a MEMS device fabricated on its own silicon substrate. FIG. 40 is a greatly enlarged perspective of the junction between two of the printhead IC's 74. Ink delivery inlets 73 are formed in the 'front' or ejection surface of a printhead IC 74. The inlets 73 supply ink to respective nozzles 801 (described below with reference to FIGS. 41 to 54) positioned on the inlets. The ink must be delivered to the IC's so as to supply ink to each and every individual inlet 73. Accordingly, the inlets 73 within an individual printhead IC 74 are physically grouped to reduce ink supply complexity and wiring complexity. They are also grouped logically to minimize power consumption and allow a variety of printing speeds.

Each printhead IC 74 is configured to receive and print five different colours of ink (C, M, Y, K and IR) and contains 1280 ink inlets per colour, with these nozzles being divided into even and odd nozzles (640 each). Even and odd nozzles for each colour are provided on different rows on the printhead IC 74 and are aligned vertically to perform true 1600 dpi printing, meaning that nozzles 801 are arranged in 10 rows, as clearly shown in FIG. 39. The horizontal distance between two adjacent nozzles 801 on a single row is 31.75 microns, whilst the vertical distance between rows of nozzles is based on the firing order of the nozzles, but rows are typically separated by an exact number of dot lines, plus a fraction of a dot line corresponding to the distance the paper will move between row firing times. Also, the spacing of even and odd rows of nozzles for a given colour must be such that they can share an ink channel, as will be described below.

As the printhead is a pagewidth printhead, individual printhead ICs 74 are linked together in abutting arrangement central strip if the LCP channel molding 266. The printhead IC's 74 may be attached to the polymer sealing film (described above) by heating the IC's above the melting point of the adhesive layer and then pressing them into the sealing film, or melting the adhesive layer under the IC with a laser before pressing them into the film. Another option is to both heat the IC (not above the adhesive melting point) and the adhesive layer, before pressing it into the film.

The length of an individual printhead IC 74 is around 20-22 mm. To print an A4/US letter sized page, 11-12 individual printhead ICs 74 are contiguously linked together. The number of individual printhead ICs 74 may be varied to accommodate sheets of other widths.

The printhead ICs 74 may be linked together in a variety of ways. One particular manner for linking the ICs 74 is shown in FIG. 40. In this arrangement, the ICs 74 are shaped at their ends to link together to form a horizontal line of ICs, with no vertical offset between neighboring ICs. A sloping join is provided between the ICs having substantially a 45° angle. The joining edge is not straight and has a sawtooth profile to facilitate positioning, and the ICs 74 are intended to be spaced about 11 microns apart, measured perpendicular to the joining edge. In this arrangement, the left most ink delivery nozzles 73 on each row are dropped by 10 line pitches and arranged in a triangle configuration. This arrangement provides a degree of overlap of nozzles at the join and maintains the pitch of the nozzles to ensure that the drops of ink are delivered consistently along the printing zone. This arrangement also ensures that more silicon is provided at the edge of the IC 74 to ensure sufficient linkage. Whilst control of the operation of the nozzles is performed by the SoPEC device (discussed later in the description), compensation for the nozzles may be performed in the printhead, or may also be performed by the SoPEC device, depending on the storage requirements. In this regard it will be appreciated that the dropped triangle arrangement of nozzles disposed at one end of the IC 74 provides the minimum on-printhead storage requirements. However where storage requirements are less critical, shapes other than a triangle can be used, for example, the dropped rows may take the form of a trapezoid.

The upper surface of the printhead ICs have a number of bond pads 75 provided along an edge thereof which provide a means for receiving data and or power to control the operation of the nozzles 73 from the SoPEC device. To aid in positioning the ICs 74 correctly on the surface of the adhesive layer 71 and aligning the ICs 74 such that they correctly align with the holes 72 formed in the adhesive layer 71, fiducials 76 are also provided on the surface of the ICs 74. The fiducials 76 are in the form of markers that are readily identifiable by appropriate positioning equipment to indicate the true position of the IC 74 with respect to a neighboring IC and the surface of the adhesive layer 71, and are strategically positioned at the edges of the ICs 74, and along the length of the adhesive layer 71.

Figure 38:
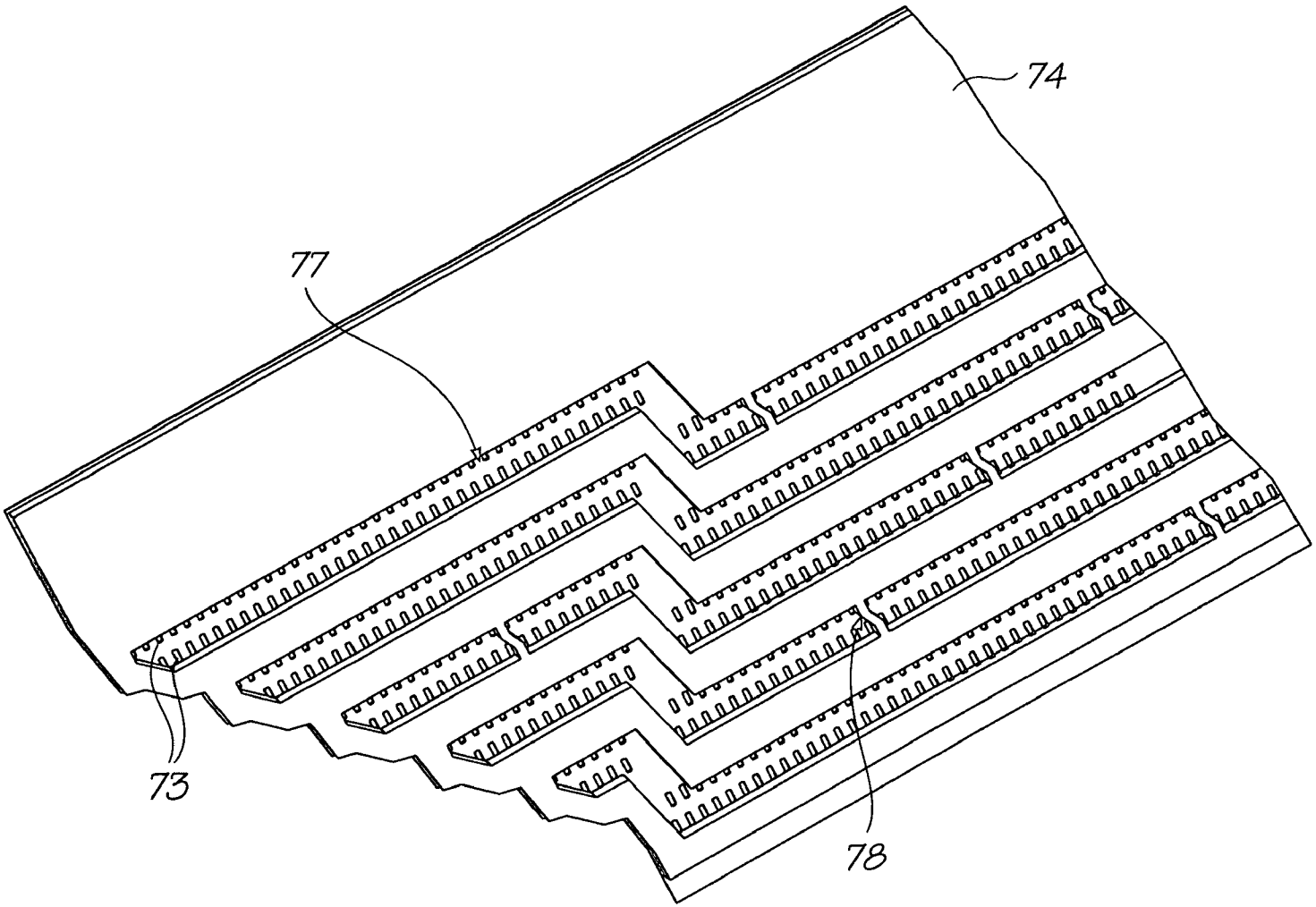
FIG. 38 shows a magnified partial perspective view of the top of the drop triangle end of a printhead integrated circuit module.
Figure 39:
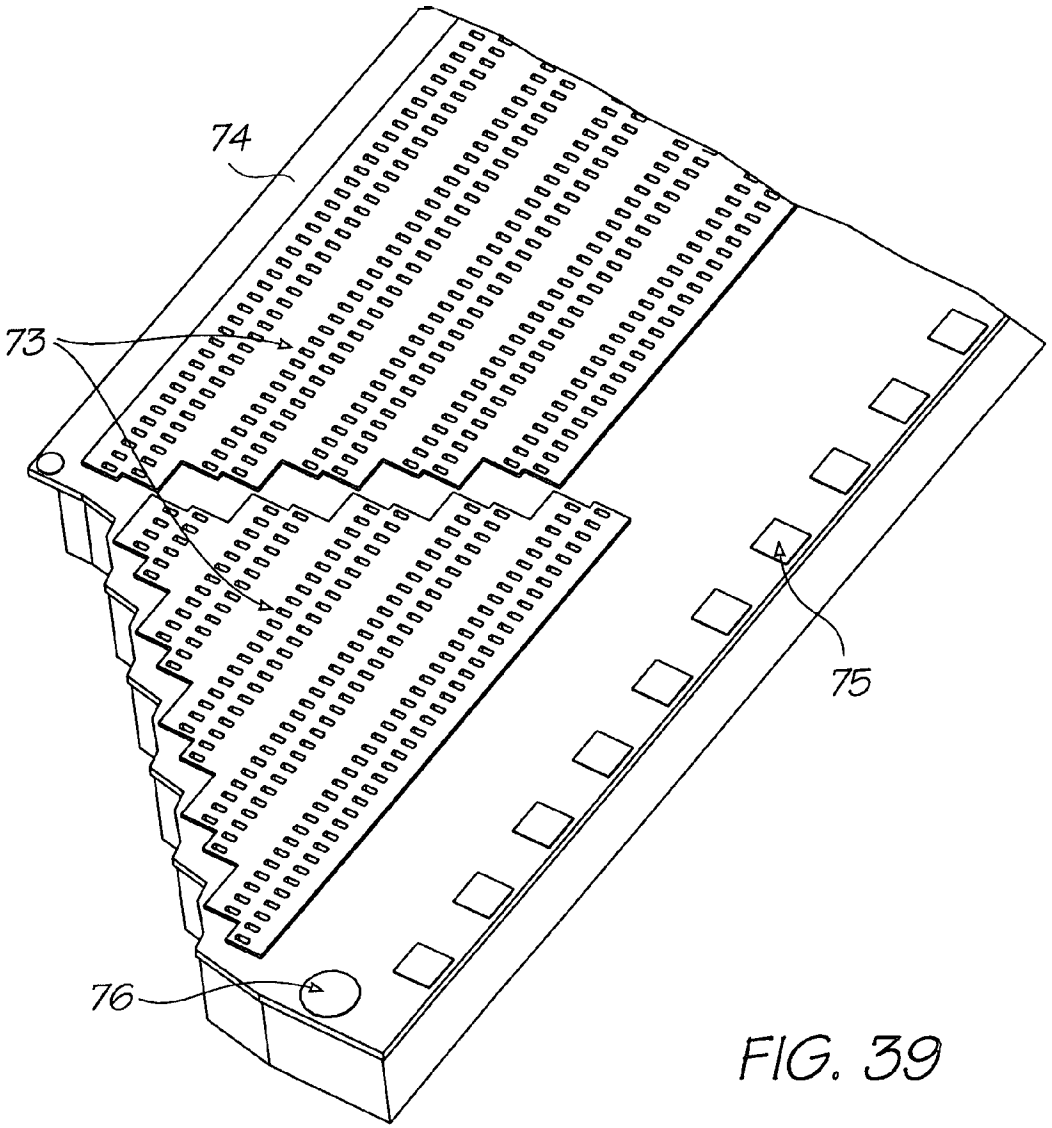
FIG. 39 shows a magnified partial perspective view of the bottom of the drop triangle end of a printhead integrated circuit module.

As shown in FIG. 38, the etched channels 77 in the underside of each printhead IC 74 receive ink from the ink conduits 278 and distribute it to the ink inlets 73. Each channel 77 communicates with a pair of rows of inlets 73 dedicated to delivering one particular colour or type of ink. The channels 77 are about 80 microns wide, which is equivalent to the width of the holes 72 in the polymer sealing film and extend the length of the IC 74. The channels 77 are divided into sections by silicon walls 78. Each section is directly supplied with ink, to reduce the flow path to the inlets 73 and the likelihood of ink starvation to the individual nozzles 801. In this regard, each section feeds approximately 128 nozzles 801 via their respective inlets 73.

To halve the density of laser drilled holes needed in the sealing film, the holes can be positioned on the silicon walls 78. In this way, one hole supplies ink to two sections of the channel 77.

Following attachment and alignment of each of the printhead ICs 74 to the channel molding, a flex PCB is attached along an edge of the ICs 74 so that control signals and power can be supplied to the bond pads 75 to control and operate the nozzles 801. The flex PCB and its attachment to the bond pads 75 is described in detail in the above mentioned co-pending U.S. application Ser. No. 11/014,769 filed Dec. 20, 2004, incorporated herein by reference. The flex PCB wraps around the bearing surface 282 of the lid molding 264 (see FIG. 32).

Ink Delivery Nozzles

Figure 49:
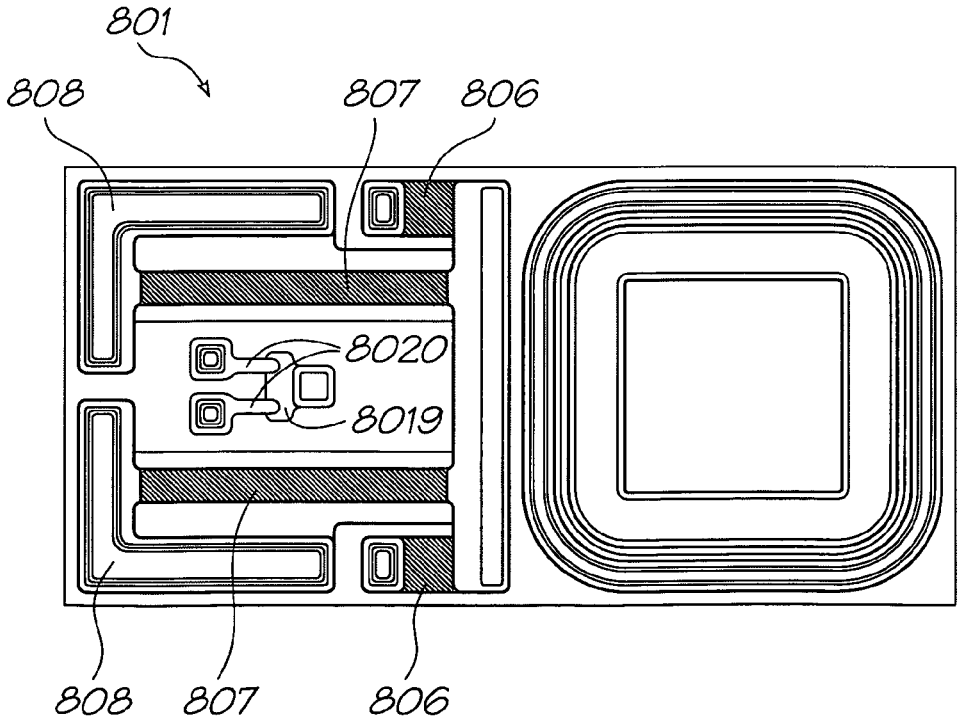
FIG. 49 shows a plan view of the nozzle of FIG. 41 with the lever arm and movable nozzle removed for clarity.
Figure 50:
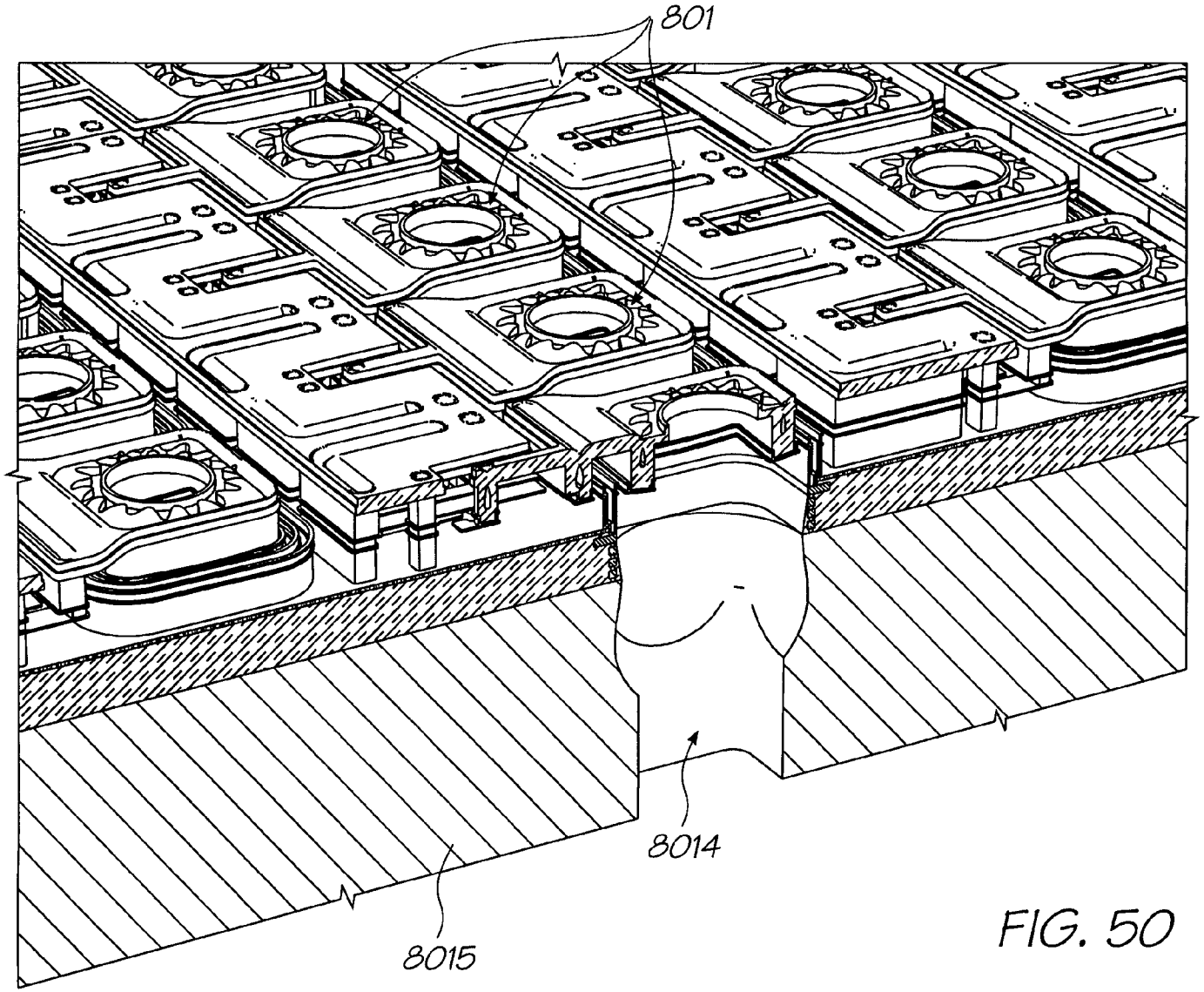
FIG. 50 shows a perspective vertical sectional view of a part of a printhead chip incorporating a plurality of the nozzle arrangements of the type shown in FIG. 41.

One example of a type of ink delivery nozzle arrangement suitable for the present invention, comprising a nozzle and corresponding actuator, will now be described with reference to FIGS. 41 to 50. FIG. 50 shows an array of ink delivery nozzle arrangements 801 formed on a silicon substrate 8015. Each of the nozzle arrangements 801 are identical, however groups of nozzle arrangements 801 are arranged to be fed with different colored inks or fixative. In this regard, the nozzle arrangements are arranged in rows and are staggered with respect to each other, allowing closer spacing of ink dots during printing than would be possible with a single row of nozzles. Such an arrangement makes it possible to provide a high density of nozzles, for example, more than 5000 nozzles arrayed in a plurality of staggered rows each having an interspacing of about 32 microns between the nozzles in each row and about 80 microns between the adjacent rows. The multiple rows also allow for redundancy (if desired), thereby allowing for a predetermined failure rate per nozzle.

Each nozzle arrangement 801 is the product of an integrated circuit fabrication technique. In particular, the nozzle arrangement 801 defines a micro-electromechanical system (MEMS).

For clarity and ease of description, the construction and operation of a single nozzle arrangement 801 will be described with reference to FIGS. 41 to 50.

The ink jet printhead integrated circuit 74 includes a silicon wafer substrate 8015 having 0.35 micron 1 P4M 12 volt CMOS microprocessing electronics is positioned thereon.

A silicon dioxide (or alternatively glass) layer 8017 is positioned on the substrate 8015. The silicon dioxide layer 8017 defines CMOS dielectric layers. CMOS top-level metal defines a pair of aligned aluminium electrode contact layers 8030 positioned on the silicon dioxide layer 8017. Both the silicon wafer substrate 8015 and the silicon dioxide layer 8017 are etched to define an ink inlet channel 8014 having a generally circular cross section (in plan). An aluminium diffusion barrier 8028 of CMOS metal 1, CMOS metal 2/3 and CMOS top level metal is positioned in the silicon dioxide layer 8017 about the ink inlet channel 8014. The diffusion barrier 8028 serves to inhibit the diffusion of hydroxyl ions through CMOS oxide layers of the drive electronics layer 8017.

A passivation layer in the form of a layer of silicon nitride 8031 is positioned over the aluminium contact layers 8030 and the silicon dioxide layer 8017. Each portion of the passivation layer 8031 positioned over the contact layers 8030 has an opening 8032 defined therein to provide access to the contacts 8030.

Figure 44:
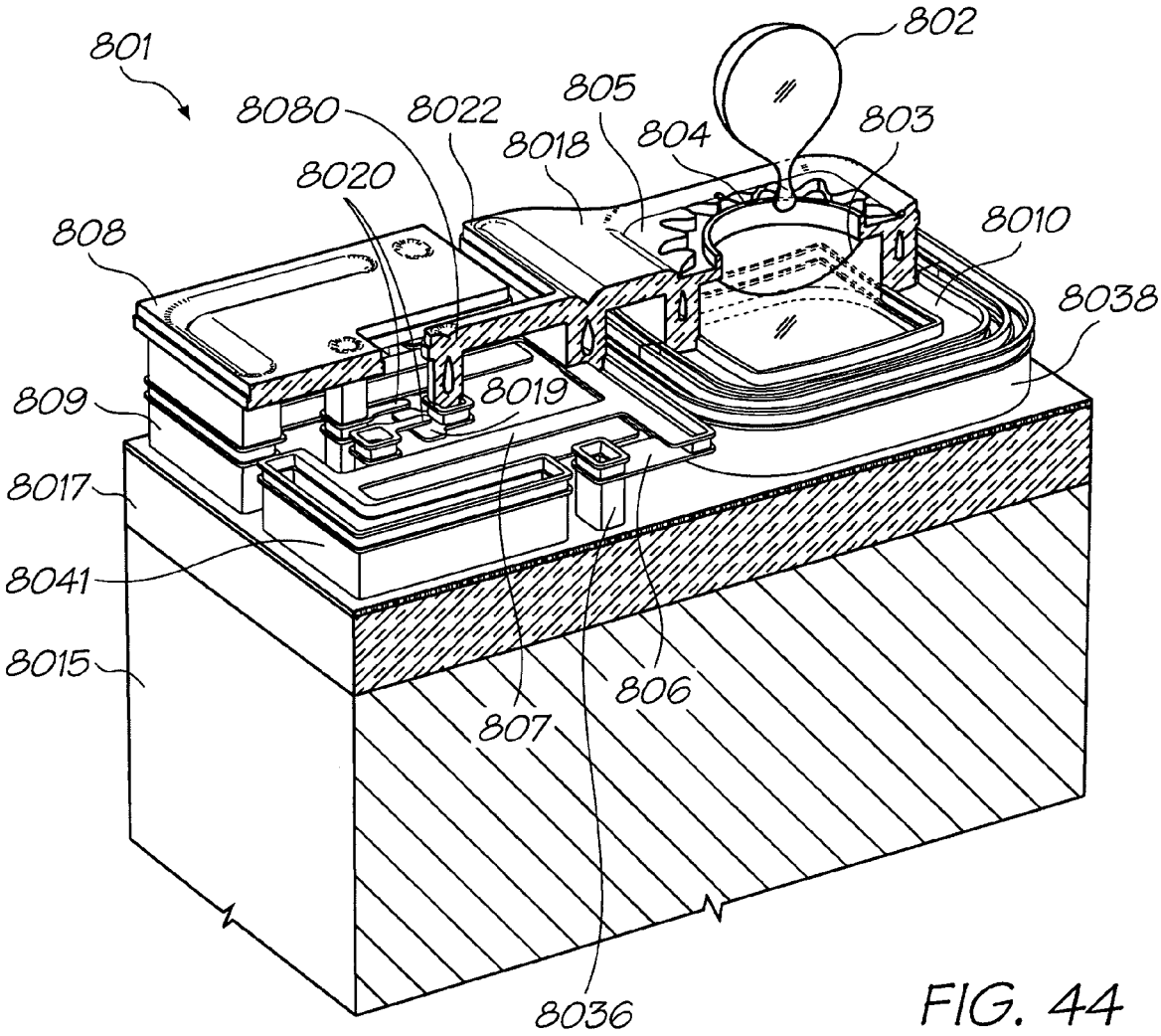
FIG. 44 shows a perspective partial vertical sectional view of the nozzle of FIG. 41, at the actuation state shown in FIG. 36.

The nozzle arrangement 801 includes a nozzle chamber 8029 defined by an annular nozzle wall 8033, which terminates at an upper end in a nozzle roof 8034 and a radially inner nozzle rim 804 that is circular in plan. The ink inlet channel 8014 is in fluid communication with the nozzle chamber 8029. At a lower end of the nozzle wall, there is disposed a moving rim 8010, that includes a moving seal lip 8040. An encircling wall 8038 surrounds the movable nozzle, and includes a stationary seal lip 8039 that, when the nozzle is at rest as shown in FIG. 44, is adjacent the moving rim 8010. A fluidic seal 8011 is formed due to the surface tension of ink trapped between the stationary seal lip 8039 and the moving seal lip 8040.

This prevents leakage of ink from the chamber whilst providing a low resistance coupling between the encircling wall 8038 and the nozzle wall 8033.

Figure 48:
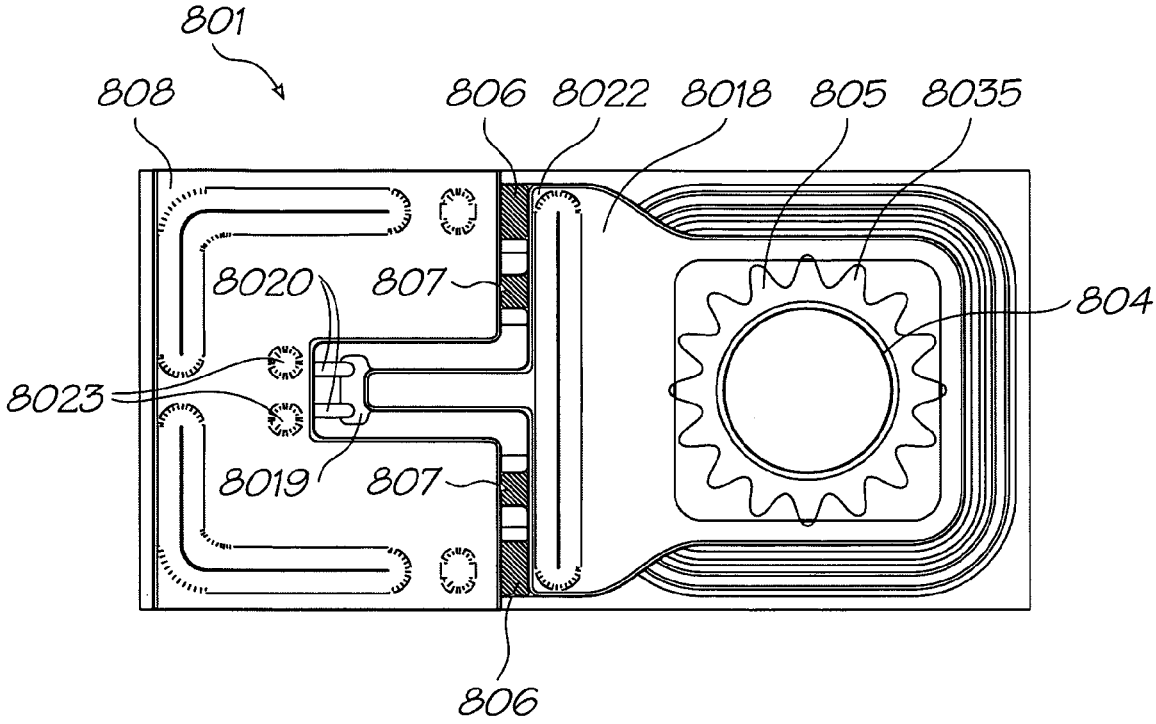
FIG. 48 shows a plan view of the nozzle of FIG. 41.

As best shown in FIG. 48, a plurality of radially extending recesses 8035 is defined in the roof 8034 about the nozzle rim 804. The recesses 8035 serve to contain radial ink flow as a result of ink escaping past the nozzle rim 804.

The nozzle wall 8033 forms part of a lever arrangement that is mounted to a carrier 8036 having a generally U-shaped profile with a base 8037 attached to the layer-8031 of silicon nitride.

The lever arrangement also includes a lever arm 8018 that extends from the nozzle walls and incorporates a lateral stiffening beam 8022. The lever arm 8018 is attached to a pair of passive beams 806, formed from titanium nitride (TiN) and positioned on either side of the nozzle arrangement, as best shown in FIGS. 44 and 49. The other ends of the passive beams 806 are attached to the carrier 8036.

The lever arm 8018 is also attached to an actuator beam 807, which is formed from TiN. It will be noted that this attachment to the actuator beam is made at a point a small but critical distance higher than the attachments to the passive beam 806.

Figure 41:
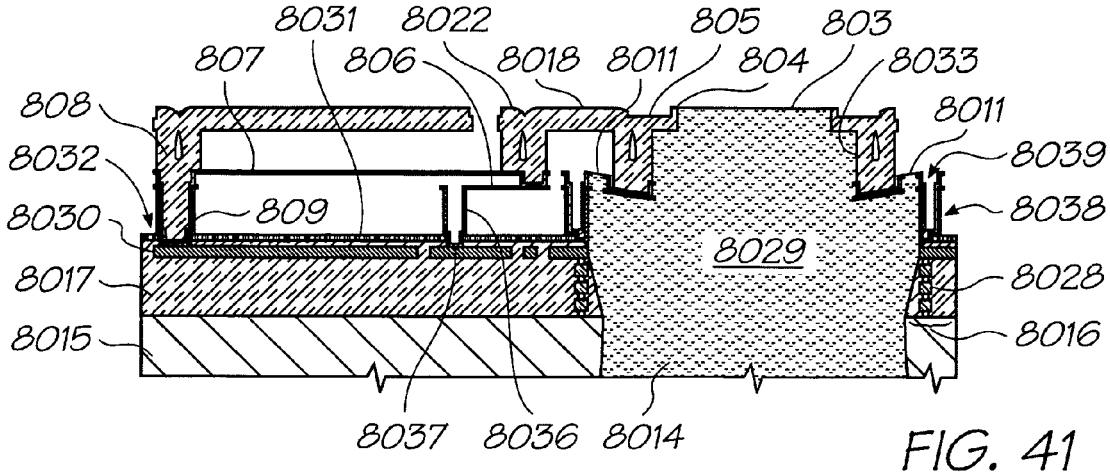
FIG. 41 shows a vertical sectional view of a single nozzle for ejecting ink, for use with the invention, in a quiescent state.
Figure 47:
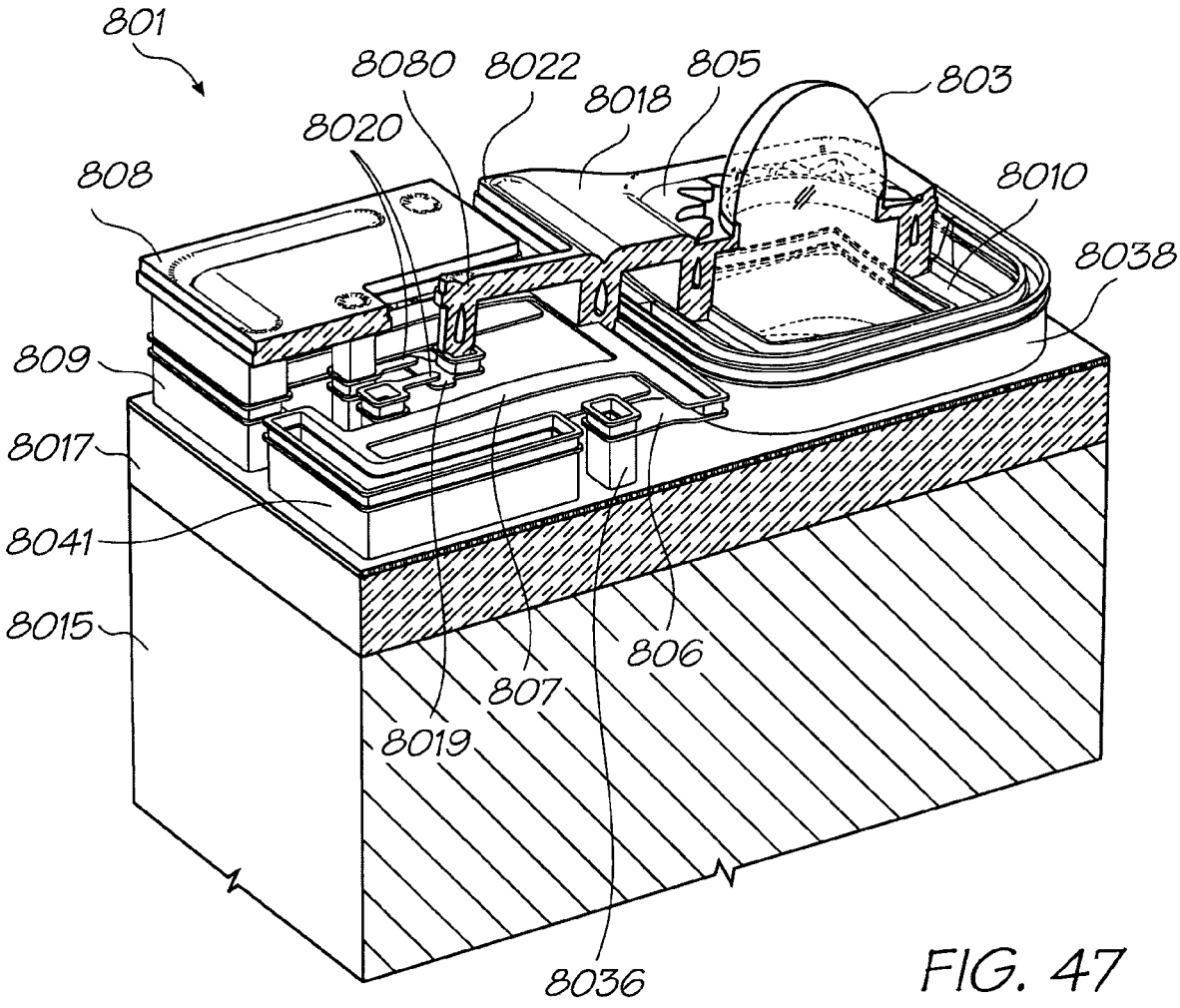
FIG. 47 shows a perspective partial vertical sectional view of the nozzle of FIG. 41, at the actuation state shown in FIG. 42.

As best shown in FIGS. 41 and 47, the actuator beam 807 is substantially U-shaped in plan, defining a current path between the electrode 809 and an opposite electrode 8041. Each of the electrodes 809 and 8041 are electrically connected to respective points in the contact layer 8030. As well as being electrically coupled via the contacts 809, the actuator beam is also mechanically anchored to anchor 808.

Figure 45:
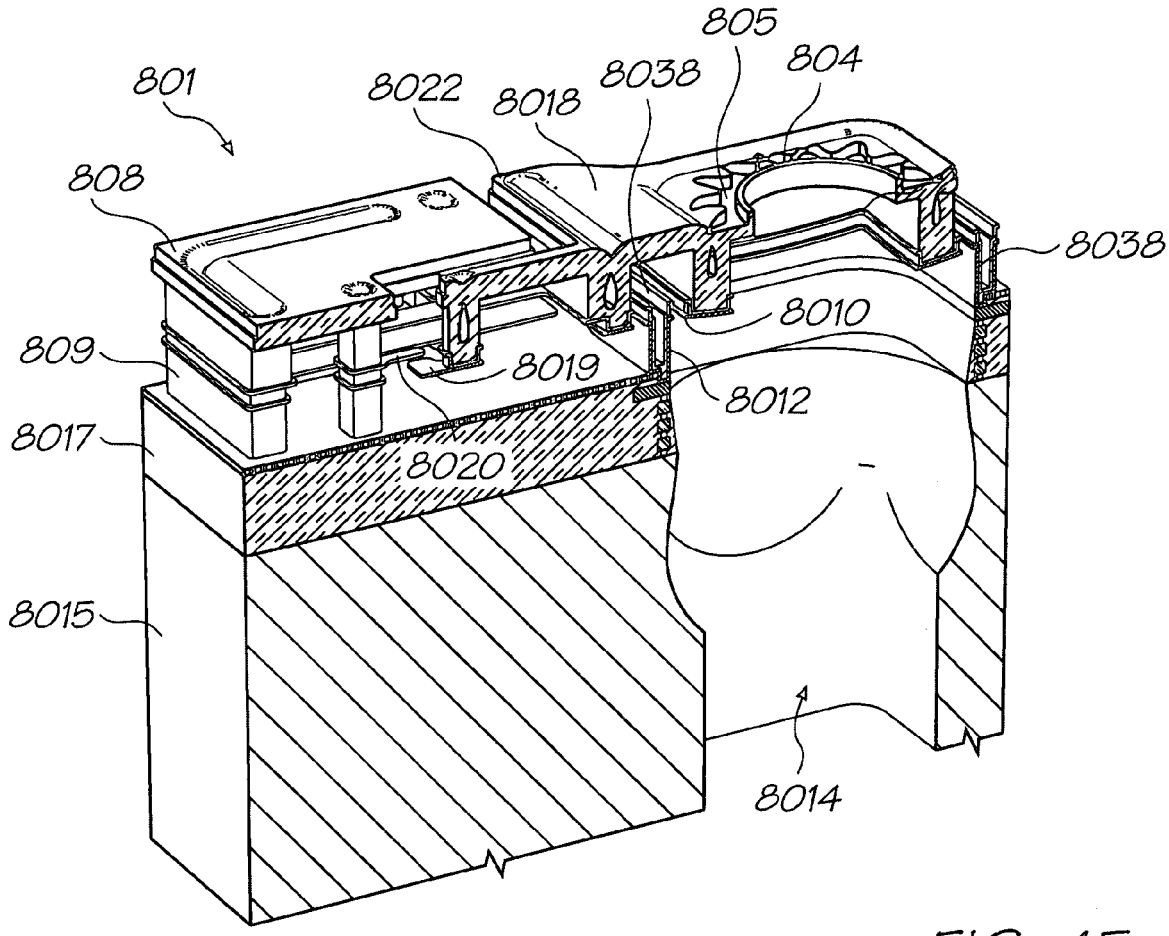
FIG. 45 shows a perspective vertical section of the nozzle of FIG. 41, with ink omitted.
Figure 46:
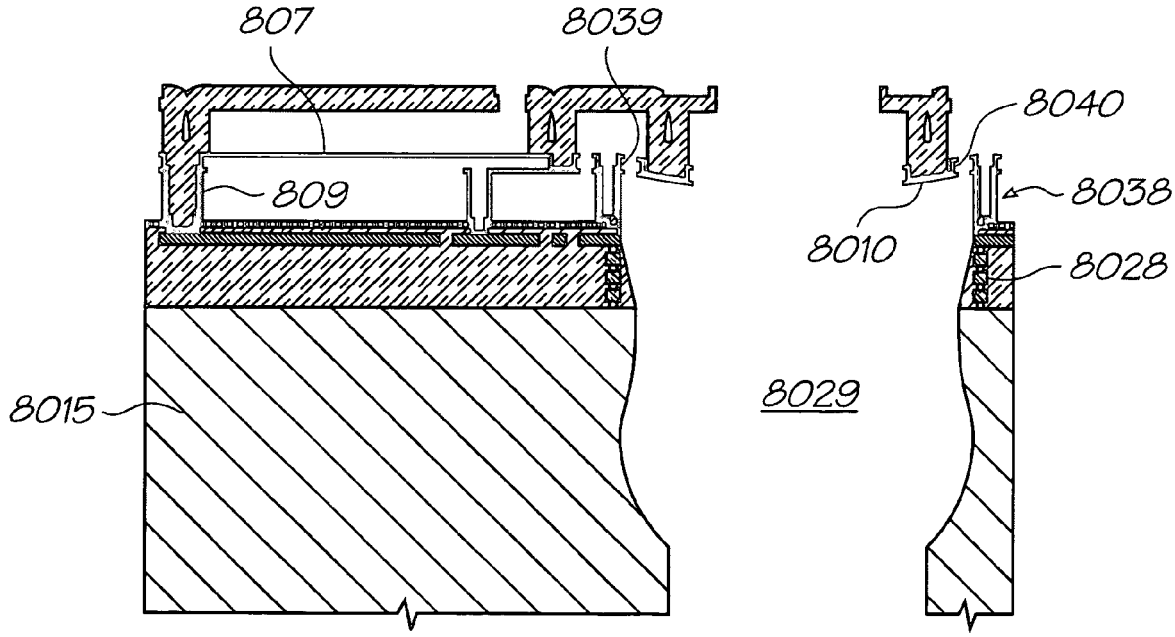
FIG. 46 shows a vertical sectional view of the of the nozzle of FIG. 45.

The anchor 808 is configured to constrain motion of the actuator beam 807 to the left of FIGS. 44 to 46 when the nozzle arrangement is in operation.

The TiN in the actuator beam 807 is conductive, but has a high enough electrical resistance that it undergoes self-heating when a current is passed between the electrodes 809 and 8041. No current flows through the passive beams 806, so they do not expand.

In use, the device at rest is filled with ink 8013 that defines a meniscus 803 under the influence of surface tension. The ink is retained in the chamber 8029 by the meniscus, and will not generally leak out in the absence of some other physical influence.

Figure 42:
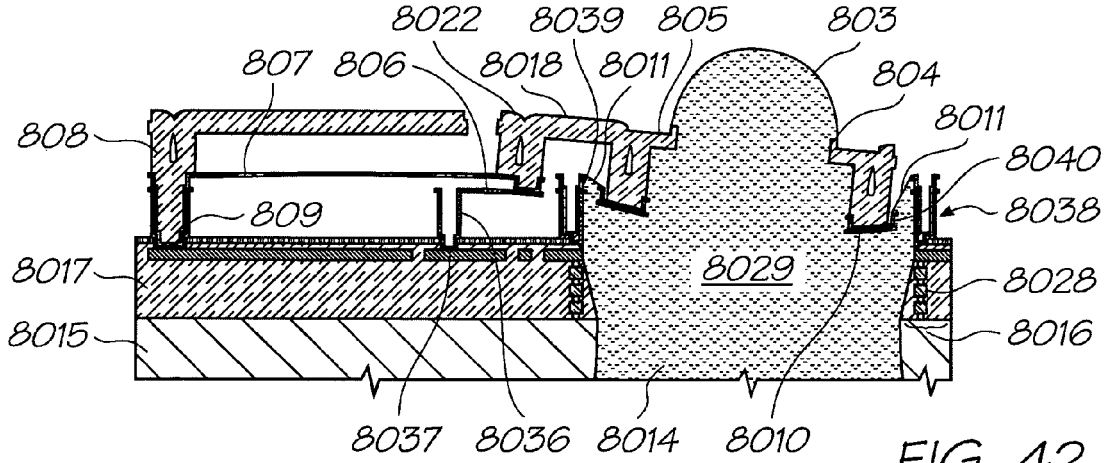
FIG. 42 shows a vertical sectional view of the nozzle of FIG. 41 during an initial actuation phase.

As shown in FIG. 42, to fire ink from the nozzle, a current is passed between the contacts 809 and 8041, passing through the actuator beam 807. The self-heating of the beam 807 due to its resistance causes the beam to expand. The dimensions and design of the actuator beam 807 mean that the majority of the expansion in a horizontal direction with respect to FIGS. 41 to 43. The expansion is constrained to the left by the anchor 808, so the end of the actuator beam 807 adjacent the lever arm 8018 is impelled to the right.

The relative horizontal inflexibility of the passive beams 806 prevents them from allowing much horizontal movement the lever arm 8018. However, the relative displacement of the attachment points of the passive beams and actuator beam respectively to the lever arm causes a twisting movement that causes the lever arm 8018 to move generally downwards. The movement is effectively a pivoting or hinging motion. However, the absence of a true pivot point means that the rotation is about a pivot region defined by bending of the passive beams 806.

The downward movement (and slight rotation) of the lever arm 8018 is amplified by the distance of the nozzle wall 8033 from the passive beams 806. The downward movement of the nozzle walls and roof causes a pressure increase within the chamber 8029, causing the meniscus to bulge as shown in FIG. 42. It will be noted that the surface tension of the ink means the fluid seal 8011 is stretched by this motion without allowing ink to leak out.

Figure 43:
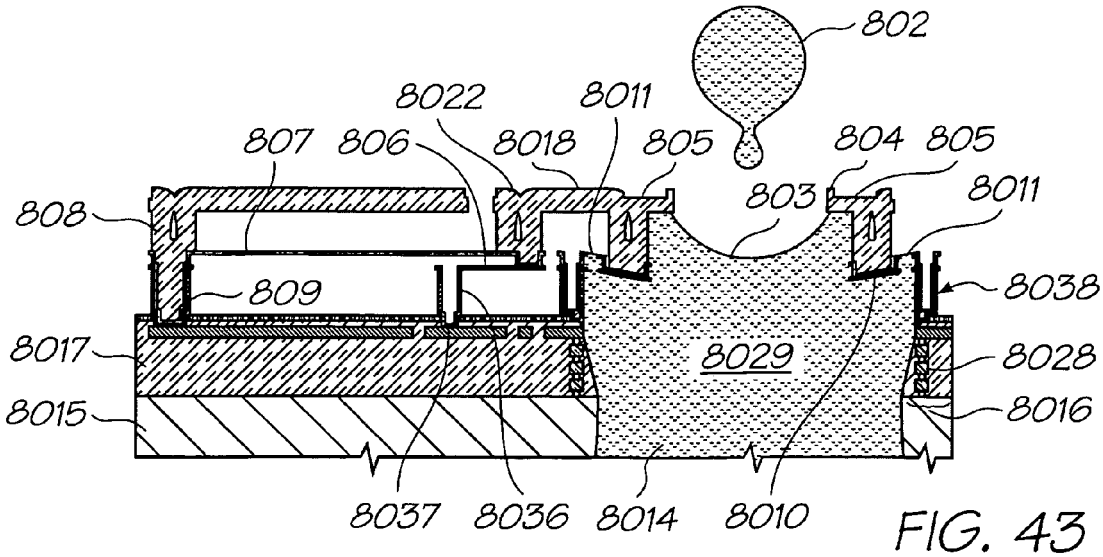
FIG. 43 shows a vertical sectional view of the nozzle of FIG. 42 later in the actuation phase.

As shown in FIG. 43, at the appropriate time, the drive current is stopped and the actuator beam 807 quickly cools and contracts. The contraction causes the lever arm to commence its return to the quiescent position, which in turn causes a reduction in pressure in the chamber 8029. The interplay of the momentum of the bulging ink and its inherent surface tension, and the negative pressure caused by the upward movement of the nozzle chamber 8029 causes thinning, and ultimately snapping, of the bulging meniscus to define an ink drop 802 that continues upwards until it contacts adjacent print media.

Immediately after the drop 802 detaches, meniscus 803 forms the concave shape shown in FIG. 43. Surface tension causes the pressure in the chamber 8029 to remain relatively low until ink has been sucked upwards through the inlet 8014, which returns the nozzle arrangement and the ink to the quiescent situation shown in FIG. 41.

Another type of printhead nozzle arrangement suitable for the present invention will now be described with reference to FIG. 51. Once again, for clarity and ease of description, the construction and operation of a single nozzle arrangement 1001 will be described.

The nozzle arrangement 1001 is of a bubble forming heater element actuator type which comprises a nozzle plate 1002 with a nozzle 1003 therein, the nozzle having a nozzle rim 1004, and aperture 1005 extending through the nozzle plate. The nozzle plate 1002 is plasma etched from a silicon nitride structure which is deposited, by way of chemical vapour deposition (CVD), over a sacrificial material which is subsequently etched.

The nozzle arrangement includes, with respect to each nozzle 1003, side walls 1006 on which the nozzle plate is supported, a chamber 1007 defined by the walls and the nozzle plate 1002, a multi-layer substrate 1008 and an inlet passage 1009 extending through the multi-layer substrate to the far side (not shown) of the substrate. A looped, elongate heater element 1010 is suspended within the chamber 1007, so that the element is in the form of a suspended beam. The nozzle arrangement as shown is a microelectromechanical system (MEMS) structure, which is formed by a lithographic process.

When the nozzle arrangement is in use, ink 1011 from a reservoir (not shown) enters the chamber 1007 via the inlet passage 1009, so that the chamber fills. Thereafter, the heater element 1010 is heated for somewhat less than 1 micro second, so that the heating is in the form of a thermal pulse. It will be appreciated that the heater element 1010 is in thermal contact with the ink 1011 in the chamber 1007 so that when the element is heated, this causes the generation of vapor bubbles in the ink. Accordingly, the ink 1011 constitutes a bubble forming liquid.

The bubble 1012, once generated, causes an increase in pressure within the chamber 1007, which in turn causes the ejection of a drop 1016 of the ink 1011 through the nozzle 1003. The rim 1004 assists in directing the drop 1016 as it is ejected, so as to minimize the chance of a drop misdirection.

The reason that there is only one nozzle 1003 and chamber 1007 per inlet passage 1009 is so that the pressure wave generated within the chamber, on heating of the element 1010 and forming of a bubble 1012, does not effect adjacent chambers and their corresponding nozzles.

The increase in pressure within the chamber 1007 not only pushes ink 1011 out through the nozzle 1003, but also pushes some ink back through the inlet passage 1009. However, the inlet passage 1009 is approximately 200 to 300 microns in length, and is only approximately 16 microns in diameter. Hence there is a substantial viscous drag. As a result, the predominant effect of the pressure rise in the chamber 1007 is to force ink out through the nozzle 1003 as an ejected drop 1016, rather than back through the inlet passage 1009.

Figure 51:
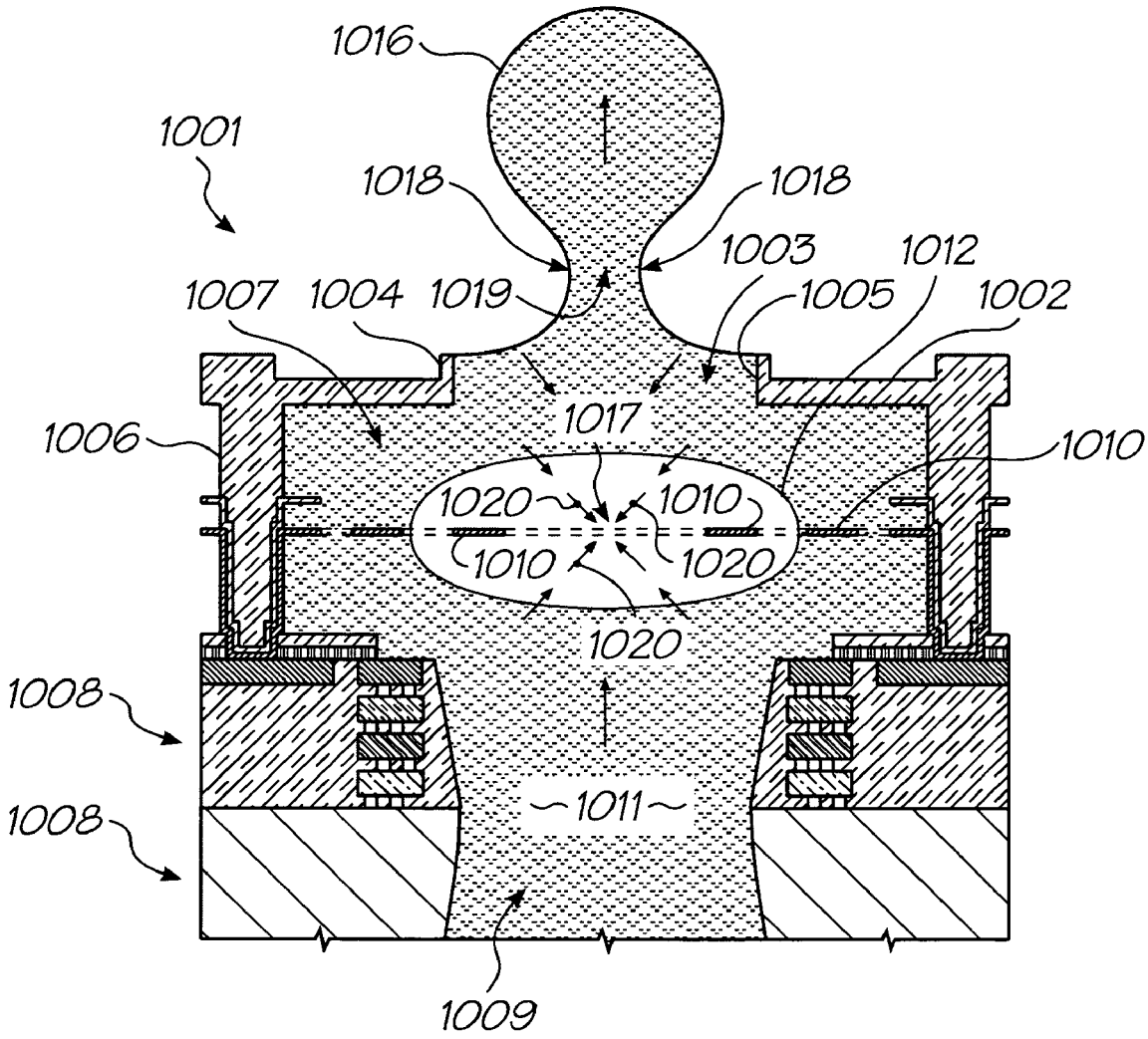
FIG. 51 shows a schematic cross-sectional view through an ink chamber of a single nozzle for injecting ink of a bubble forming heater element actuator type.

As shown in FIG. 51, the ink drop 1016 is being ejected is shown during its "necking phase" before the drop breaks off. At this stage, the bubble 1012 has already reached its maximum size and has then begun to collapse towards the point of collapse 1017.

The collapsing of the bubble 1012 towards the point of collapse 1017 causes some ink 1011 to be drawn from within the nozzle 1003 (from the sides 1018 of the drop), and some to be drawn from the inlet passage 1009, towards the point of collapse. Most of the ink 1011 drawn in this manner is drawn from the nozzle 1003, forming an annular neck 1019 at the base of the drop 1016 prior to its breaking off.

The drop 1016 requires a certain amount of momentum to overcome surface tension forces, in order to break off. As ink 1011 is drawn from the nozzle 1003 by the collapse of the bubble 1012, the diameter of the neck 1019 reduces thereby reducing the amount of total surface tension holding the drop, so that the momentum of the drop as it is ejected out of the nozzle is sufficient to allow the drop to break off.

When the drop 1016 breaks off, cavitation forces are caused as reflected by the arrows 1020, as the bubble 1012 collapses to the point of collapse 1017. It will be noted that there are no solid surfaces in the vicinity of the point of collapse 1017 on which the cavitation can have an effect.

Yet another type of printhead nozzle arrangement suitable for the present invention will now be described with reference to FIGS. 52-54. This type typically provides an ink delivery nozzle arrangement having a nozzle chamber containing ink and a thermal bend actuator connected to a paddle positioned within the chamber. The thermal actuator device is actuated so as to eject ink from the nozzle chamber. The preferred embodiment includes a particular thermal bend actuator which includes a series of tapered portions for providing conductive heating of a conductive trace. The actuator is connected to the paddle via an arm received through a slotted wall of the nozzle chamber. The actuator arm has a mating shape so as to mate substantially with the surfaces of the slot in the nozzle chamber wall.

Figure 52A:
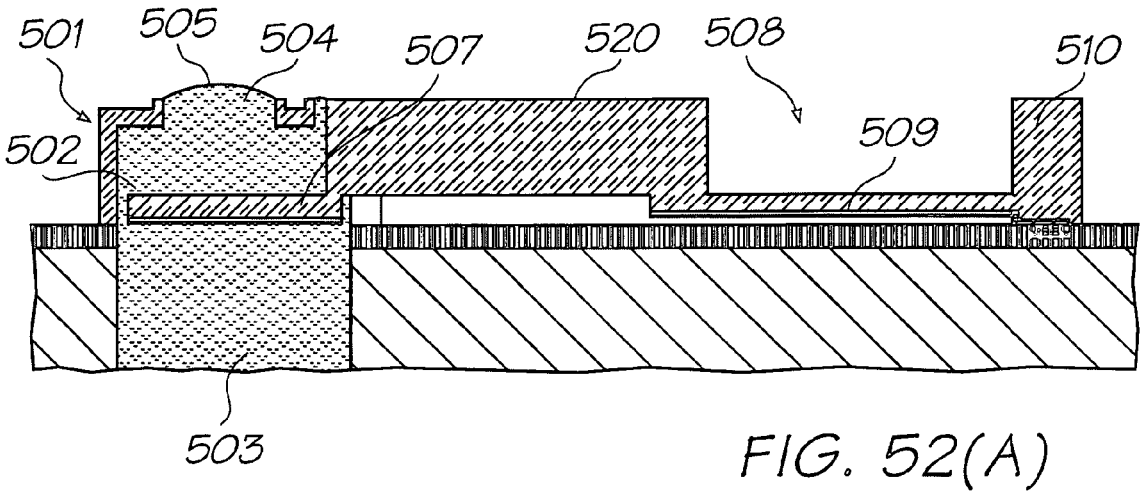
FIGS. 52A to 52C show the basic operational principles of a thermal bend actuator.
Figure 52B:
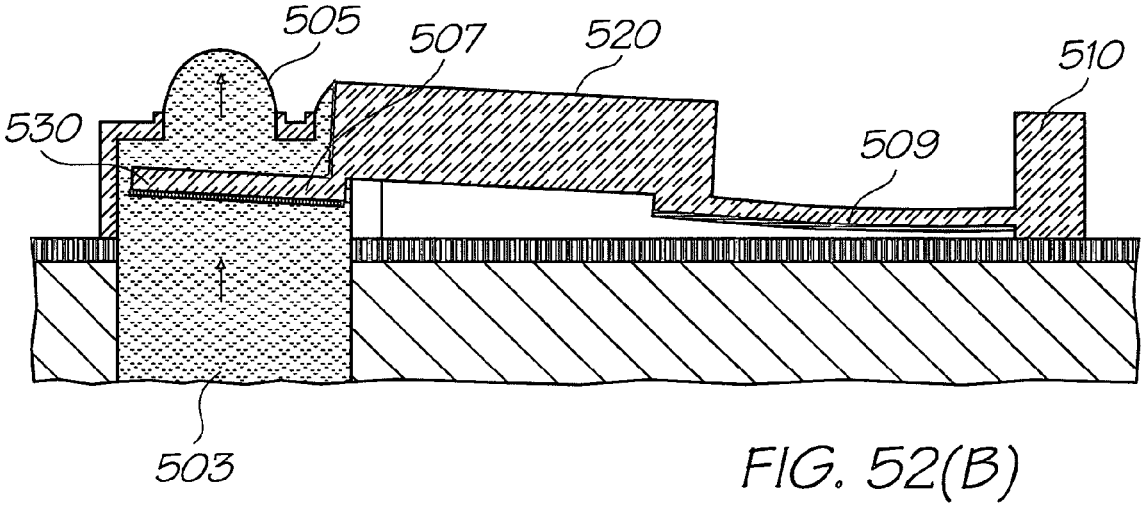
Figure 52C:
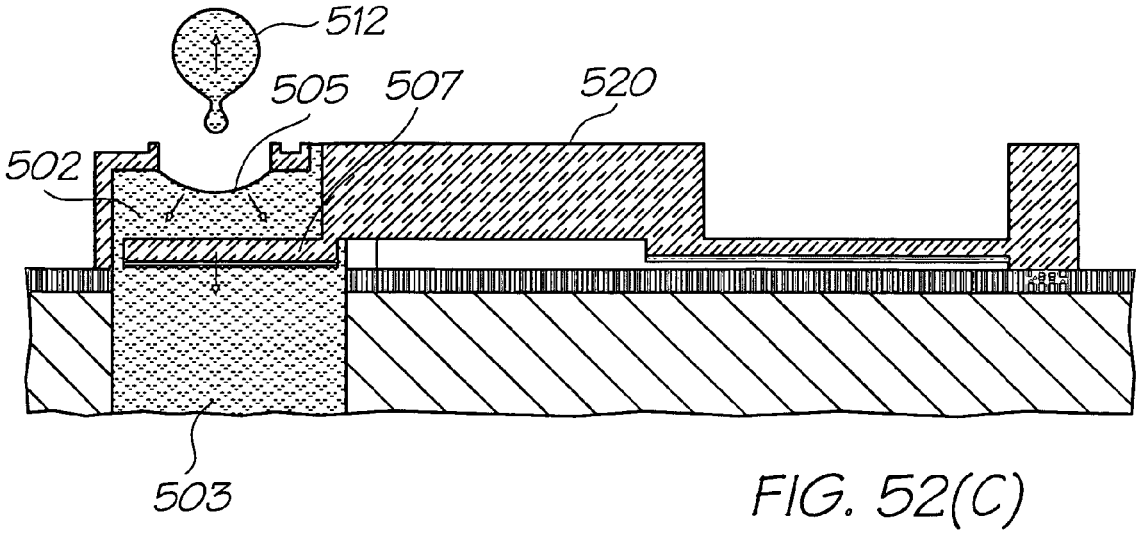

Turning initially to FIGS. 52*a-c*, there is provided schematic illustrations of the basic operation of a nozzle arrangement of this embodiment. A nozzle chamber 501 is provided filled with ink 502 by means of an ink inlet channel 503 which can be etched through a wafer substrate on which the nozzle chamber 501 rests. The nozzle chamber 501 further includes an ink ejection port 504 around which an ink meniscus forms.

Inside the nozzle chamber 501 is a paddle type device 507 which is interconnected to an actuator 508 through a slot in the wall of the nozzle chamber 501. The actuator 508 includes a heater means e.g. 509 located adjacent to an end portion of a post 510. The post 510 is fixed to a substrate.

When it is desired to eject a drop from the nozzle chamber 501, as illustrated in FIG. 52*b*, the heater means 509 is heated so as to undergo thermal expansion. Preferably, the heater means 509 itself or the other portions of the actuator 508 are built from materials having a high bend efficiency where the bend efficiency is defined as:

$$\text{bend efficiency} = \frac{\text{Young's Modulus} \times (\text{Coefficient of thermal Expansion})}{\text{Density} \times \text{Specific Heat Capacity}}$$

A suitable material for the heater elements is a copper nickel alloy which can be formed so as to bend a glass material.

The heater means 509 is ideally located adjacent the end portion of the post 510 such that the effects of activation are magnified at the paddle end 507 such that small thermal expansions near the post 510 result in large movements of the paddle end.

The heater means 509 and consequential paddle movement causes a general increase in pressure around the ink meniscus 505 which expands, as illustrated in FIG. 52*b*, in a rapid manner. The heater current is pulsed and ink is ejected out of the port 504 in addition to flowing in from the ink channel 503.

Subsequently, the paddle 507 is deactivated to again return to its quiescent position. The deactivation causes a general reflow of the ink into the nozzle chamber. The forward momentum of the ink outside the nozzle rim and the corresponding backflow results in a general necking and breaking off of the drop 512 which proceeds to the print media. The collapsed meniscus 505 results in a general sucking of ink into the nozzle chamber 502 via the ink flow channel 503. In time, the nozzle chamber 501 is refilled such that the position in FIG. 52*a* is again reached and the nozzle chamber is subsequently ready for the ejection of another drop of ink.

Figure 53:
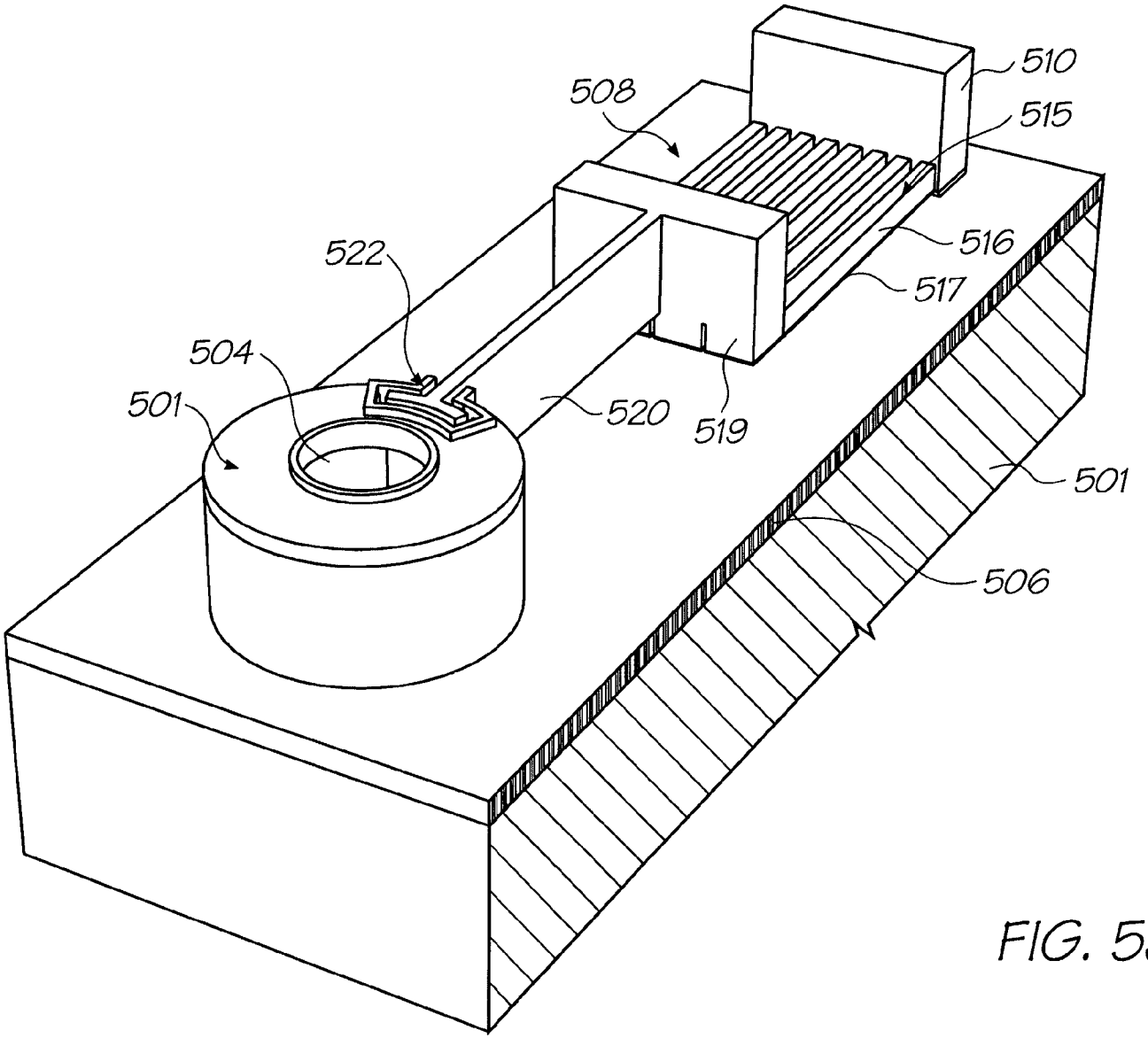
FIG. 53 shows a three dimensional view of a single ink jet nozzle arrangement constructed in accordance with FIGS. 52A to C.
Figure 54:
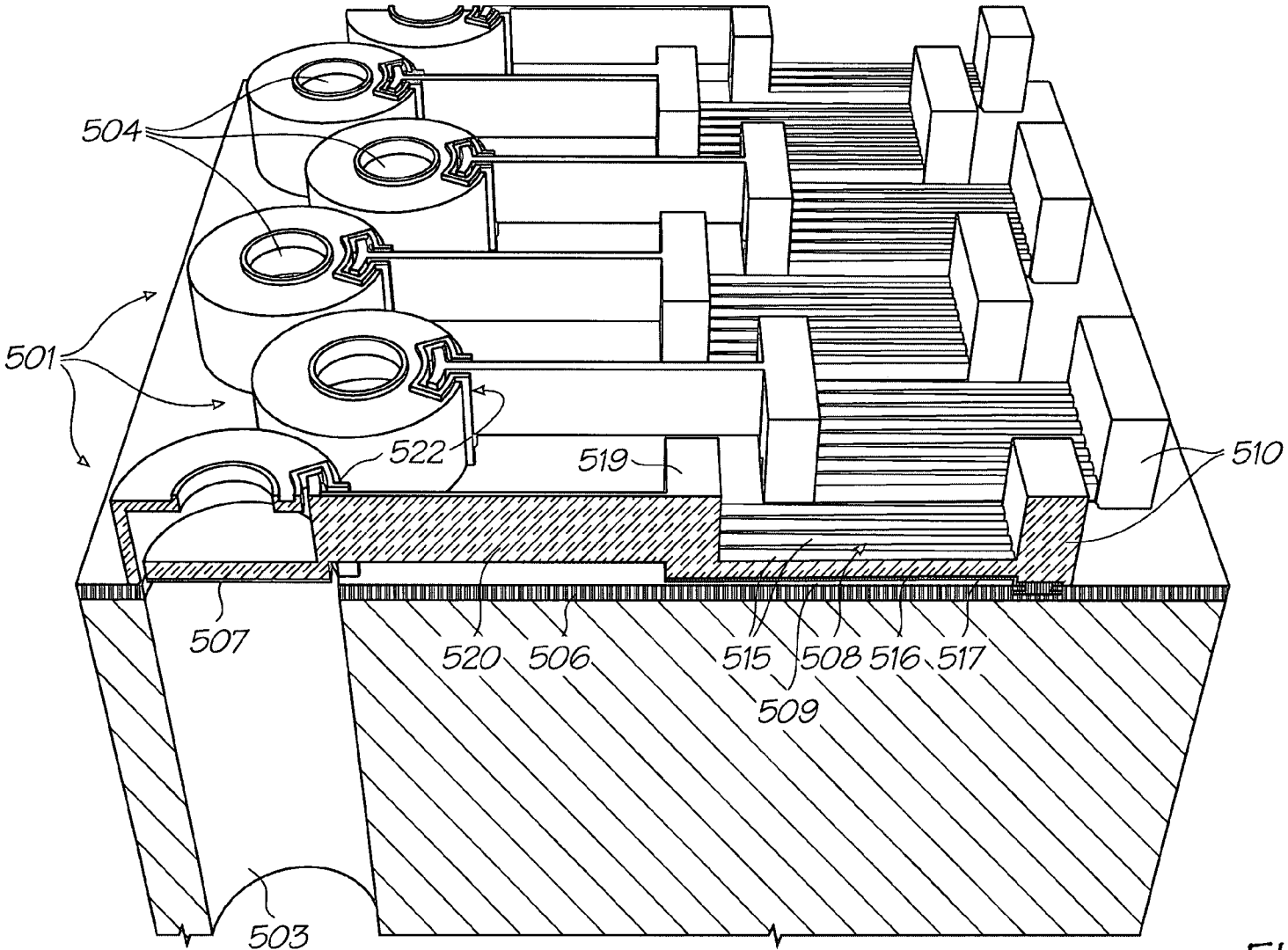
FIG. 54 shows an array of the nozzle arrangements shown in FIG. 53.

FIG. 53 illustrates a side perspective view of the nozzle arrangement. FIG. 54 illustrates sectional view through an array of nozzle arrangement of FIG. 53. In these figures, the numbering of elements previously introduced has been retained.

Firstly, the actuator 508 includes a series of tapered actuator units e.g. 515 which comprise an upper glass portion (amorphous silicon dioxide) 516 formed on top of a titanium nitride layer 517. Alternatively a copper nickel alloy layer (hereinafter called cupronickel) can be utilized which will have a higher bend efficiency.

The titanium nitride layer 517 is in a tapered form and, as such, resistive heating takes place near an end portion of the post 510. Adjacent titanium nitride/glass portions 515 are interconnected at a block portion 519 which also provides a mechanical structural support for the actuator 508.

The heater means 509 ideally includes a plurality of the tapered actuator unit 515 which are elongate and spaced apart such that, upon heating, the bending force exhibited along the axis of the actuator 508 is maximized. Slots are defined between adjacent tapered units 515 and allow for slight differential operation of each actuator 508 with respect to adjacent actuators 508.

The block portion 519 is interconnected to an arm 520. The arm 520 is in turn connected to the paddle 507 inside the nozzle chamber 501 by means of a slot e.g. 522 formed in the side of the nozzle chamber 501. The slot 522 is designed generally to mate with the surfaces of the arm 520 so as to minimize opportunities for the outflow of ink around the arm 520. The ink is held generally within the nozzle chamber 501 via surface tension effects around the slot 522.

When it is desired to actuate the arm 520, a conductive current is passed through the titanium nitride layer 517 within the block portion 519 connecting to a lower CMOS layer 506 which provides the necessary power and control circuitry for the nozzle arrangement. The conductive current results in heating of the nitride layer 517 adjacent to the post 510 which results in a general upward bending of the arm 20 and consequential ejection of ink out of the nozzle 504. The ejected drop is printed on a page in the usual manner for an inkjet printer as previously described.

An array of nozzle arrangements can be formed so as to create a single printhead. For example, in FIG. 54 there is illustrated a partly sectioned various array view which comprises multiple ink ejection nozzle arrangements laid out in interleaved lines so as to form a printhead array. Of course, different types of arrays can be formulated including full color arrays etc.

The construction of the printhead system described can proceed utilizing standard MEMS techniques through suitable modification of the steps as set out in U.S. Pat. No. 6,243,113 entitled "Image Creation Method and Apparatus (IJ 41)" to the present applicant, the contents of which are fully incorporated by cross reference.

The integrated circuits 74 may be arranged to have between 5000 to 100,000 of the above described ink delivery nozzles arranged along its surface, depending upon the length of the integrated circuits and the desired printing properties required. For example, for narrow media it may be possible to only require 5000 nozzles arranged along the surface of the printhead to achieve a desired printing result, whereas for wider media a minimum of 10,000, 20,000 or 50,000 nozzles may need to be provided along the length of the printhead to achieve the desired printing result. For full colour photo quality images on A4 or US letter sized media at or around 1600 dpi, the integrated circuits 74 may have 13824 nozzles per color. Therefore, in the case where the printhead 600 is capable of printing in 4 colours (C, M, Y, K), the integrated circuits 74 may have around 53396 nozzles disposed along the surface thereof. Further, in a case where the printhead is capable of printing 6 printing fluids (C, M, Y, K, IR and a fixative) this may result in 82944 nozzles being provided on the surface of the integrated circuits 74. In all such arrangements, the electronics supporting each nozzle is the same.

The manner in which the individual ink delivery nozzle arrangements may be controlled within the printhead cartridge 100 will now be described with reference to FIGS. 55-58.

Figure 55:
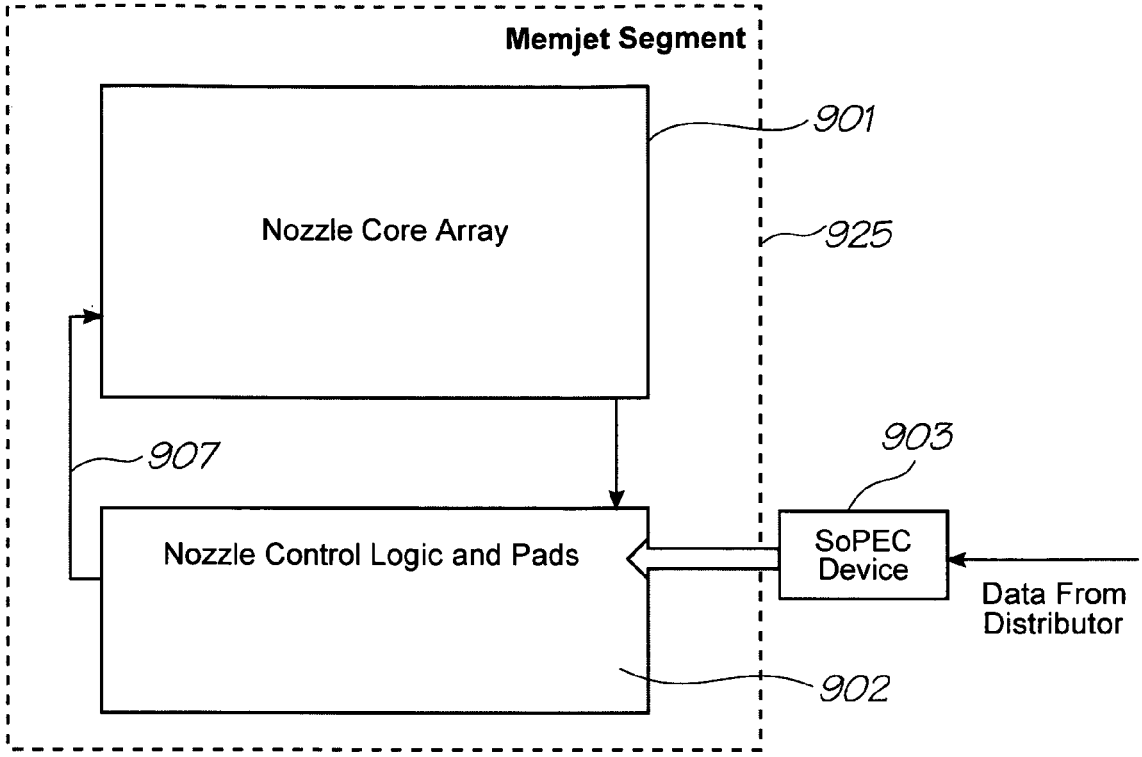
FIG. 55 shows a schematic showing CMOS drive and control blocks for use with the printer of the present invention.

FIG. 55 shows an overview of the integrated circuit 74 and its connections to the SoPEC device (discussed above) provided within the control electronics of the print engine 1. As discussed above, integrated circuit 74 includes a nozzle core array 901 containing the repeated logic to fire each nozzle, and nozzle control logic 902 to generate the timing signals to fire the nozzles. The nozzle control logic 902 receives data from the SoPEC device via a high-speed link.

The nozzle control logic 902 is configured to send serial data to the nozzle array core for printing, via a link 907, which may be in the form of an electrical connector. Status and other operational information about the nozzle array core 901 is communicated back to the nozzle control logic 902 via another link 908, which may be also provided on the electrical connector.

Figure 56:
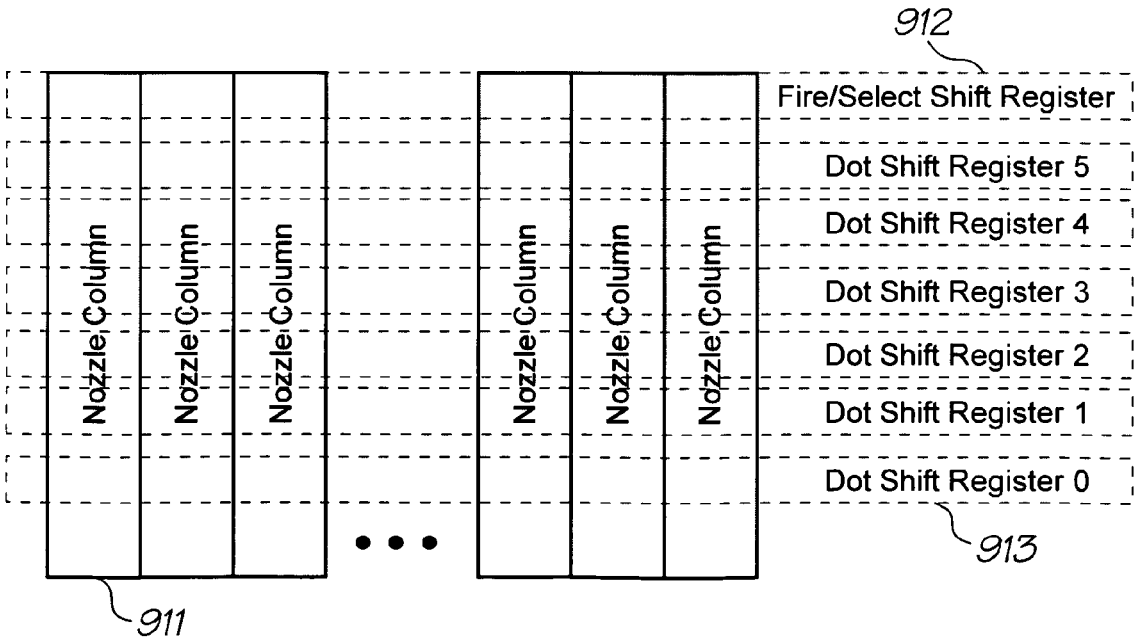
FIG. 56 shows a schematic showing the relationship between nozzle columns and dot shift registers in the CMOS blocks of FIG. 55.
Figure 57:
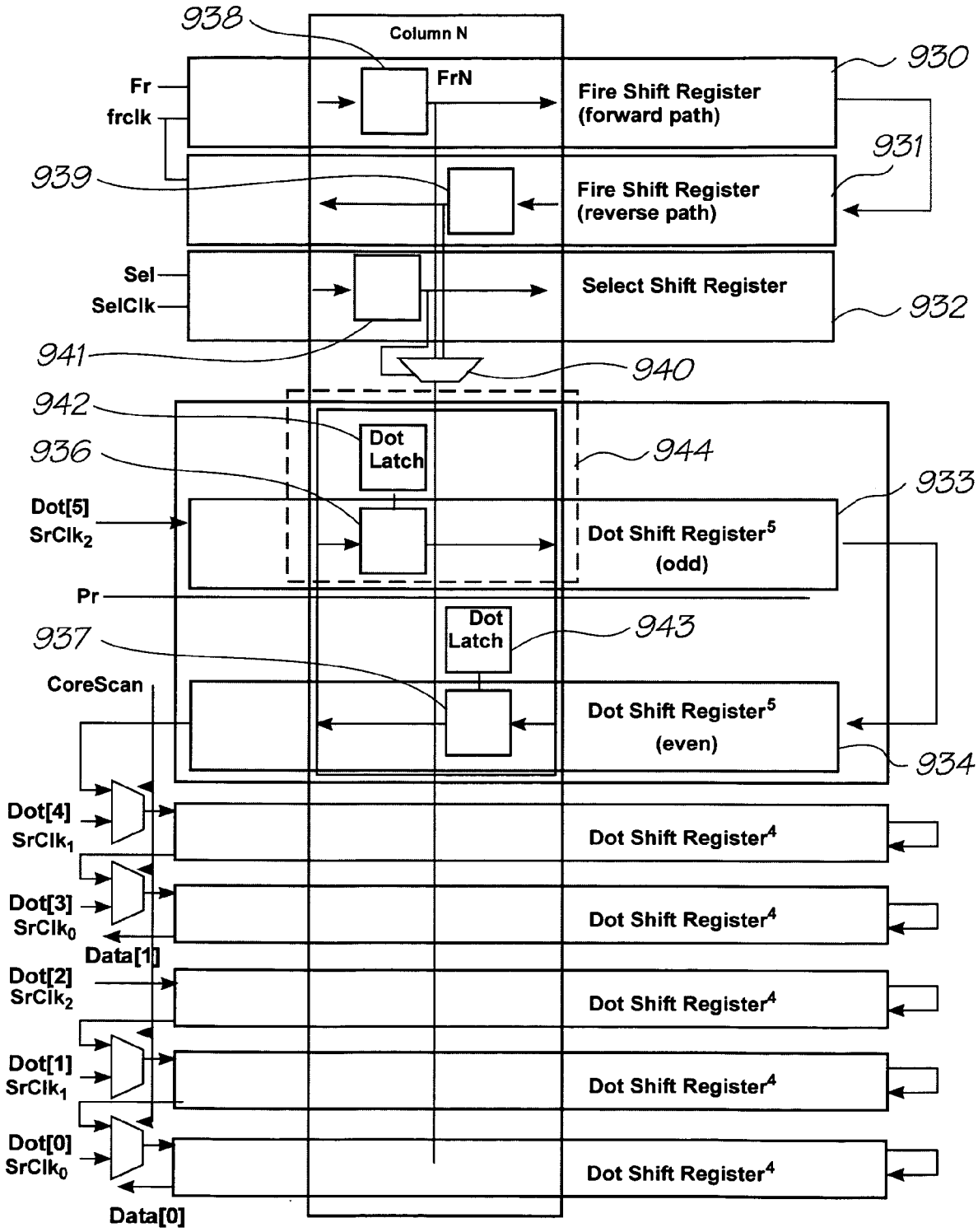
FIG. 57 shows a more detailed schematic showing a unit cell and its relationship to the nozzle columns and dot shift registers of FIG. 56; and, FIG. 58 shows a circuit diagram showing logic for a single printer nozzle in the printer of the present invention.

The nozzle array core 901 is shown in more detail in FIGS. 56 and 57. In FIG. 56, it will be seen that the nozzle array core 901 comprises an array of nozzle columns 911. The array includes a fire/select shift register 912 and up to 6 color channels, each of which is represented by a corresponding dot shift register 913.

As shown in FIG. 57, the fire/select shift register 912 includes forward path fire shift register 930, a reverse path fire shift register 931 and a select shift register 932. Each dot shift register 913 includes an odd dot shift register 933 and an even dot shift register 934. The odd and even dot shift registers 933 and 934 are connected at one end such that data is clocked through the odd shift register 933 in one direction, then through the even shift register 934 in the reverse direction. The output of all but the final even dot shift register is fed to one input of a multiplexer 935. This input of the multiplexer is selected by a signal (corescan) during post-production testing. In normal operation, the corescan signal selects dot data input Dot[x] supplied to the other input of the multiplexer 935. This causes Dot[x] for each color to be supplied to the respective dot shift registers 913.

A single column N will now be described with reference to FIG. 58. In the embodiment shown, the column N includes 12 data values, comprising an odd data value 936 and an even data value 937 for each of the six dot shift registers. Column N also includes an odd fire value 938 from the forward fire shift register 930 and an even fire value 939 from the reverse fire shift register 931, which are supplied as inputs to a multiplexer 940. The output of the multiplexer 940 is controlled by the select value 941 in the select shift register 932. When the select value is zero, the odd fire value is output, and when the select value is one, the even fire value is output.

Each of the odd and even data values 936 and 937 is provided as an input to corresponding odd and even dot latches 942 and 943 respectively.

Each dot latch and its associated data value form a unit cell, such as unit cell 944. A unit cell is shown in more detail in FIG. 58. The dot latch 942 is a D-type flip-flop that accepts the output of the data value 936, which is held by a D-type flip-flop 944 forming an element of the odd dot shift register 933. The data input to the flip-flop 944 is provided from the output of a previous element in the odd dot shift register (unless the element under consideration is the first element in the shift register, in which case its input is the Dot[x] value). Data is clocked from the output of flip-flop 944 into latch 942 upon receipt of a negative pulse provided on LsyncL.

The output of latch 942 is provided as one of the inputs to a three-input AND gate 945. Other inputs to the AND gate 945 are the Fr signal (from the output of multiplexer 940) and a pulse profile signal Pr. The firing time of a nozzle is controlled by the pulse profile signal Pr, and can be, for example, lengthened to take into account a low voltage condition that arises due to low power supply (in a removable power supply embodiment). This is to ensure that a relatively consistent amount of ink is efficiently ejected from each nozzle as it is fired. In the embodiment described, the profile signal Pr is the same for each dot shift register, which provides a balance between complexity, cost and performance. However, in other embodiments, the Pr signal can be applied globally (ie, is the same for all nozzles), or can be individually tailored to each unit cell or even to each nozzle.

Once the data is loaded into the latch 942, the fire enable Fr and pulse profile Pr signals are applied to the AND gate 945, combining to the trigger the nozzle to eject a dot of ink for each latch 942 that contains a logic 1.

The signals for each nozzle channel are summarized in the following table:

| Name | Direction | Description |
|---|---|---|
| D | Input | Input dot pattern to shift register bit |
| Q | Output | Output dot pattern from shift register bit |
| SrClk | Input | Shift register clock in - d is captured on rising edge of this clock |
| LsyncL | Input | Fire enable - needs to be asserted for nozzle to fire |
| Pr | Input | Profile - needs to be asserted for nozzle to fire |

Figure 58:
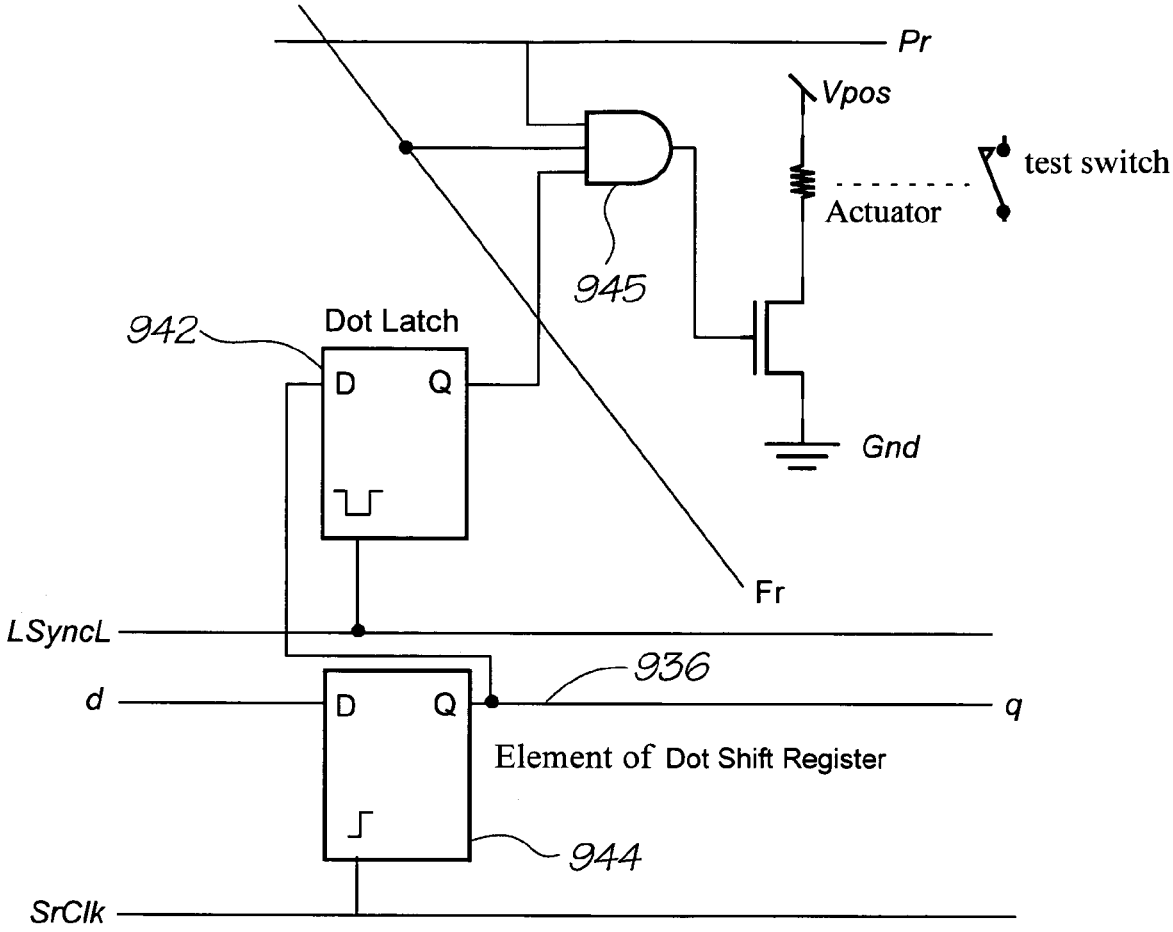

As shown in FIG. 58, the fire signals Fr are routed on a diagonal, to enable firing of one color in the current column, the next color in the following column, and so on. This averages the current demand by spreading it over 6 columns in time-delayed fashion.

The dot latches and the latches forming the various shift registers are fully static in this embodiment, and are CMOS-based. The design and construction of latches is well known to those skilled in the art of integrated circuit engineering and design, and so will not be described in detail in this document.

The nozzle speed may be as much as 20 kHz for the printer unit 2 capable of printing at about 60 ppm, and even more for higher speeds. At this range of nozzle speeds the amount of ink that can be ejected by the entire printhead 600 is at least 50 million drops per second. However, as the number of nozzles is increased to provide for higher-speed and higher-quality printing at least 100 million drops per second, preferably at least 500 million drops per second and more preferably at least 1 billion drops per second may be delivered. At such speeds, the drops of ink are ejected by the nozzles with a maximum drop ejection energy of about 250 nanojoules per drop.

Consequently, in order to accommodate printing at these speeds, the control electronics must be able to determine whether a nozzle is to eject a drop of ink at an equivalent rate. In this regard, in some instances the control electronics must be able to determine whether a nozzle ejects a drop of ink at a rate of at least 50 million determinations per second. This may increase to at least 100 million determinations per second or at least 500 million determinations per second, and in many cases at least 1 billion determinations per second for the higher-speed, higher-quality printing applications.

For the printer 2 of the present invention, the above-described ranges of the number of nozzles provided on the printhead 600 together with the nozzle firing speeds and print speeds results in an area print speed of at least 50 $cm^2$ per second, and depending on the printing speed, at least 100 $cm^2$ per second, preferably at least 200 $cm^2$ per second, and more preferably at least 500 $cm^2$ per second at the higher-speeds.

Such an arrangement provides a printer unit 2 that is capable of printing an area of media at speeds not previously attainable with conventional printer units.

The invention has been described herein by way of example only. Skilled workers in this field will readily recognize many variations or modifications that do not depart from the spirit and scope of the broad inventive concept.

The invention claimed is:

1. An inkjet printer comprising:

a printer body;

a printhead cartridge for installation in the printer body, the printhead cartridge having a pagewidth inkjet printhead structure with an array of nozzles;

a plurality of ink cartridges for supplying ink, the ink cartridge having a docking face for engagement with a complementary face to supply the printhead cartridge with ink, the complementary face being partially provided by the printhead cartridge and partially provided by the printer body; wherein, each of the ink cartridges connecting to respective ink inlets, a plurality of resilient connectors form part of the fluid paths to the nozzles from each of the ink inlets, the ink inlets and the resilient connectors being mounted in a docking frame for receiving the ink cartridges; such that, longitudinal expansion and contraction of the pagewidth printhead structure relative to the docking frame is accommodated by the resilient connectors.

2. An inkjet printer according to claim 1 wherein the printhead cartridge has a casing to support the printhead and the printer body has a cradle for holding the printhead cartridge in an operative position such that the printhead is adjacent a paper path defined by the printer body; wherein, during insertion, the cradle and the casing interact to form an over centre mechanism whereby, the printhead cartridge rotates against a bias prior until reaching a balance point, after which it is biased to rotate into the operative position.

3. An inkjet printer according to claim 2 wherein the casing has a plurality of contacts for receiving print data from corresponding contacts on the printer body when the printhead cartridge is in the operative position; wherein during installation, the casing acts as a lever to push the contacts into engagement with the corresponding contacts on the printer body.

4. An inkjet pritner according to claim 2 wherein the printhead the cradle has a biased locating abutment to apply a compressive force for maintaining the printhead cartridge in the operative position and the casing has a structural member extending from the fulcrum formation; such that during use, the structural member extends from the locating abutment to the complementary formation and is aligned with the direction of the compressive force.

5. An inkjet printer according to claim 1 wherein the docking frame is configured to receive five of the ink cartridges, the ink cartridges containing cyan, magenta, yellow, black and infra red ink respectively.

6. An inkjet printer according to claim 1 wherein the printhead cartridge has a maintenance station for engaging the pagewidth printhead when not in use;

the inkjet printer further comprises a maintenance station drive shaft for detachably engaging the maintenance station upon insertion of the printhead cartridge into the printer, the maintenance station drive shaft having an engagement formation at one end for engaging a complementary formation in the maintenance station; such that, when engaging the complementary formation, the engagement formation has limited axial displacement and limited transverse displacement.

7. An inkjet printer according to claim 1 wherein the ink inlet valve are each configured for sealed connection to respective outlets on the ink cartridges, each of the inlet valves having an inlet opening and a movable valve member biased into sealing engagement with the inlet opening, the outlet having a complementary member for depressing the movable valve member out of engagement with the inlet opening to open the valve; wherein, the inlet opening has an external formation about its periphery for sealing against the outlet before the complementary member depresses the movable valve member.

8. An inkjet printer according to claim 7 wherein the printhead assembly is a printhead cartridge for installation in the inkjet printer.

9. An inkjet printer according to claim 7 wherein the external formation is an outer surface of a ring member, the inlet opening is the hole defined by the ring member and an inner surface opposite the outer surface provides a valve seat for the movable valve member.

10. An inkjet printer according to claim 9 wherein the moveable valve member has a conical head for sealing against the valve seat supported on a based of compressible resilient material such that the complementary member compresses the base to open the inlet valve.

11. An inkjet printer according to claim 10 wherein the conical head has an apex that does not extend beyond the outer surface of the ring member so that the complementary member is within the inlet opening when the complementary member engages the conical head.

12. An inkjet printer according to claim 11 wherein the complementary member has a stem with a flange portion on its end, the flange portion having a recess corresponding to the apex end of the conical head, the flange portion having a diameter sized for a loose sliding fit within the inlet opening to displace substantially all the air from between the complementary member and the conical head before the inlet valve is opened.

13. An injet printer according to claim 12 wherein the ink cartridge outlet has an annular collar of resilient material that is biased to seal against the side of the flange portion opposite the recess, such that during use the external formation on the inlet valve seals against the annular collar of resilient material before the flange portion depressed the conical head to open the inlet valve.

14. An inkjet printer according to claim 13 wherein the external formation on the inlet valve seals against the annular collar immediately adjacent to the sides of the flange portion such that minimal air is trapped between the sides of the flange portion and the external formation.

15. An inkjet printer according to claim 14 wherein the ring member and the external formation are located within a frustoconical tube that tapers toward the outlet of the ink cartridge to guide the ink cartridge into correct position during installation.

16. An inkjet printer according to claim 13 further comprising a filter adjacent the inlet valve for trapping air bubbles and contaminants.

17. An inkjet printer according to claim 16 wherein the filter has a surface area larger than the area of the inlet opening such that its pore size is kept small while adversely constricting the ink flow.

18. An inkjet printer according to claim 17 further comprising a pressure regulator to cut fluid communication between the inlet valve and the nozzles if the pressure difference across the pressure regulator is below a certain threshold.

19. An inkjet printer according to claim 17 wherein the pressure regulator has a diaphragm biased to seal against a regulator valve seat such that upstream pressure acts on one side of the diaphragm and down stream pressure acts the opposite side.

* * * * *